US008102388B2

(12) United States Patent
Yamashita et al.

(10) Patent No.: US 8,102,388 B2
(45) Date of Patent: Jan. 24, 2012

(54) METHOD OF DRIVING ORGANIC ELECTROLUMINESCENCE DISPLAY APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 241 days.

(21) Appl. No.: 12/591,706

(22) Filed: Nov. 30, 2009

(65) Prior Publication Data

US 2010/0141627 A1 Jun. 10, 2010

(30) Foreign Application Priority Data

Dec. 8, 2008 (JP) ..... 2008-311805

(51) Int. Cl.
*G09G 5/00* (2006.01)

(52) U.S. Cl. ..... 345/212; 345/92; 345/204; 345/211

(58) Field of Classification Search ..... 345/76–84, 345/90–100, 204–215; 315/169.1–169.4
See application file for complete search history.

(56) References Cited

U.S. PATENT DOCUMENTS 6,356,026 B1 * 3/2002 Murto ..... 315/111.81
6,693,388 B2 * 2/2004 Oomura ..... 315/169.3

FOREIGN PATENT DOCUMENTS

| | | | |
|---|---|---|---|
| JP | 2003-271095 | A | 9/2003 |
| JP | 2007-156460 | A | 6/2007 |
| JP | 2007-310311 | | 11/2007 |
| JP | 2008-032863 | A | 2/2008 |
| JP | 2008-033193 | A | 2/2008 |
| JP | 2008-233501 | A | 10/2008 |
| JP | 2008-233651 | A | 10/2008 |
| JP | 2009-168968 | A | 7/2009 |
| JP | 2009-271336 | A | 11/2009 |
| JP | 2010-113188 | A | 5/2010 |

OTHER PUBLICATIONS

Japanese Office Action issued Mar. 1, 2011 for corresponding Japanese Application No. 2008-311805.

* cited by examiner

*Primary Examiner* — Vijay Shankar
(74) *Attorney, Agent, or Firm* — Rader, Fishman & Grauer PLLC

(57) ABSTRACT

A display apparatus includes a plurality of light-emitting elements, a driving circuit disposed in each of the plurality of light emitting elements, scanning lines, emission control lines, and data lines. Here, each driving circuit includes a driving transistor supplying current to the corresponding light-emitting element, changes the emission control signal from a first voltage value to a second voltage value to make the light-emitting element be in a non-emission state, and changes the emission control signal from the second voltage value to the first voltage value to correct the threshold voltage of the driving transistor, and the emission control signal has the first voltage value in a period other than a period of the second voltage value for correcting the threshold voltage of the driving transistor in a subsequent non-emission period.

8 Claims, 31 Drawing Sheets

FIG. 5A [TP(2)$_0$']
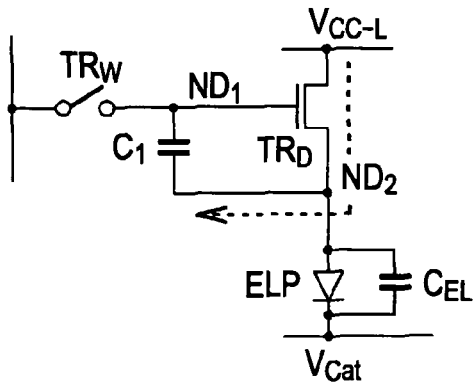
FIG. 5B [TP(2)$_1$']
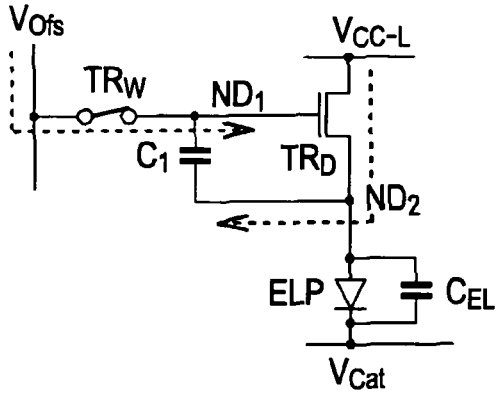
FIG. 5C [TP(2)$_2$']
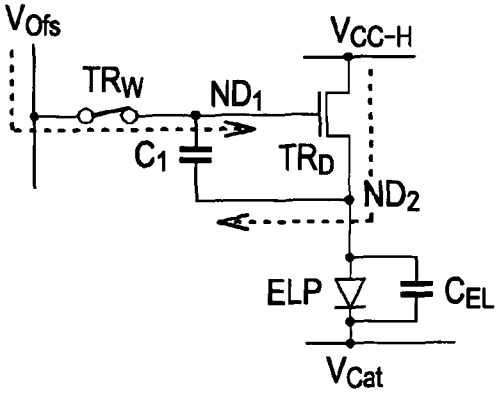
FIG. 5D [TP(2)$_3$']
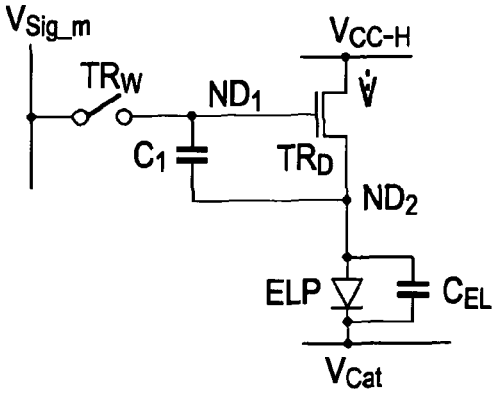
FIG. 5E [TP(2)$_4$']
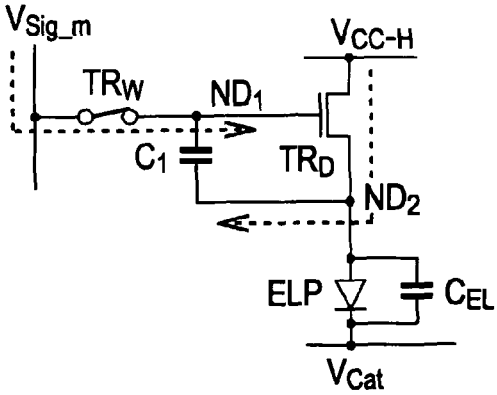
FIG. 5F [TP(2)$_5$']
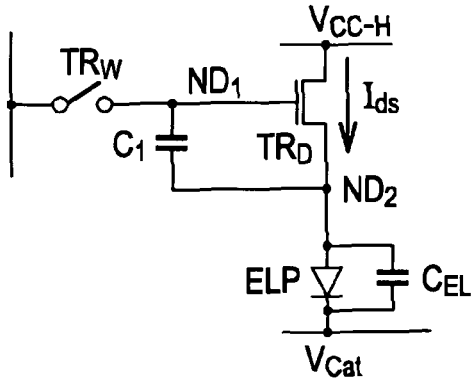

[ $TP(2)_6'$ ]

[ $TP(2)_{+1}'$ ]

FIG. 8A [TP(2)$_{-1}$]
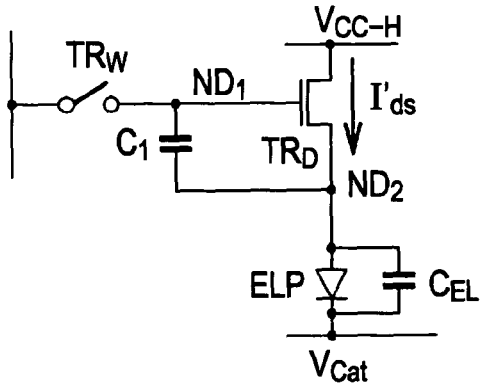
FIG. 8B [TP(2)$_0$]
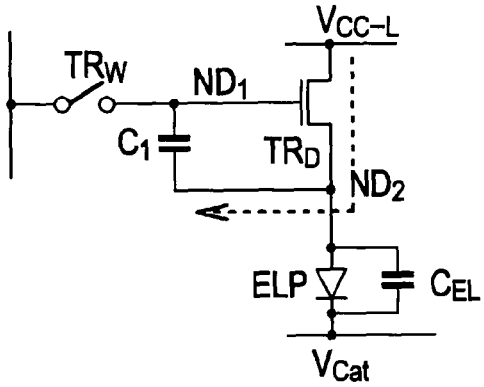
FIG. 8C [TP(2)$_1$]
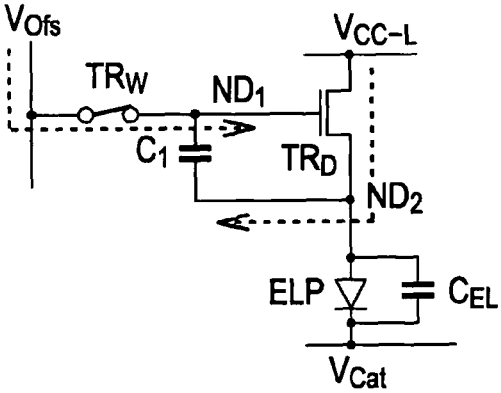
FIG. 8D [TP(2)$_2$]
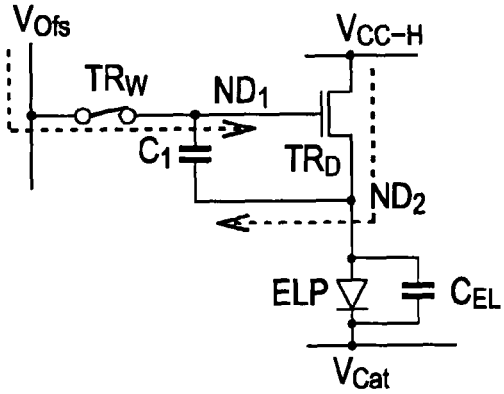
FIG. 8E [TP(2)$_2$] (CONTINUED)
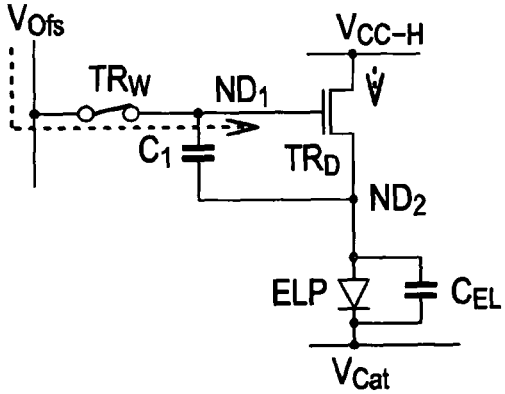
FIG. 8F [TP(2)$_3$]
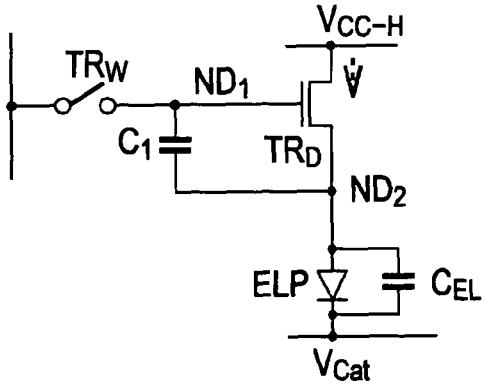

FIG. 9A [TP(2)4]
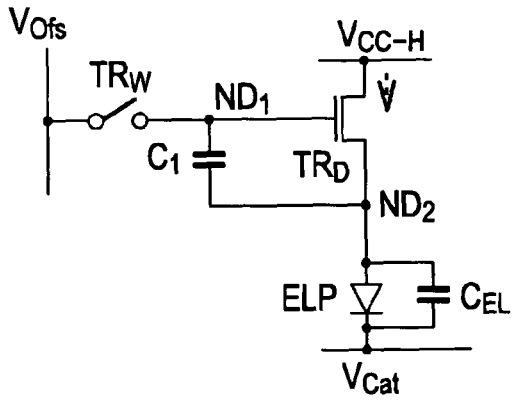
FIG. 9B [TP(2)5]
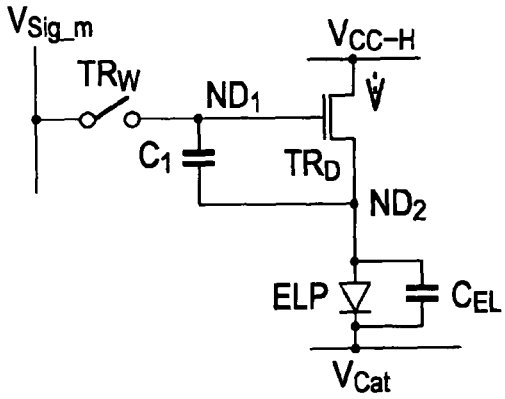
FIG. 9C [TP(2)6]
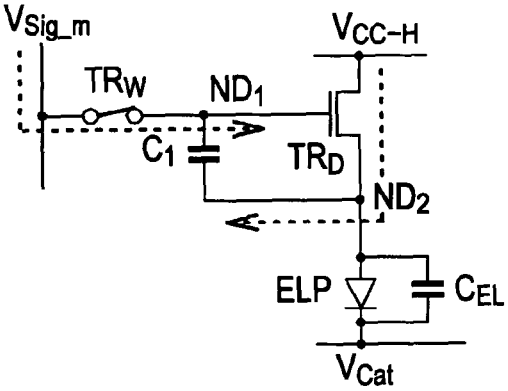
FIG. 9D [TP(2)7]
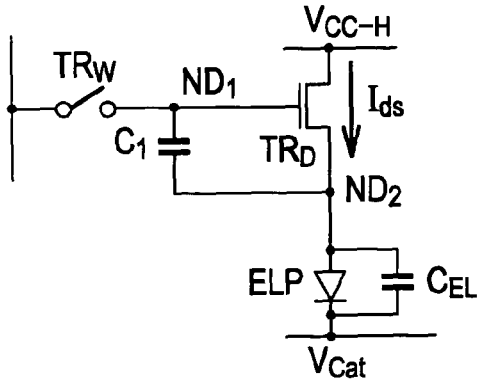
FIG. 9E [TP(2)8]
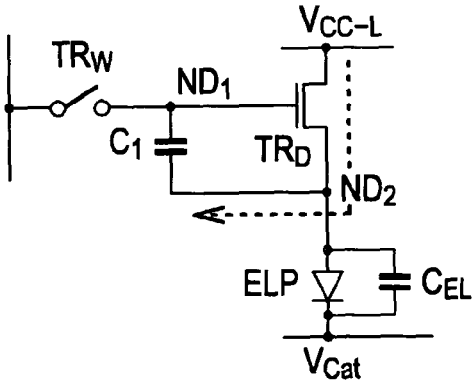
FIG. 9F [TP(2)+1]
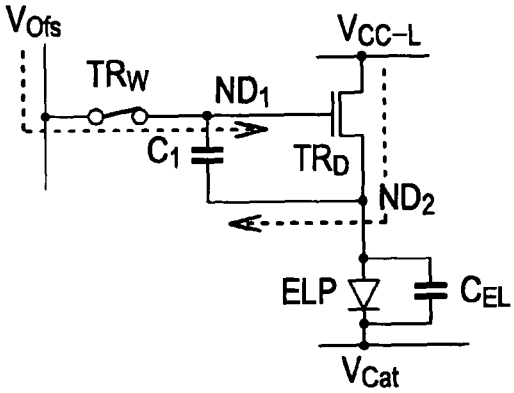

FIG. 11A [TP(2)3A]
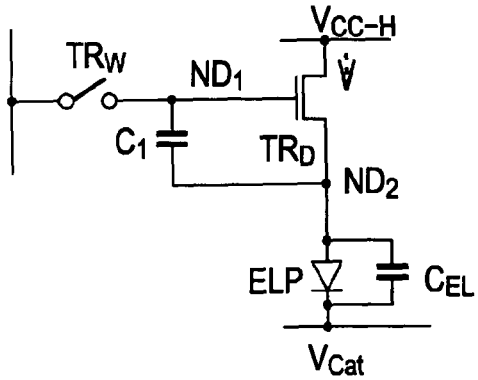
FIG. 11B [TP(2)3B]
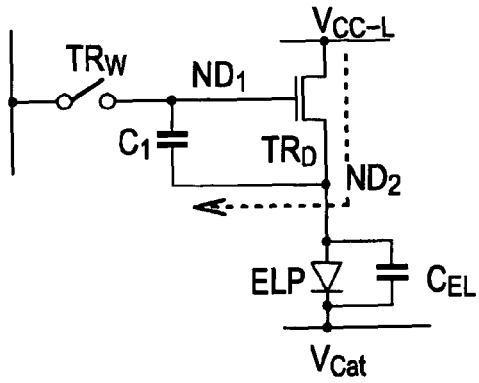
FIG. 11C [TP(2)4A]
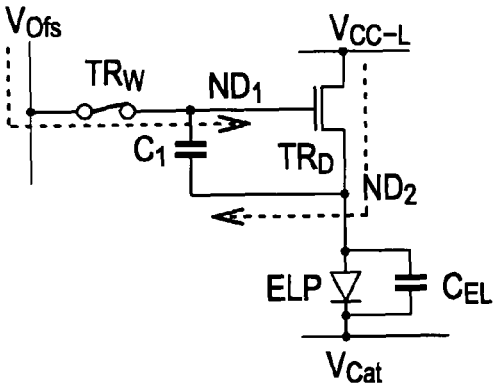
FIG. 11D [TP(2)4B]
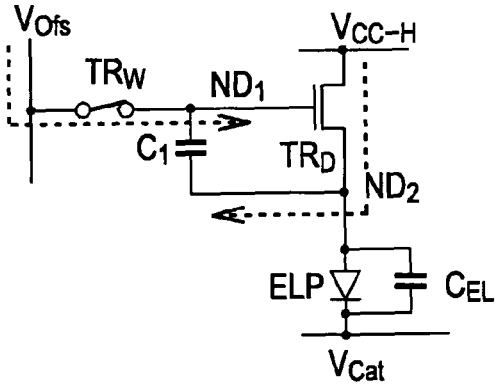
FIG. 11E [TP(2)4B] (CONTINUED)
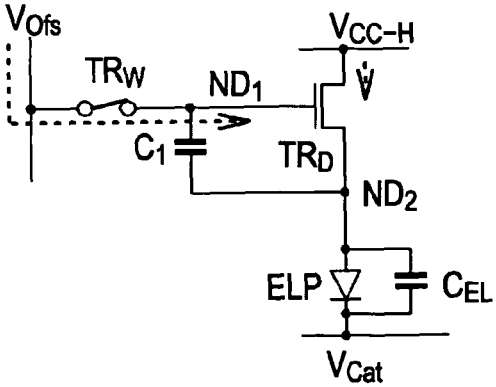

FIG. 13A [TP(2)$_0$]
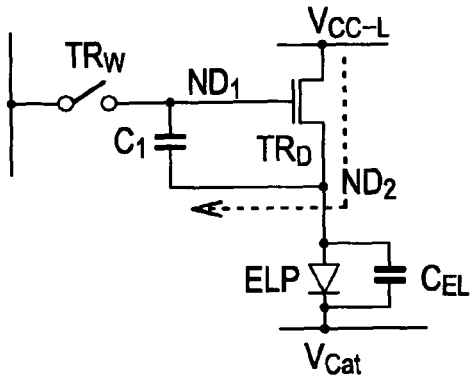
FIG. 13B [TP(2)$_1$]
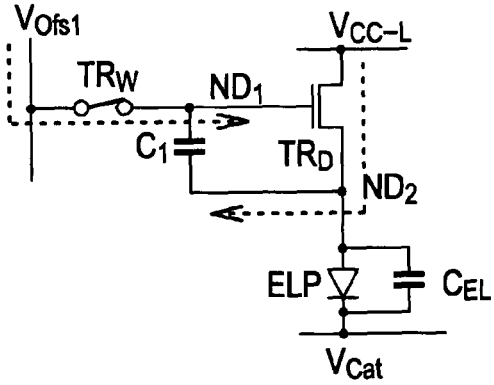
FIG. 13C [TP(2)$_{2A}$]
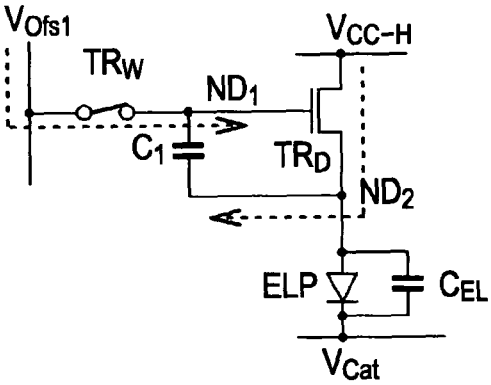
FIG. 13D [TP(2)$_{2A}$] (CONTINUED)
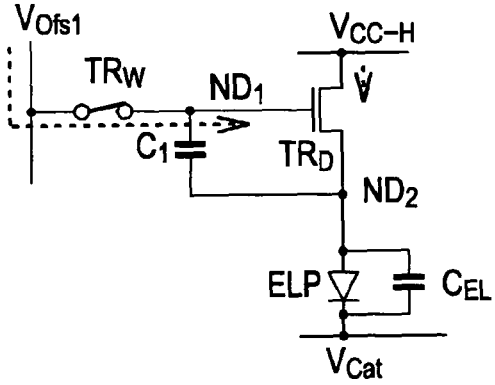
FIG. 13E [TP(2)$_{2B}$]
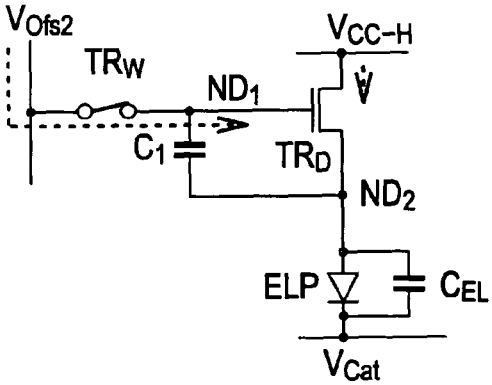
FIG. 13F [TP(2)$_3$]
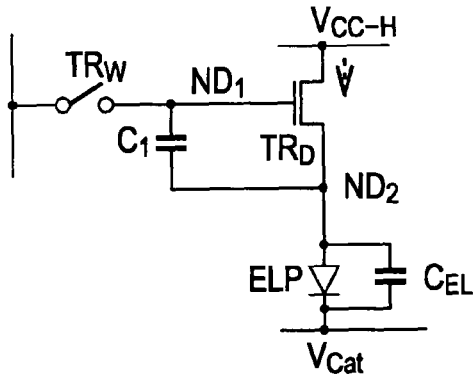

FIG. 15A [TP(2)$_2$]
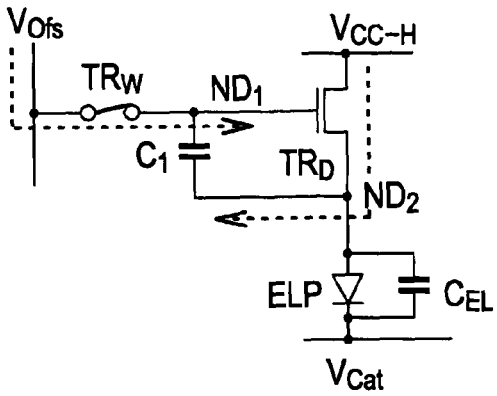
FIG. 15B [TP(2)$_{3A}$]
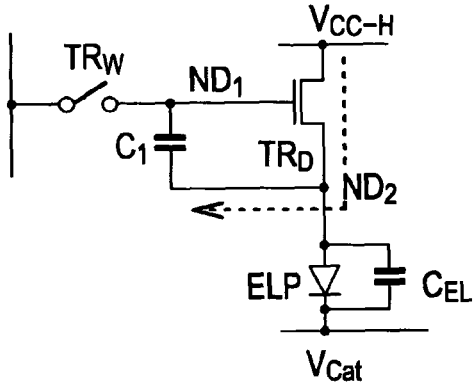
FIG. 15C [TP(2)$_{3B}$]
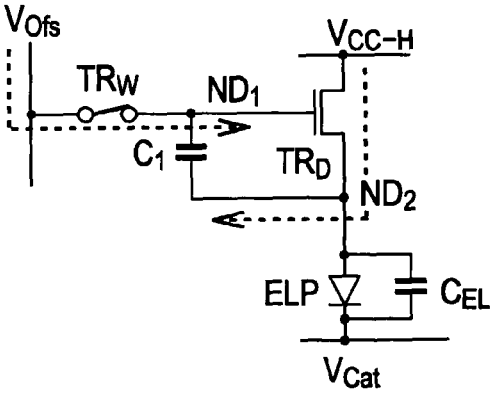
FIG. 15D [TP(2)$_{3B}$] (CONTINUED)
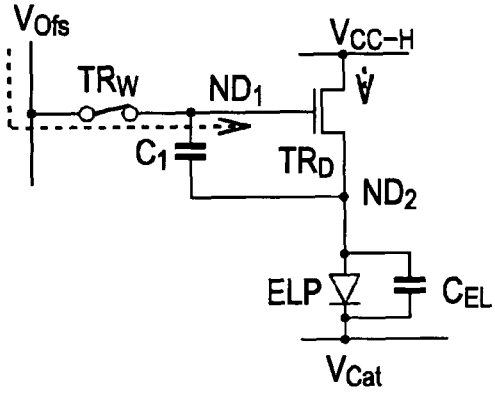
FIG. 15E [TP(2)$_{3C}$]
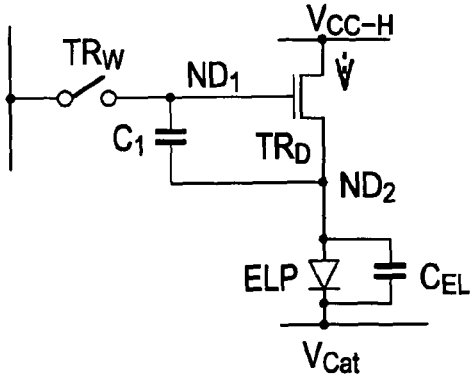

FIG. 19A [TP(3)$_{-1}$]
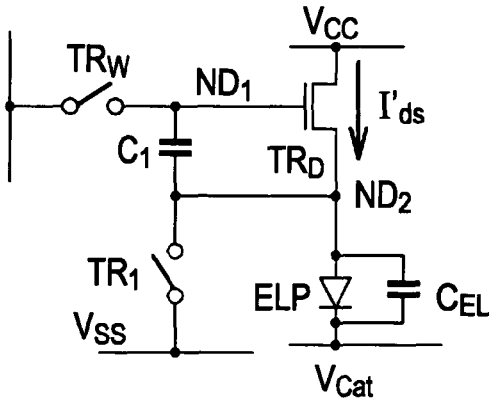
FIG. 19B [TP(3)$_0$]
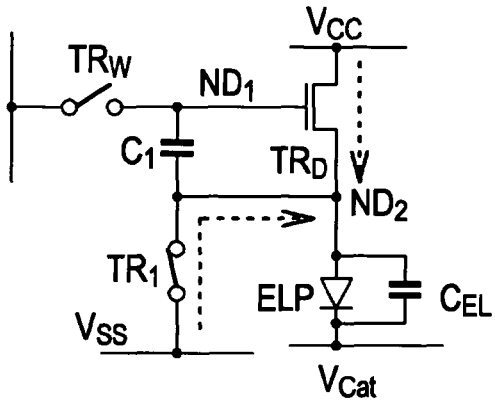
FIG. 19C [TP(3)$_1$]
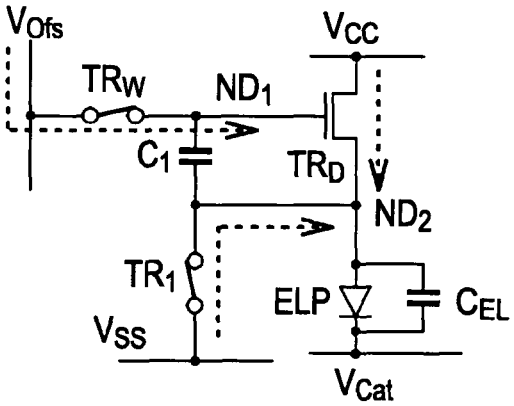
FIG. 19D [TP(3)$_2$]
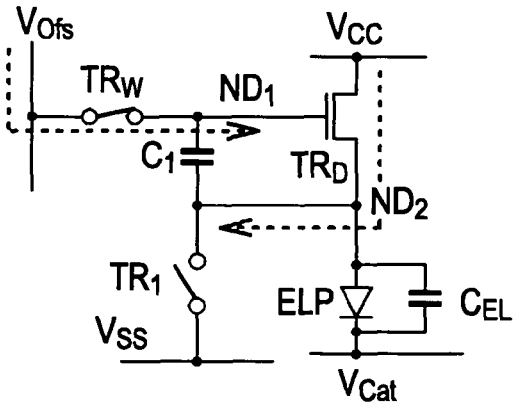
FIG. 19E [TP(3)$_2$] (CONTINUED)
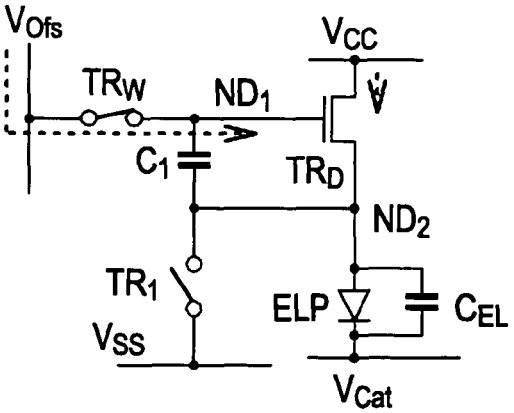
FIG. 19F [TP(3)$_3$]
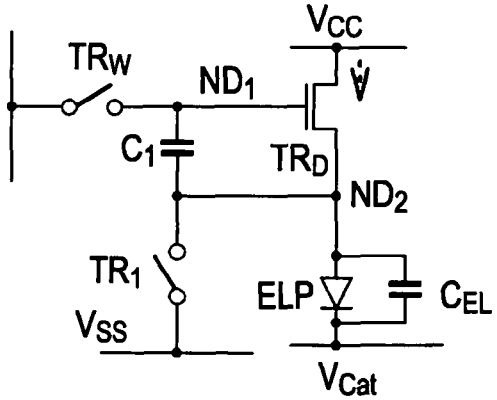

FIG. 20A [TP(3)$_4$]
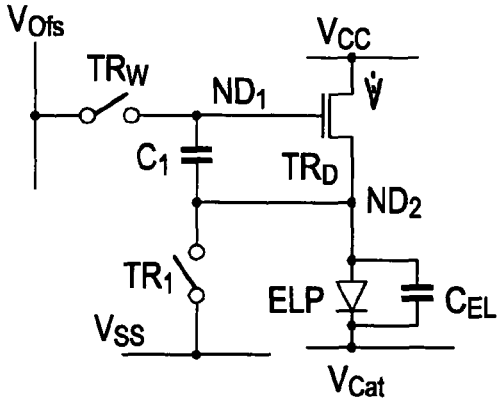
FIG. 20B [TP(3)$_5$]
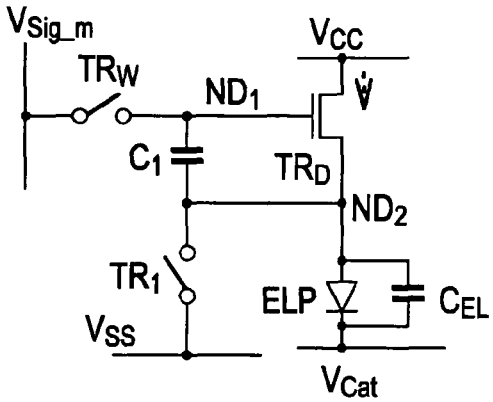
FIG. 20C [TP(3)$_6$]
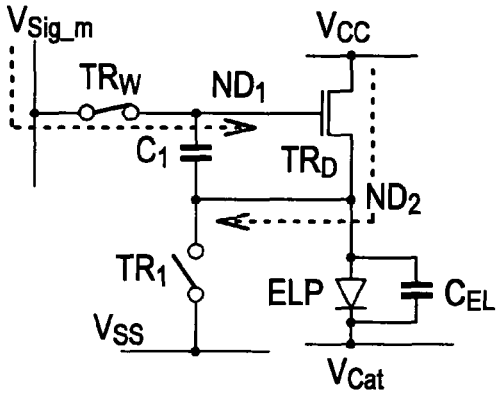
FIG. 20D [TP(3)$_7$]
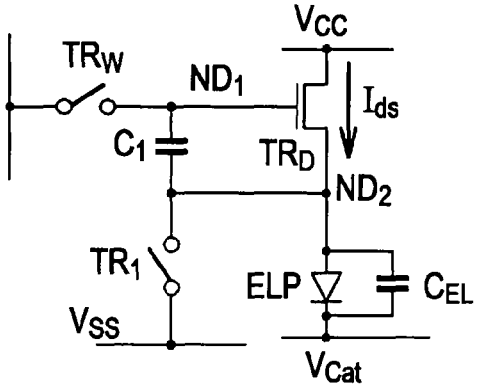
FIG. 20E [TP(3)$_8$]
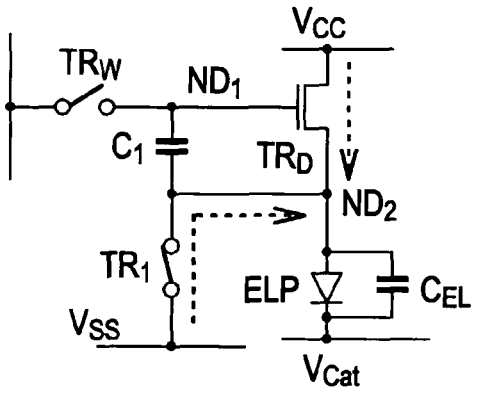
FIG. 20F [TP(3)$_{+1}$]
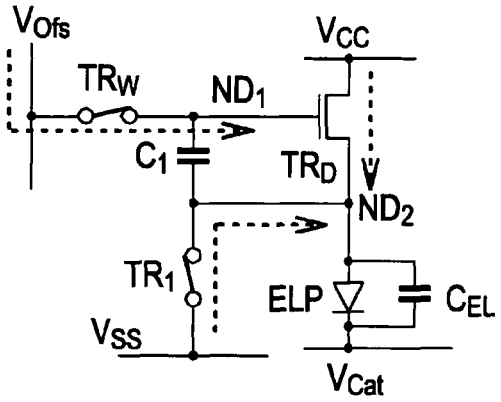

FIG. 22A [ $TP(3)_{3A}$ ]
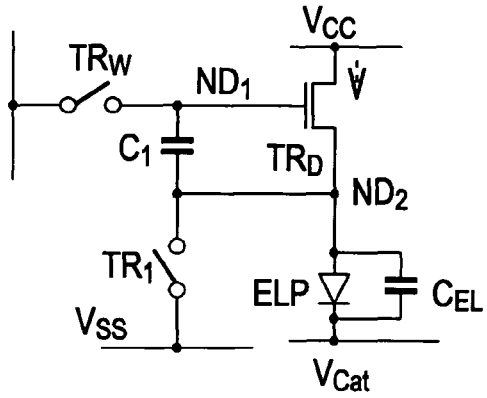
FIG. 22B [ $TP(3)_{3B}$ ]
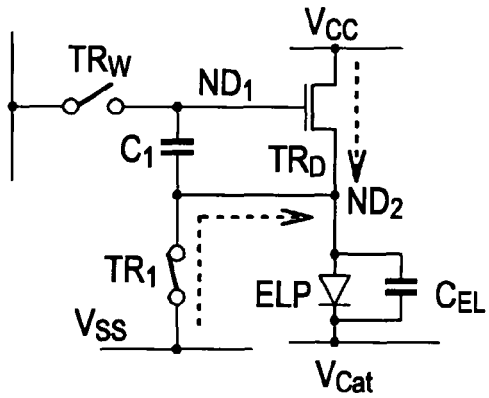
FIG. 22C [ $TP(3)_{4A}$ ]
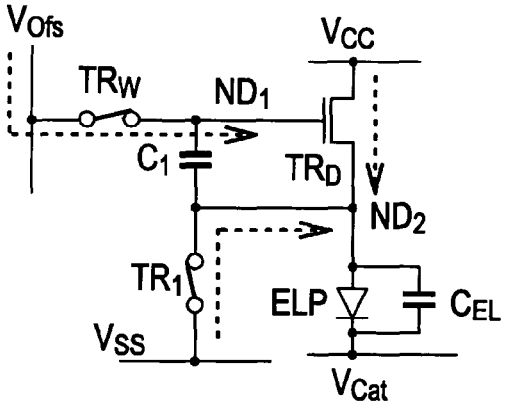
FIG. 22D [ $TP(3)_{4B}$ ]
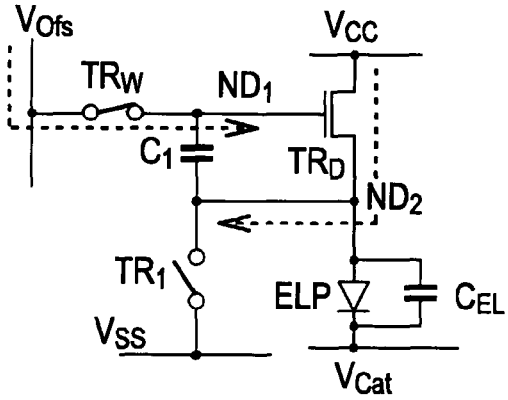
FIG. 22E [ $TP(3)_{4B}$ ] (CONTINUED)
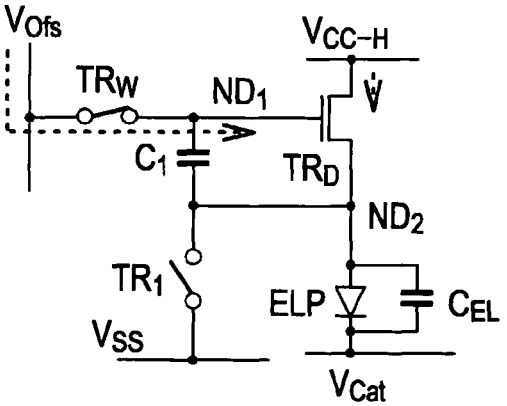

FIG. 24A [TP(3)$_0$]
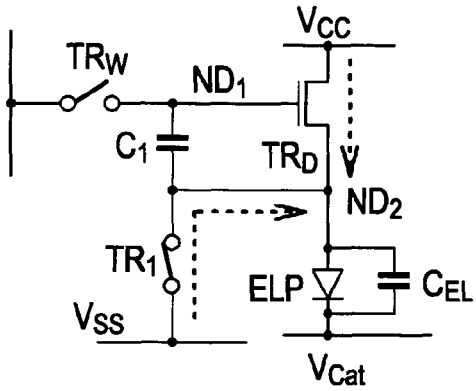
FIG. 24B [TP(3)$_1$]
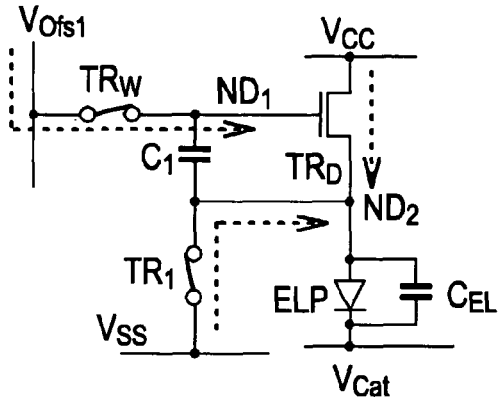
FIG. 24C [TP(3)$_{2A}$]
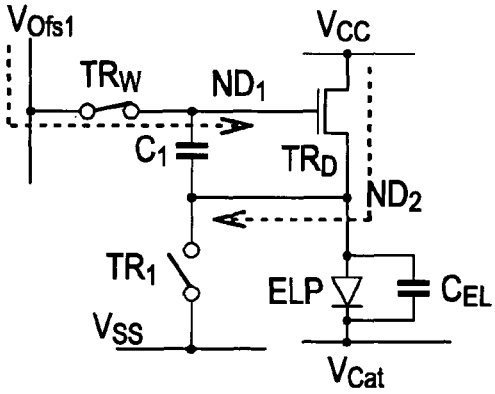
FIG. 24D [TP(3)$_{2A}$] (CONTINUED)
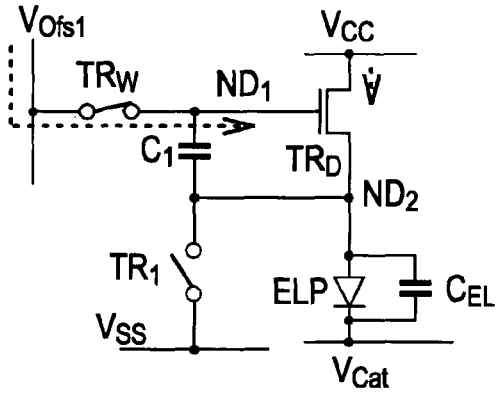
FIG. 24E [TP(3)$_{2B}$]
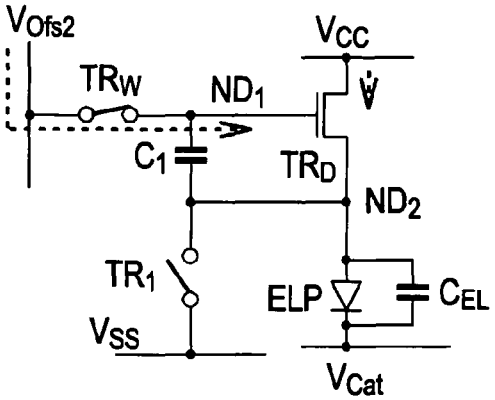
FIG. 24F [TP(3)$_3$]
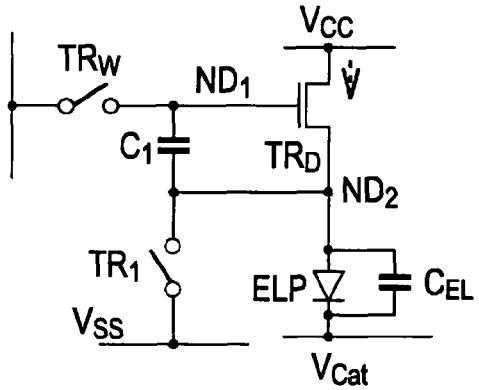

FIG. 26A [TP(3)$_2$]
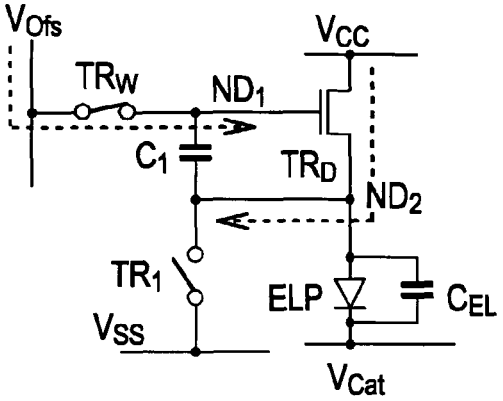
FIG. 26B [TP(3)$_{3A}$]
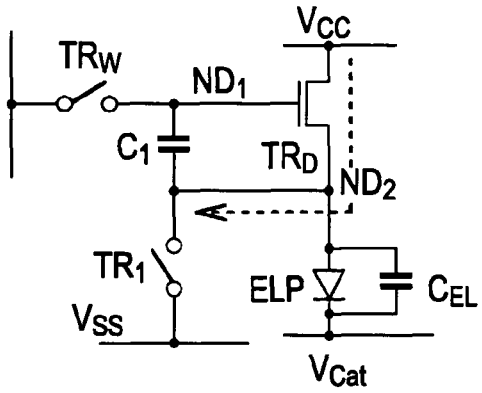
FIG. 26C [TP(3)$_{3B}$]
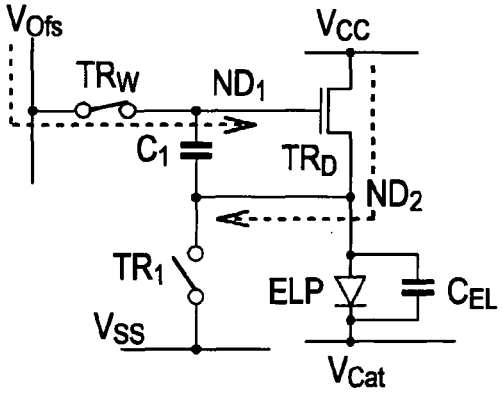
FIG. 26D [TP(3)$_{3B}$] (CONTINUED)
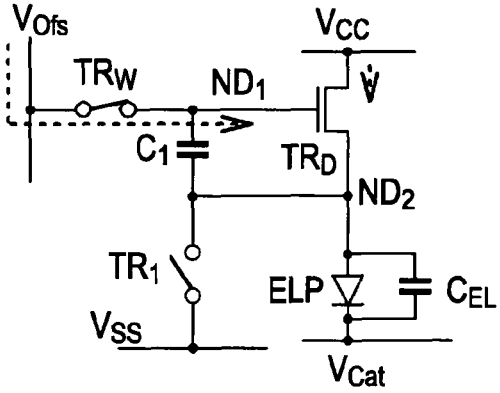
FIG. 26E [TP(3)$_{3C}$]
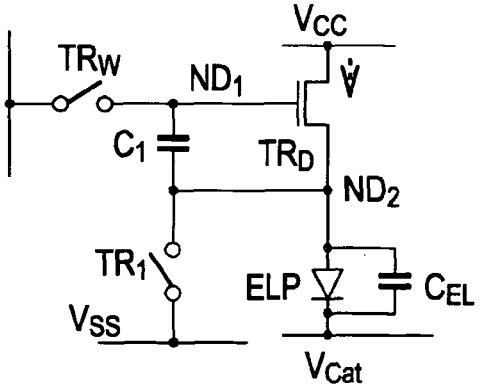

FIG. 29A [TP(3)$_{-1}$]
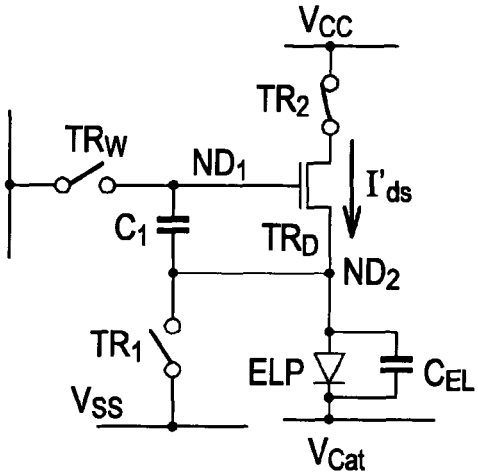
FIG. 29B [TP(3)$_0$]
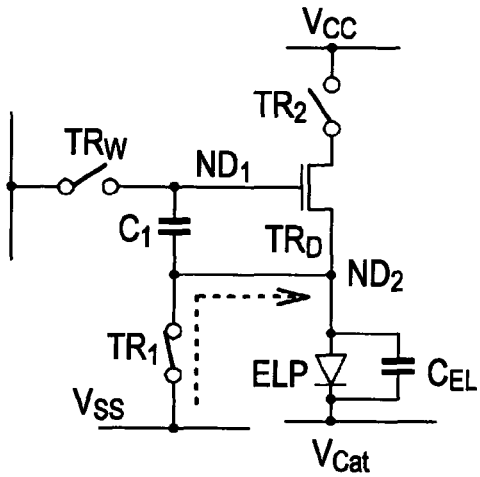
FIG. 29C [TP(3)$_1$]
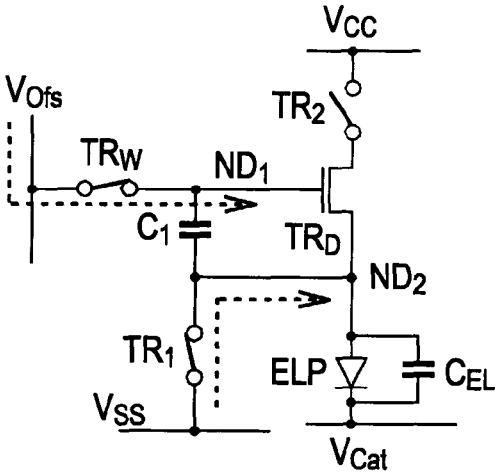
FIG. 29D [TP(3)$_2$]
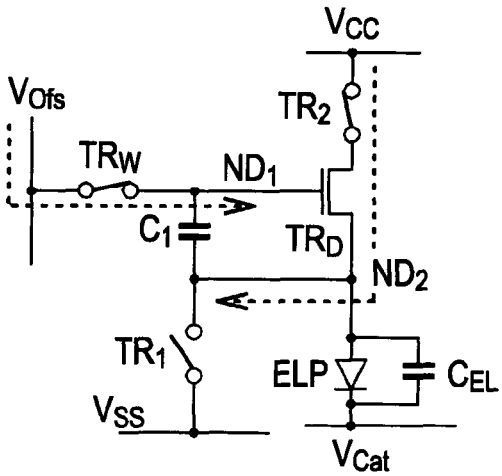

FIG. 31A [TP(3)$_{-1}$]
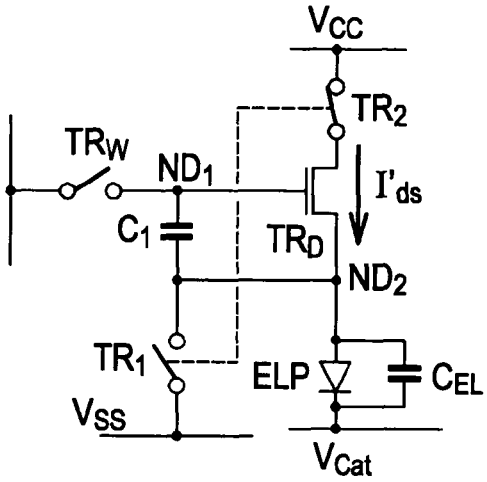
FIG. 31B [TP(3)$_0$]
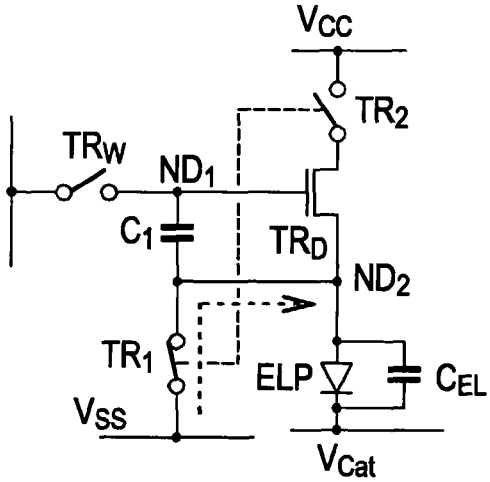
FIG. 31C [TP(3)$_1$]
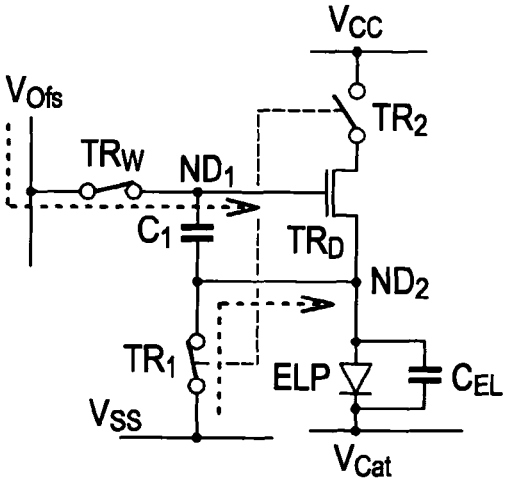
FIG. 31D [TP(3)$_2$]
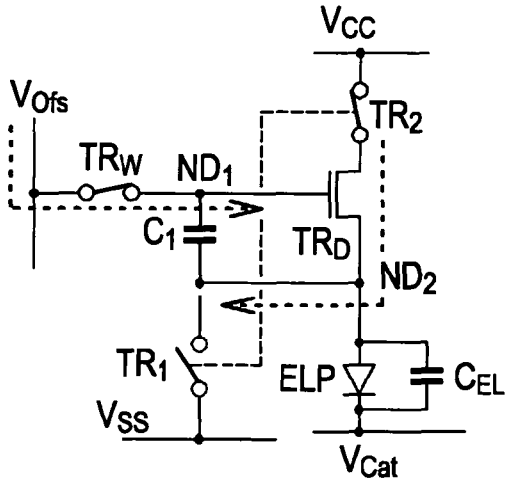

METHOD OF DRIVING ORGANIC ELECTROLUMINESCENCE DISPLAY APPARATUS

BACKGROUND OF THE INVENTION

1. Field of the Invention

The present invention relates to a method of driving an organic electroluminescence display apparatus.

2. Description of the Related Art

A display element having a light-emitting portion and a display apparatus having the display elements are known well. For example, display elements (hereinafter, also referred to as "organic EL display elements") having an organic electroluminescence (hereinafter, also abbreviated as "EL") light-emitting portion using the electroluminescence phenomenon of an organic material attract attention as display elements capable of emitting light with high luminance by low-voltage DC driving.

In an organic EL display apparatus having organic EL display elements, such as a liquid crystal display apparatus, a simple matrix driving method and an active matrix driving method are known well as a driving method. The active matrix driving method has a disadvantage that the structure is complicated but has an advantage that it can enhance the luminance of an image. The organic EL display element driven in the active matrix driving method should have a driving circuit driving a light-emitting portion in addition to the light-emitting portion formed of an organic layer including a light-emitting layer.

As a circuit driving an organic EL light-emitting portion (hereinafter, also referred to as "light-emitting portion"), a driving circuit (referred to as "2Tr/1C driving circuit") including two transistors and one capacitor is disclosed, for example, in Japanese Unexamined Patent Application Publication No. 2007-310311. As shown in FIG. 2, the 2Tr/1C driving circuit includes two transistors these being a writing transistor $TR_W$ and a driving transistor $TR_D$ and one capacitor $C_1$. Here, one of source and drain regions of the driving transistor $TR_D$ forms a second node $ND_2$ and the gate electrode of the driving transistor $TR_D$ forms a first node $ND_1$.

As shown in the timing diagram of FIG. 4, a preprocessing process of a threshold voltage canceling process is performed in period $TP(\mathbf{2})_1'$. That is, a first node initialization voltage $V_{Ofs}$ (for example, 0 V) is applied to the first node $ND_1$ from a data line DTL via the writing transistor $TR_W$ turned on by a signal from a scanning line SCL. Accordingly, the potential of the first node $ND_1$ is $V_{Ofs}$. A second node initialization voltage $V_{CC-L}$ (for example, −10 V) is applied to the second node $ND_2$ from a power source unit 100 via the driving transistor $TR_D$. Accordingly, the potential of the second node $ND_2$ is $V_{CC-L}$. The threshold voltage of the driving transistor $TR_D$ is represented by $V_{th}$ (for example, 3 V). The potential difference between the gate electrode of the driving transistor $TR_D$ and the other of the source and drain regions (hereinafter, also referred to as source region for the purpose of convenience) thereof is equal to or greater than $V_{th}$ and the driving transistor $TR_D$ is thus turned on. A cathode of the light-emitting portion ELP is connected to a power supply line PS2 through which a voltage $V_{Cat}$ (for example, 0 V) is applied.

Then, in period $TP(\mathbf{2})_2'$, the threshold voltage canceling process is performed. That is, with the writing transistor $TR_W$ kept in the ON state, the voltage of the power source unit 100 is switched from the second node initialization voltage $V_{CC-L}$ to a driving voltage $V_{CC-H}$ (for example, 20 V). As a result, the potential of the second node $ND_2$ varies to the potential obtained by subtracting the threshold voltage $V_{th}$ of the driving transistor $TR_D$ from the potential of the first node $ND_1$. That is, the potential of the second node $ND_2$ in a floating state increases. When the potential difference between the gate electrode of the driving transistor $TR_D$ and the source region reaches $V_{th}$, the driving transistor $TR_D$ is turned off. In this state, the potential of the second node $ND_2$ is about $(V_{Ofs}-V_{th})$.

Thereafter, in period $TP(\mathbf{2})_3'$, the writing transistor $TR_W$ is turned off. The voltage of the data line DTL is changed to the voltage (the image signal (driving signal, luminance signal) $V_{Sig_m}$ for controlling the luminance of the light-emitting portion ELP) corresponding to the image signal.

Then, in period $TP(\mathbf{2})_4'$, a writing process is performed. Specifically, the writing transistor $TR_W$ is turned on by setting the scanning line SCL to a high level. As a result, the potential of the first node $ND_1$ increases to the image signal $V_{Sig_m}$.

Here, the value of the capacitor $C_1$ is set to $c_1$ and the value of the capacitor $C_{EL}$ of the light-emitting portion ELP is set to $c_{EL}$. The parasitic capacitance value between the gate electrode of the driving transistor $TR_D$ and the other of the source and drain regions is set to $c_{gs}$. When the potential of the gate electrode of the driving transistor $TR_D$ is changed from $V_{Ofs}$ to $V_{Sig_m}$ ($>V_{Ofs}$), the potential between both electrodes of the capacitor $C_1$ (that is, the potential between the first node $ND_1$ and the second node $ND_2$) is also changed in principle. That is, electric charges based on the variation $(V_{Sig_m}-V_{Ofs})$ in the potential of the gate electrode (=the potential of the first node $ND_1$) of the driving transistor $TR_D$ are distributed to the capacitor $C_1$, the capacitor $C_{EL}$ of the light-emitting portion ELP, and the parasitic capacitor between the gate electrode of the driving transistor $TR_D$ and the other of the source and drain regions. When the value of $c_{EL}$ is much greater than the value of $c_1$ and the value of $c_{gs}$, the variation in potential of the other (second node $ND_2$) of the source and drain regions of the driving transistor $TR_D$ based on the variation in potential $(V_{Sig_m}-V_{Ofs})$ of the gate electrode of the driving transistor $TR_D$ is small. In general, the value $c_{EL}$ of the capacitor $C_{EL}$ of the light-emitting portion ELP is greater than the value $c_1$ of the capacitor $C_1$ and the value $c_{gs}$ of the parasitic capacitor of the driving transistor $TR_D$. Accordingly, for the purpose of simplifying the explanation, the variation in potential of the second node $ND_2$ resulting from the variation in potential of the first node $ND_1$ is not considered in the following description. In the driving timing diagram shown in FIG. 4, the variation in potential of the second node $ND_2$ resulting from the variation in potential of the first node $ND_1$ is not considered.

In the above-mentioned operations, in a state where the voltage $V_{CC-H}$ is applied to one of the source and drain regions of the driving transistor $TR_D$ from the power source unit 100, the image signal $V_{Sig_m}$ is applied to the gate electrode of the driving transistor $TR_D$. Accordingly, as shown in FIG. 4, the potential of the second node $ND_2$ increases in period $TP(\mathbf{2})_4'$. The amount of increasing potential $\Delta V$ (potential correcting value) will be described later. When the potential of the gate electrode (first node $ND_1$) of the driving transistor $TR_D$ is $V_g$ and the potential of the other of the source and drain regions (second node $ND_2$) is $V_s$, the value of $V_g$ and the value of $V_s$ are as follows without considering the amount of increasing potential $\Delta V$ of the second node $ND_2$. The potential difference between the first node $ND_1$ and the second node $ND_2$, that is, the potential difference $V_{gs}$ between the gate electrode of the driving transistor $TR_D$ and the other of the source and drain regions serving as the source region, can be expressed by Expression A.

$$V_g = V_{Sig_m}$$

$$V_s \cong V_{Ofs} - V_{th}$$

$$V_{gs} \cong V_{Sig_m} - (V_{Ofs} - V_{th}) \quad \text{Expression A}$$

That is, $V_{gs}$ obtained in the writing process on the driving transistor $TR_D$ depends on only on the image signal $V_{Sig_m}$ for controlling the luminance of the light-emitting portion ELP, the threshold voltage $V_{th}$ of the driving transistor $TR_D$, and the voltage $V_{Ofs}$ for initializing the potential of the gate electrode of the driving transistor $TR_D$. The value $V_{gs}$ does not depend on the threshold voltage $V_{th\text{-}EL}$ of the light-emitting portion ELP.

A mobility correcting process will be described now in brief. In the above-mentioned operation, the mobility correcting process of changing the potential (that is, the potential of the second node $ND_2$) of the other of the source and drain regions of the driving transistor $TR_D$ depending on the characteristic of the driving transistor $TR_D$ (for example, the magnitude of the mobility μ) is performed along with the writing process.

As described above, in a state where the voltage $V_{CC\text{-}H}$ is applied to one of the source and drain regions of the driving transistor $TR_D$ from the power source unit 100, the image signal $V_{Sig_m}$ is applied to the gate electrode of the driving transistor $TR_D$. Here, as shown in FIG. 4, the potential of the second node $ND_2$ increases in period $TP(\mathbf{2})_4'$. As a result, the amount of increasing potential ΔV (potential correcting value) in the source region of the driving transistor $TR_D$ increases when the value of the mobility μ of the driving transistor $TR_D$ is great, and the amount of increasing potential ΔV (potential correcting value) in the source region of the driving transistor $TR_D$ decreases when the value of the mobility μ of the driving transistor $TR_D$ is small. The potential difference $V_{gs}$ between the gate electrode of the driving transistor $TR_D$ and the source region is changed from Expression A to Expression B. The entire time ($t_0$) of period $TP(\mathbf{2})_4'$ can be determined in advance as a design value at the time of designing the organic EL display apparatus.

$$V_{gs} \cong V_{Sig_m} - (V_{Ofs} - V_{th}) - \Delta V \quad \text{Expression B}$$

The threshold voltage canceling process, the writing process, and the mobility correcting process are finished by the above-mentioned operations. At the start time of period $TP(\mathbf{2})_5'$, the first node $ND_1$ is changed to a floating state by turning off the writing transistor $TR_W$ on the basis of the signal from the scanning line SCL. The voltage $V_{CC\text{-}H}$ is applied to one (hereinafter, also referred to as drain region for convenience) of the source and drain regions of the driving transistor $TR_D$ from the power source unit 100. As a result, the potential of the second node $ND_2$ increases, the same phenomenon as that in a so-called bootstrap circuit occurs in the gate electrode of the driving transistor $TR_D$, and thus the potential of the first node $ND_1$ also increases. The potential difference $V_{gs}$ between the gate electrode and the source region of the driving transistor $TR_D$ holds the value of Expression B. The current flowing in the light-emitting portion ELP is a drain current $I_{ds}$ flowing from the drain region of the driving transistor $TR_D$ to the source region. When the driving transistor $TR_D$ ideally operates in a saturated region, the drain current $I_{ds}$ can be expressed by Expression C. The light-emitting portion ELP emits light with the luminance corresponding to the value of the drain current $I_{ds}$. The coefficient k will be described later.

$$I_{ds} = k \cdot \mu \cdot (V_{gs} - V_{th})^2$$

$$= k \cdot \mu \cdot (V_{Sig_m} - V_{Ofs} - \Delta V)^2 \quad \text{Expression C}$$

Period $TP(\mathbf{2})_5'$ shown in FIG. 4 is called an emission period and a period of time from the start of period $TP(\mathbf{2})_6'$ to the next emission period is called a period of a non-emission state (hereinafter, also simply referred to as non-emission period). Specifically, at the start time of period $TP(\mathbf{2})_6'$, the voltage $V_{CC\text{-}H}$ of the power source unit 100 is switched to the voltage $V_{CC\text{-}L}$, which is maintained up to the end time of next period $TP(\mathbf{2})_1'$ (shown by period $TP(\mathbf{2})_{+1}'$ in FIG. 4). Accordingly, the period of time from the start of period TP(2)6' to next period TP(2)+5' is a non-emission period.

The operation of the 2Tr/1C driving circuit of which the configuration has been schematically described above will be described in detail later.

SUMMARY OF THE INVENTION

In the above-mentioned driving method, by providing the non-emission period, an afterimage blur resulting from the active matrix driving method can be reduced, thereby improving the quality of a moving image. However, in the non-emission period, the reverse voltage of the value of $|V_{CC\text{-}L} - V_{Cat}|$ is basically applied to the light-emitting portion ELP. To reduce the deterioration of the light-emitting portion ELP, it is preferable that the ratio of the period where the reverse voltage having a large absolute value is applied to the non-emission period is small. It is also preferable that the absolute value of the reverse voltage applied to the light-emitting portion ELP in the non-emission period other than the period where the preprocessing process is performed is small. For example, a middle voltage $V_{CC\text{-}M}$ satisfying the conditional expression of $V_{CC\text{-}L} < V_{CC\text{-}M} < V_{CC\text{-}H}$ can be supplied from the power source unit in the non-emission period other than the period where the preprocessing process is performed, but a problem that the configuration or control of the organic EL display apparatus is complicated is caused in this case.

It is desirable to provide a method of driving an organic EL display apparatus, which can reduce a deterioration of a light-emitting portion ELP due to an application of a reverse voltage in a non-emission period without complicating the configuration of the organic EL display apparatus.

According to a first embodiment and a second embodiment of the invention, there is provided a method of driving an organic electroluminescence (EL) display apparatus having (1) a scanning circuit, (2) a signal output circuit, (3) organic EL display elements of which N×M of N in a first direction and M in a second direction different from the first direction are arranged in a two-dimensional matrix, each organic EL display element having an organic EL light-emitting portion and a driving circuit driving the organic EL light-emitting portion, (4) M scanning lines connected to the scanning circuit to extend in the first direction, (5) N data lines connected to the signal output circuit to extend in the second direction, and (6) a power source unit, wherein the driving circuit includes a writing transistor, a driving transistor, and a capacitor. Here, (A-1) one of source and drain regions of the driving transistor is connected to the power source unit, (A-2) the other of the source and drain regions is connected to an anode of the organic EL light-emitting portion and one electrode of the capacitor to form a second node, and (A-3) the gate electrode thereof is connected to the other of source and drain regions of the writing transistor and the other electrode of the capacitor to form a first node. (B-1) one of the source and drain regions of the writing transistor is connected to the corresponding data line, and (B-2) the gate electrode thereof is connected to the corresponding scanning line. When the organic EL display elements in the first row to the M-th row are line-sequentially scanned and a period allocated to scan the organic EL display elements in the respective rows is represented by a horizontal scanning period, each horizontal scanning period includes an initialization period where the signal output circuit applies a first node initialization voltage to the corresponding data lines and an image signal period where the signal output circuit applies an image signal to the corresponding data lines.

In the organic EL display element in the m-th row (where m=1, 2, 3, . . . , M) and n-th column (where n=1, 2, 3, . . . , N) where the horizontal scanning period including the image signal period corresponding to the organic EL display elements in the m-th row is represented by a horizontal scanning period $H_m$ and the horizontal scanning period previous to the horizontal scanning period $H_m$ by P horizontal scanning periods (where P satisfies 1<P<M and is a predetermined value in the organic EL display apparatus) is represented by a horizontal scanning period $H_{m_pre_P}$, the method of driving an organic EL display apparatus according to the first embodiment of the invention includes the steps of: (a) performing a preprocessing process of initializing the potential of the first node and the potential of the second node, so that the potential difference between the first node and the second node is greater than the threshold voltage of the driving transistor and the potential difference between the second node and the cathode of the organic EL light-emitting portion is not greater than the threshold voltage of the organic EL light-emitting portion, in an initialization period located before the end of the horizontal scanning period $H_{m_pre_P}$ by applying a first node initialization voltage to the first node from the corresponding data line via the writing transistor turned on by the operation of the scanning circuit to initialize the potential of the first node and applying a second node initialization voltage to the one of the source and drain regions of the driving transistor from the power source unit to initialize the potential of the second node; (b) switching the voltage of the power source unit from the second node initialization voltage to a driving voltage and holding the state where the driving voltage is applied to the one of the source and drain regions of the driving transistor from the power source unit; (c) performing a threshold voltage canceling process of changing the potential of the second node until the potential obtained by subtracting the threshold voltage of the driving transistor from the first node initialization voltage to turn off the driving transistor in the initialization period of the horizontal scanning period $H_{m_pre_P}$, by applying the driving voltage to the one of the source and drain regions of the driving transistor from the power source unit in a state where the writing transistor is turned on in the initialization period by the operation of the scanning circuit and the first node initialization voltage is applied to the first node from the data line via the turned-on writing transistor; (d) changing the first node to a floating state and holding the OFF state of the driving transistor, by turning off the writing transistor by the operation of the scanning circuit; (e) performing a writing process of applying the image signal to the first node from the data line in the image signal period of the horizontal scanning period $H_m$ via the writing transistor turned on by the operation of the scanning circuit; and (f) changing the first node to a floating state and allowing current corresponding to the potential difference between the first node and the second node to flow to the organic EL light-emitting portion via the driving transistor from the power source unit by turning off the writing transistor by the operation of the scanning circuit.

According to the second embodiment of the invention, the driving circuit further includes a first transistor, wherein (C-1) the other of source and drain regions of the first transistor is connected to the second node, (C-2) one of the source and drain regions is supplied with a second node initialization voltage for initializing the potential of the second node, and (C-3) the gate electrode thereof is connected to a first transistor control line. In the organic EL display element in the m-th row (where m=1, 2, 3, . . . , M) and n-th column (where n=1, 2, 3, . . . , N) where the horizontal scanning period including the image signal period corresponding to the organic EL display elements in the m-th row is represented by a horizontal scanning period $H_m$ and the horizontal scanning period previous to the horizontal scanning period $H_m$ by P horizontal scanning periods (where P satisfies 1<P<M and is a predetermined value in the organic EL display apparatus) is represented by a horizontal scanning period $H_{m_pre_P}$, the method of driving an organic EL display apparatus includes the steps of: (a) performing a preprocessing process of initializing the potential of the first node and the potential of the second node, so that the potential difference between the first node and the second node is greater than the threshold voltage of the driving transistor and the potential difference between the second node and the cathode of the organic EL light-emitting portion is not greater than the threshold voltage of the organic EL light-emitting portion, in an initialization period located before the end of the horizontal scanning period $H_{m_pre_P}$ by applying a first node initialization voltage to the first node from the corresponding data line via the writing transistor turned on by the operation of the scanning circuit to initialize the potential of the first node and applying the second node initialization voltage to the second node via the first transistor turned on by a signal from the first transistor control line to initialize the potential of the second node; (b) switching the first transistor from the ON state to the OFF state by the signal from the first transistor control line; (c) performing a threshold voltage canceling process of changing the potential of the second node until the potential obtained by subtracting the threshold voltage of the driving transistor from the first node initialization voltage to turn off the driving transistor in the initialization period of the horizontal scanning period $H_{m_pre_P}$, by applying the driving voltage to the one of the source and drain regions of the driving transistor from the power source unit in a state where the writing transistor is turned on in the initialization period by the operation of the scanning circuit and the first node initialization voltage is applied to the first node from the data line via the turned-on writing transistor; (d) changing the first node to a floating state and holding the OFF state of the driving transistor, by turning off the writing transistor by the operation of the scanning circuit; (e) performing a writing process of applying the image signal to the first node from the data line in the image signal period of the horizontal scanning period $H_m$ via the writing transistor turned on by the operation of the scanning circuit; and (f) changing the first node to a floating state and allowing current corresponding to the potential difference between the first node and the second node to flow to the organic EL light-emitting portion via the driving transistor from the power source unit by turning off the writing transistor by the operation of the scanning circuit.

In the method of driving an organic EL display apparatus according to the first embodiment and the second embodiment of the invention, an image is displayed by repeatedly performing the process of step (a) to step (f). Basically, the period of time from the initialization period located before the end of the horizontal scanning period Hm_pre_P to the end of the horizontal scanning period Hm in the step of (a) is a non-emission state period (hereinafter, also simply referred to as non-emission period). The period of time where the second node initialization voltage is applied to the anode of the light emitting portion ELP is defined in the vicinity of the start time of the initialization period where the preprocessing process is performed. In most of the non-emission period, the voltage with the value obtained by subtracting the threshold voltage of the driving transistor from the first node initialization voltage is applied to the anode of the light-emitting portion ELP. Therefore, it is possible to reduce the ratio of the period of time where the reverse voltage having a great absolute value is applied to the non-emission period and to reduce the absolute value of the reverse voltage applied to the light-emitting portion ELP in most of the non-emission period. Accordingly, it is possible to suppress the deterioration of the light-emitting portion ELP.

BRIEF DESCRIPTION OF THE DRAWINGS

FIGS. 5A to 5F are diagrams schematically illustrating ON/OFF states of transistors constituting a driving circuit of an organic EL display element.

FIGS. 8A to 8F are diagrams schematically illustrating ON/OFF states of transistors constituting a driving circuit of an organic EL display element.

FIGS. 9A to 9F are diagrams schematically illustrating ON/OFF states of the transistors constituting the driving circuit of the organic EL display element, which is subsequent to FIG. 8F.

FIGS. 11A to 11E are diagrams schematically illustrating ON/OFF states of transistors constituting a driving circuit of an organic EL display element.

FIGS. 13A to 13F are diagrams schematically illustrating ON/OFF states of transistors constituting a driving circuit of an organic EL display element.

FIGS. 15A to 15E are diagrams schematically illustrating ON/OFF states of transistors constituting a driving circuit of an organic EL display element.

FIGS. 19A to 19F are diagrams schematically illustrating ON/OFF states of transistors constituting a driving circuit of an organic EL display element.

FIGS. 20A to 20F are diagrams schematically illustrating ON/OFF states of the transistors constituting the driving circuit of the organic EL display element, which is subsequent to FIG. 19F.

FIGS. 22A to 22E are diagrams schematically illustrating ON/OFF states of transistors constituting a driving circuit of an organic EL display element.

FIGS. 24A to 24F are diagrams schematically illustrating ON/OFF states of transistors constituting a driving circuit of an organic EL display element.

FIGS. 26A to 26E are diagrams schematically illustrating ON/OFF states of transistors constituting a driving circuit of an organic EL display element.

FIGS. 29A to 29D are diagrams schematically illustrating ON/OFF states of transistors constituting a driving circuit of an organic EL display element.

FIGS. 31A to 31D are diagrams schematically illustrating ON/OFF states of transistors constituting a driving circuit of an organic EL display element.

DESCRIPTION OF THE PREFERRED EMBODIMENTS

Figure 1:
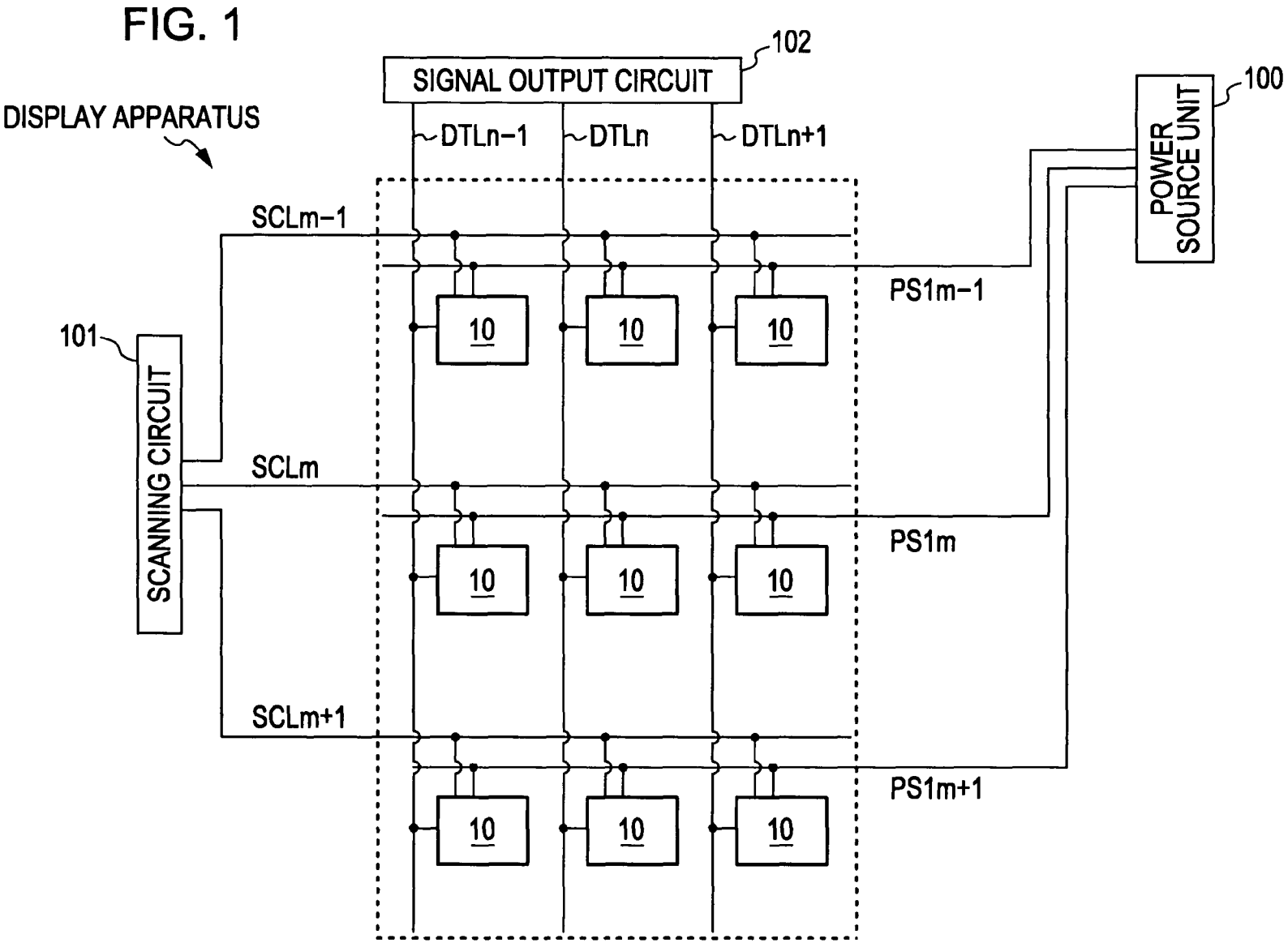
FIG. 1 is a conceptual diagram illustrating an organic EL display apparatus according to Example 1 of the invention.

Hereinafter, examples of the invention will be described with reference to the accompanying drawings. The description order is as follows.

1. Detailed Description of Method of Driving Organic EL Display Apparatus
2. Schematic Description of Organic EL Display Apparatus Used in Examples
3. Example 1 (2Tr/1C Driving Circuit)
4. Example 2 (2Tr/1C Driving Circuit)
5. Example 3 (2Tr/1C Driving Circuit)
6. Example 4 (2Tr/1C Driving Circuit)
7. Example 5 (3Tr/1C Driving Circuit)
8. Example 6 (3Tr/1C Driving Circuit)
9. Example 7 (3Tr/1C Driving Circuit)
10. Example 8 (3Tr/1C Driving Circuit)
11. Example 9 (4Tr/1C Driving Circuit)
12. Example 10 (4Tr/1C Driving Circuit)

Detailed Description of Method of Driving Organic EL Display Apparatus

In the method of driving an organic EL display apparatus according to the first embodiment of the invention, between the step of (d) and the step of (e) may be performed the steps of: (g) performing a second preprocessing process of initializing the potential of the first node and the potential of the second node, so that the potential difference between the first node and the second node is greater than the threshold voltage of the driving transistor and the potential difference between the second node and the cathode of the organic EL light-emitting portion is not greater than the threshold voltage of the organic EL light-emitting portion, in the initialization period by applying the first node initialization voltage to the first node from the corresponding data line via the writing transistor turned on by the operation of the scanning circuit to initialize the potential of the first node and applying a second node initialization voltage to the one of the source and drain regions of the driving transistor from the power source unit to initialize the potential of the second node; (h) switching the voltage of the power source unit from the second node initialization voltage to a driving voltage and holding the state where the driving voltage is applied to the one of the source and drain regions of the driving transistor from the power source unit; and (i) performing a second threshold voltage canceling process of changing the potential of the second node until the potential obtained by subtracting the threshold voltage of the driving transistor from the first node initialization voltage to turn off the driving transistor in the initialization period located before the end of the horizontal scanning period Hm, by applying the driving voltage to the one of the source and drain regions of the driving transistor from the power source unit in a state where the writing transistor is turned on in the initialization period by the operation of the scanning circuit and the first node initialization voltage is applied to the first node from the data line via the turned-on writing transistor.

In the method of driving an organic EL display apparatus according to the second embodiment of the invention, between the step of (d) and the step of (e) may be performed the steps of: (g) performing a second preprocessing process of initializing the potential of the first node and the potential of the second node, so that the potential difference between the first node and the second node is greater than the threshold voltage of the driving transistor and the potential difference between the second node and the cathode of the organic EL light-emitting portion is not greater than the threshold voltage of the organic EL light-emitting portion, in the initialization period by applying the first node initialization voltage to the first node from the corresponding data line via the writing transistor turned on by the operation of the scanning circuit to initialize the potential of the first node and applying the second node initialization voltage to the second node via the first transistor turned on by the signal from the first transistor control line to initialize the potential of the second node; (h) switching the first transistor from the ON state to the OFF state by the signal from the first transistor control line; and (i) performing a second threshold voltage canceling process of changing the potential of the second node until the potential obtained by subtracting the threshold voltage of the driving transistor from the first node initialization voltage to turn off the driving transistor in the initialization period located before the end of the horizontal scanning period $H_m$, by applying the driving voltage to the one of the source and drain regions of the driving transistor from the power source unit in a state where the writing transistor is turned on in the initialization period by the operation of the scanning circuit and the first node initialization voltage is applied to the first node from the data line via the turned-on writing transistor.

In the method of driving an organic EL display apparatus according to the first embodiment and the second embodiment of the invention, it is preferable that the step of (i) should be performed in the initialization period of the horizontal scanning period $H_m$, but the invention is not limited to this configuration. The step of (i) may be performed in the initialization period of the horizontal scanning period previous to the horizontal scanning period $H_m$.

In the method of driving an organic EL display apparatus according to the first embodiment and the second embodiment of the invention including the above-mentioned preferred configurations, the signal output circuit may apply a first initialization voltage as the first node initialization voltage to the data line in the initialization period and may then apply a second initialization voltage lower than the first initialization voltage as the first node initialization voltage to the data line instead of the first initialization voltage.

In the method of driving an organic EL display apparatus according to the first embodiment and the second embodiment of the invention including the above-mentioned preferred configurations, the step of (a) may be performed in the initialization period of the horizontal scanning period $H_{m_pre_P}$. Alternatively, the step of (a) may be performed in the initialization period of the horizontal scanning period before the horizontal scanning period $H_{m_pre_P}$. It can be properly determined what configuration to select depending on the design rule of the organic EL display apparatus. Specifically, when the step of (c), that is, the threshold voltage canceling process, can be completed only in the initialization period of one horizontal scanning period, the former can be selected. Otherwise, the latter can be selected. In the latter, it is possible to perform the threshold voltage canceling process without any trouble by controlling the ON state and the OFF state of the writing transistor on the basis of the operation of the scanning circuit up to the end of the horizontal scanning period. $H_{m_pre_P}$ so that the writing transistor is turned on in the initialization period and the writing transistor is turned off in the image signal period.

The step of (g) and the step of (i) of the method of driving an organic EL display apparatus according to the first embodiment and the second embodiment of the invention are basically the same as described above. For example, in the configuration that the step of (i) is performed in the initialization period of the horizontal scanning period $H_m$, when the step of (g), that is, the second threshold voltage canceling process, can be completed only in the initialization period of one horizontal scanning period, the step of (g) may be performed in the initialization period of the horizontal scanning period $H_m$. Otherwise, the step of (g) can be performed in the initialization period of the horizontal scanning period before the horizontal scanning period $H_m$.

In the method of driving an organic EL display apparatus according to the second embodiment of the invention including the above-mentioned preferred configurations, the driving circuit may further include a second transistor, the power source unit may be connected to the one of the source and drain regions of the driving transistor via the second transistor, and the second transistor may be turned off when the first transistor is in the ON state. In this case, the second transistor may be a transistor having a conductive type different from that of the first transistor and the gate electrode of the second transistor may be connected to the first transistor control line. According to this configuration, when the second node initialization voltage is applied to the second node via the first transistor in the ON state, it is possible to prevent the current from flowing to the first transistor from the power source unit, thereby reducing the power consumption.

In the method (hereinafter, also simply referred to as "driving method according to an embodiment of the invention" or "the invention") of driving an organic EL display apparatus according to the first embodiment and the second embodiment of the invention including the above-mentioned preferred configurations, the image signal is applied from the data line in a state where the driving voltage is applied to one of the source and drain regions of the driving transistor in the step of (e). Accordingly, the mobility correcting process of raising the potential of the second node depending on the characteristic of the driving transistor is performed at the same time as performing the writing process. The details of the mobility correcting process will be described later.

The organic EL display apparatus used in the invention may have a monochromatic display configuration or a color display configuration. A configuration in which one pixel includes plural sub pixels, for example, a color display configuration in which one pixel includes three sub pixels of a red-emission sub pixel, a green-emission sub pixel, and a blue-emission sub pixel, may be employed. In addition, a set in which one type of sub pixel or plural types of sub pixels are added to the three types of sub pixels (for example, a set in which a sub pixel emitting white light is added to enhance the luminance, a set in which a sub pixel emitting complementary color light is added to enlarge the color reproducing range, a set in which a sub pixel emitting yellow light is added to enlarge the color reproducing range, and a set in which sub pixels emitting yellow and cyan light are added to enlarge the color reproducing range) may be employed.

Several resolution values for displaying an image such as (1920, 1035), (720, 480), and (1280, 960), in addition to VGA(640, 480), S-VGA(800, 600), XGA(1024, 768), APRC (1152, 900), S-XGA(1280, 1024), U-XGA(1600, 1200), HD-TV(1920, 1080), and Q-XGA(2048, 1536), can be exemplified as the pixel values of the organic EL display apparatus, but the invention is not limited to the values.

Existing configurations or structures can be used as the configurations or structures of various circuits such as a scanning circuit and a signal output circuit, various lines such as scanning lines and data lines, a power source unit, and organic EL light-emitting portions (hereinafter, also simply referred to as light-emitting portions) in the organic EL display apparatus. Specifically, each light-emitting portion can include, for example, an anode, a hole transport layer, a light-emitting layer, an electron transport layer, and a cathode.

An n-channel thin film transistor (TFT) can be used as the transistors of the driving circuit. The transistors of the driving circuit may be of an enhancement type or a depression type. In the n-channel transistor, an LDD (Lightly Doped Drain) structure may be formed. In some cases, the LDD structure may be asymmetric. For example, since large current flows in the driving transistor at the time of allowing the organic EL display element to emit light, the LDD structure may be formed only in one of the source and drain regions serving as the drain region at the time of emitting light. For example, a p-channel thin film transistor may be used as the writing transistor or the like.

The capacitor of the driving circuit can include one electrode, another electrode, and a dielectric layer (insulating layer) interposed between the electrodes. The transistors and the capacitor of the driving circuit are formed in a plane (for example, on a support member) and the light-emitting portion is formed above the transistors and the capacitor of the driving circuit with an interlayer insulating layer interposed therebetween. The other of the source and drain regions of the driving transistor is connected to the anode of the light-emitting portion, for example, via a contact hole. The transistors may be formed in a semiconductor substrate or the like.

Hereinafter, examples of the invention will be described with reference to the accompanying drawings and the rough configuration of the organic EL display apparatus used in the examples will be first described.

Configuration of Organic EL Display Apparatus Used in Examples

An organic EL display apparatus properly appropriate for use in the examples is an organic EL display apparatus having plural pixels. One pixel includes plural sub pixels (three sub pixels of a red-emission sub pixel, a green-emission sub pixel, a blue-emission sub pixel in the examples). Each sub pixel includes an organic EL display element 10 having a structure in which a driving circuit 11 and a light-emitting portion (light-emitting portion ELP) connected to the driving circuit 11 are stacked.

Figure 16:
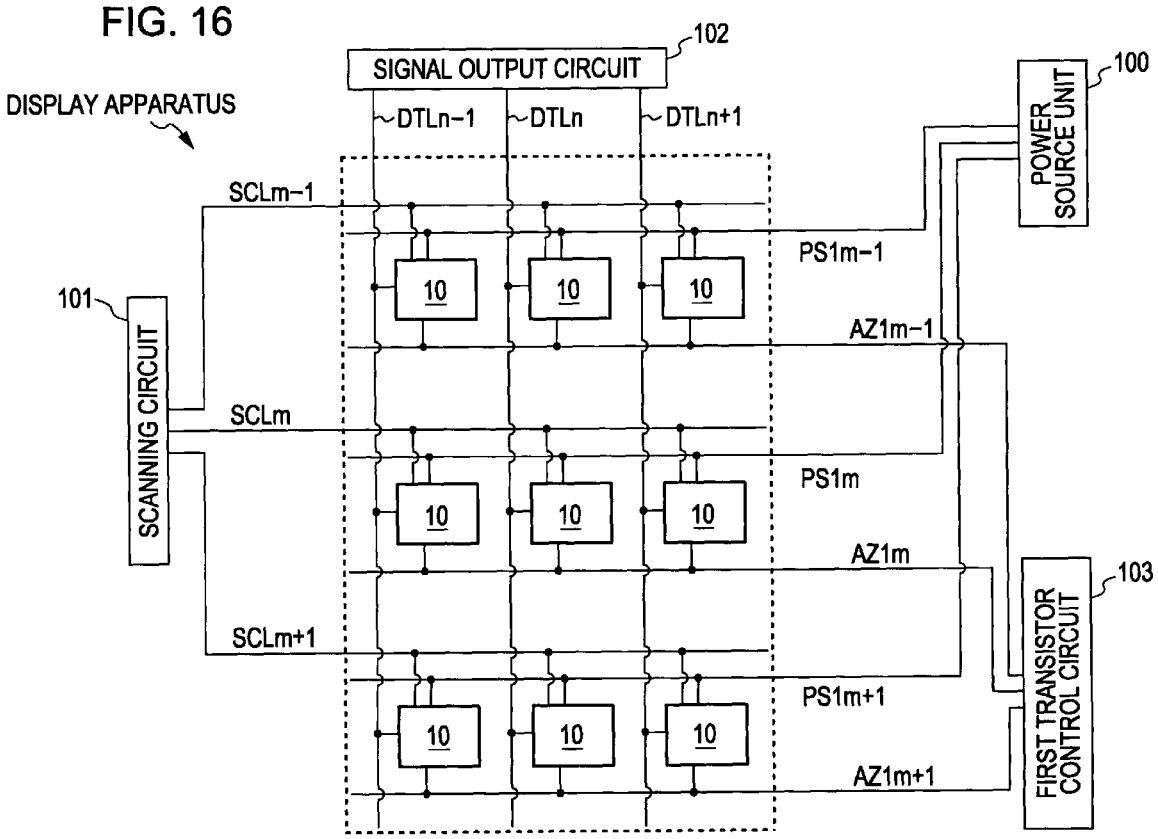
FIG. 16 is a conceptual diagram illustrating an organic EL display apparatus according to Example 5 of the invention.
Figure 27:
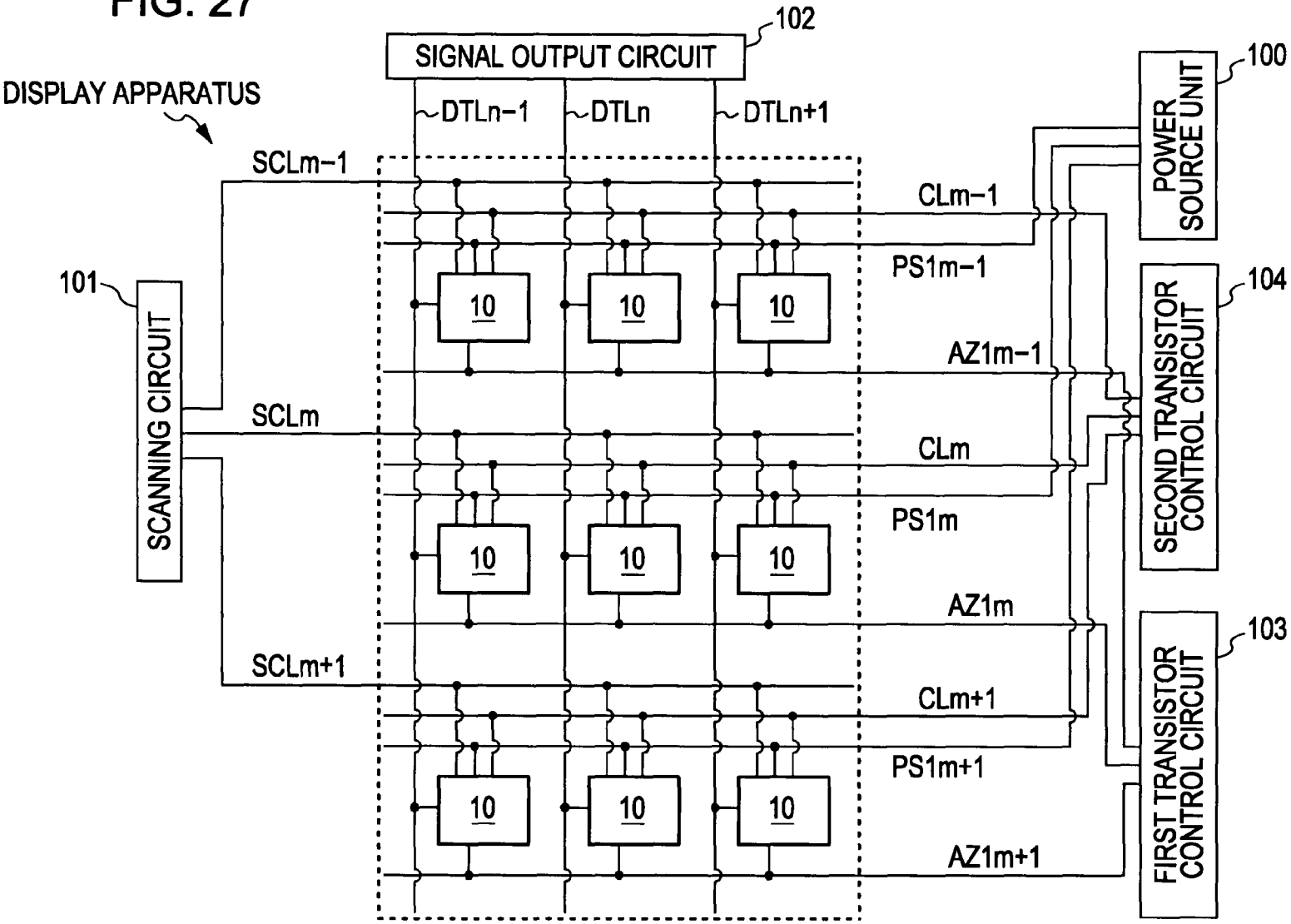
FIG. 27 is a conceptual diagram illustrating an organic EL display apparatus according to Example 9 of the invention.

The conceptual diagram of the organic EL display apparatus according to Example 1, Example 2, Example 3, and Example 4 is shown in FIG. 1. The conceptual diagram of the organic EL display apparatus according to Example 5, Example 6 Example 7, Example 8, and Example 10 is shown in FIG. 16. The conceptual diagram of the organic EL display apparatus according to Example 9 is shown in FIG. 27.

Figure 2:
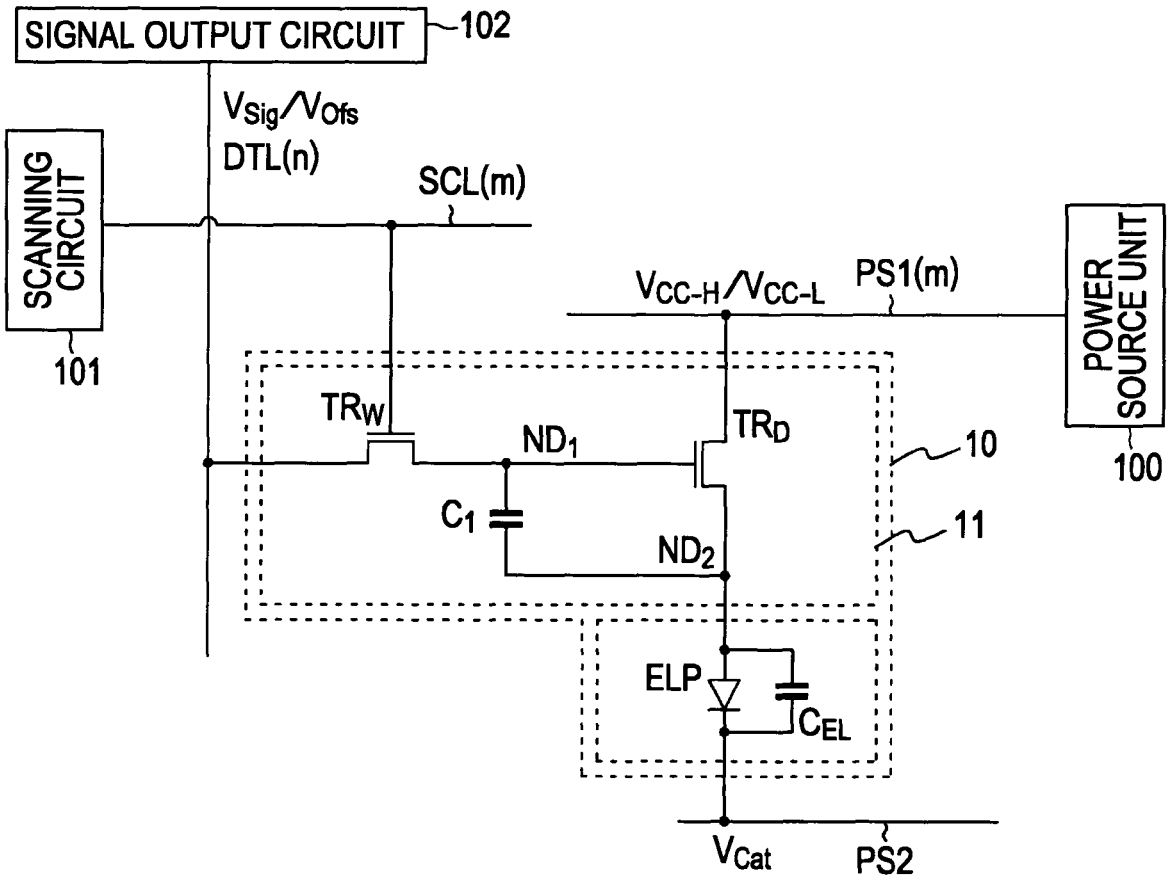
FIG. 2 is an equivalent circuit diagram of an organic EL display element including a driving circuit.
Figure 17:
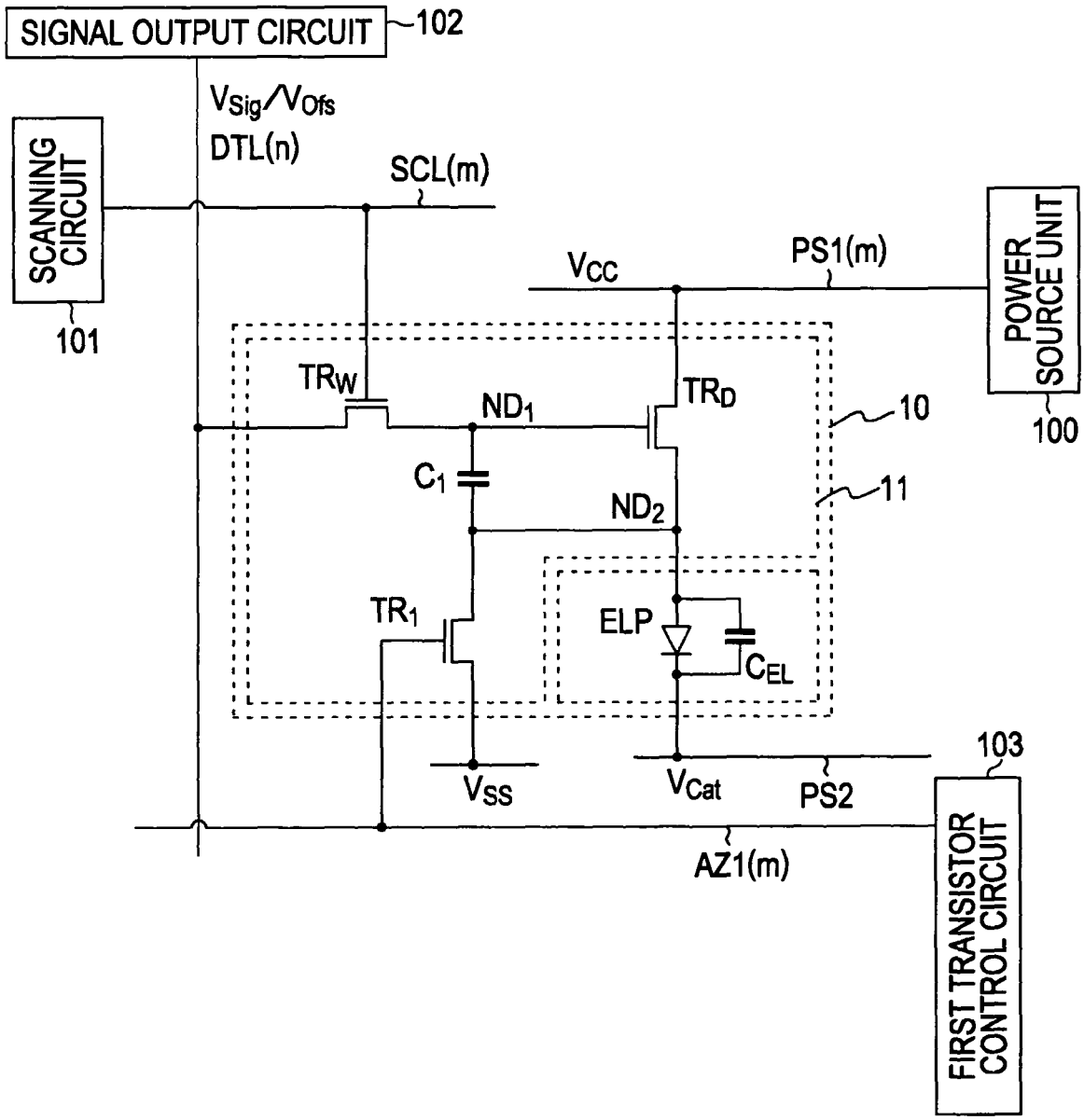
FIG. 17 is an equivalent circuit diagram of an organic EL display element including a driving circuit.
Figure 28:
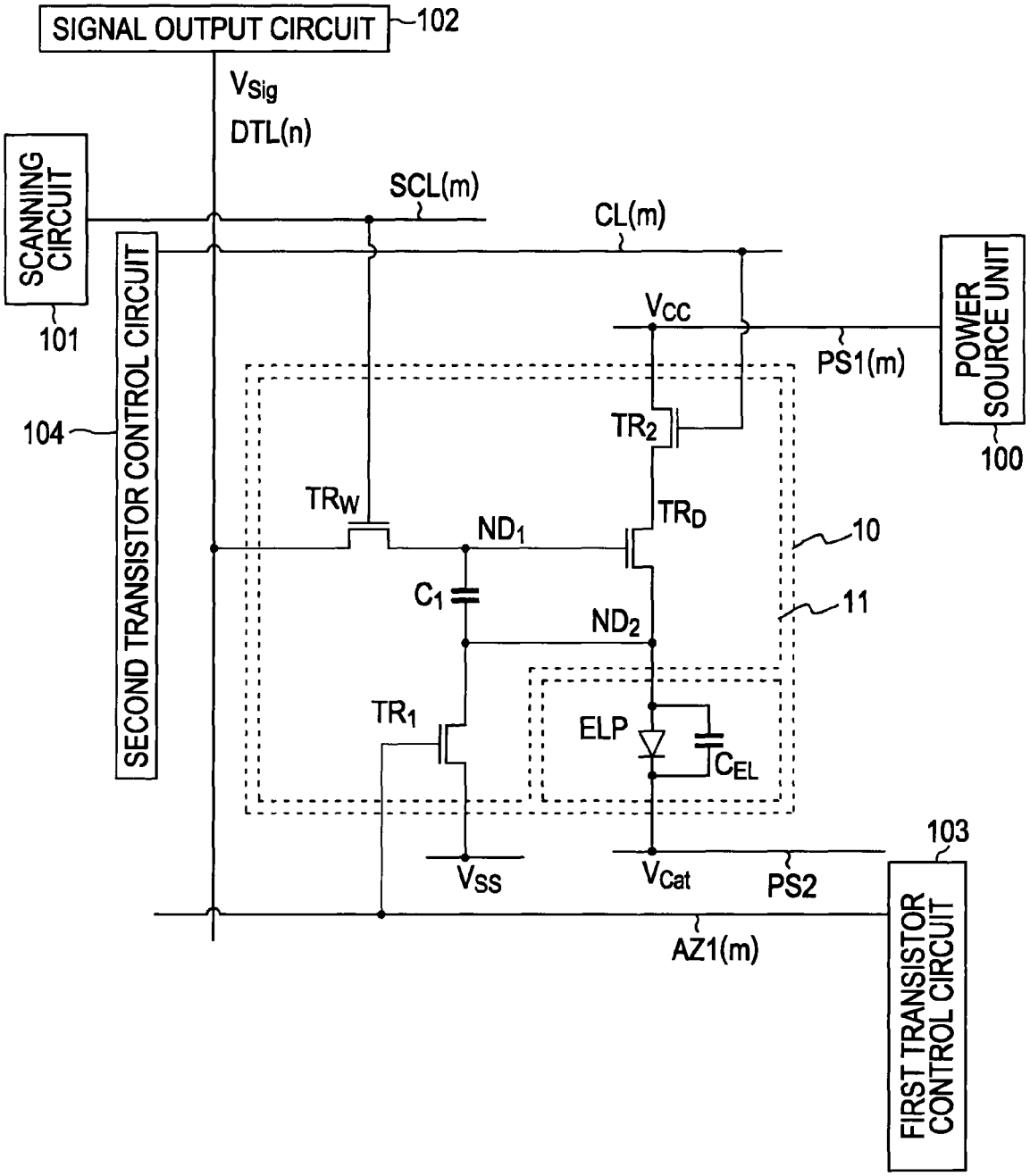
FIG. 28 is an equivalent circuit diagram of an organic EL display element including a driving circuit.
Figure 30:
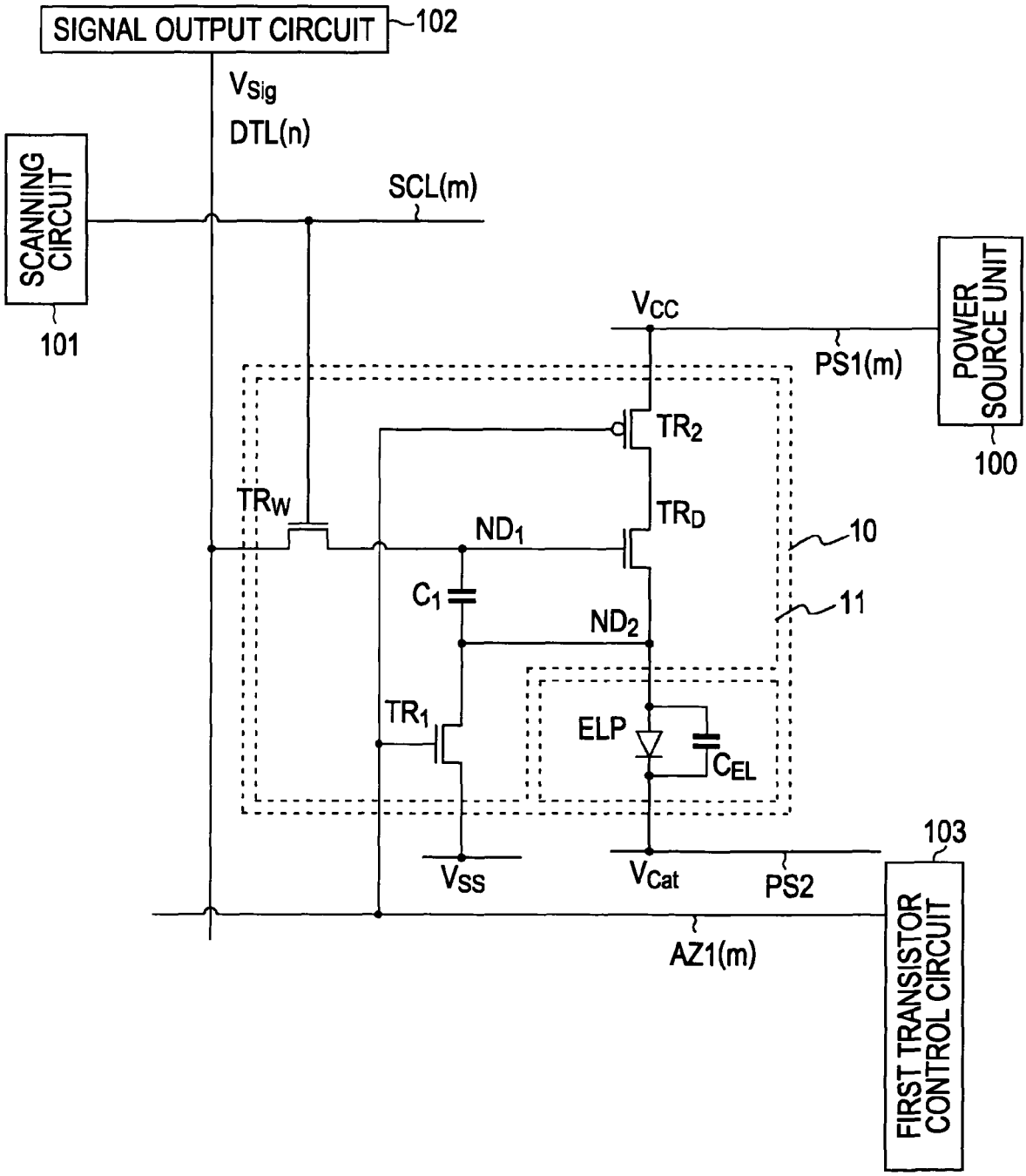
FIG. 30 is an equivalent circuit diagram of an organic EL display element including a driving circuit.

FIG. 2 shows a driving circuit (also referred to as 2Tr/1C driving circuit) basically including two transistors and one capacitor. FIG. 17 shows a driving circuit (also referred to as 3Tr/1C driving circuit) basically including three transistors and one capacitor. FIGS. 28 and 30 show a driving circuit (also referred to as 4Tr/1C driving circuit) basically including four transistors and one capacitor.

The organic EL display apparatus according to the examples includes (1) a scanning circuit 101, (2) a signal output circuit 102, (3) organic EL display elements 10 of which N×M of N in a first direction and M in a second direction different from the first direction are arranged in a two-dimensional matrix, each organic EL display element having a light-emitting portion ELP and a driving circuit 11 driving the light-emitting portion ELP, (4) M scanning lines SCL connected to the scanning circuit 101 to extend in the first direction, (5) N data lines DTL connected to the signal output circuit 102 to extend in the second direction, and (6) a power source unit 100. In FIGS. 1, 16, and 27, 3×3 organic EL display elements 10 are shown, which is only an example. For the purpose of simplifying the explanation, power supply lines PS2 shown in FIG. 2 are not shown in FIGS. 1, 16, and 27.

The light-emitting portion ELP has an existing configuration or structure including, for example, an anode, a hole transport layer, a light-emitting layer, an electron transport layer, and a cathode. Existing configurations or structures can be used as the configurations or structures of the scanning circuit 101, the signal output circuit 102, the scanning lines SCL, the data lines DTL, and the power source unit 100.

The minimum elements of the driving circuit 11 will be described now. The driving circuit 11 includes at least a driving transistor $TR_D$, a writing transistor $TR_W$, and a capacitor $C_1$ having a pair of electrodes. The driving transistor $TR_D$ is formed of an n-channel TFT including source and drain regions, a channel forming region, and a gate electrode. The writing transistor $TR_W$ is formed of an n-channel TFT including source and drain regions, a channel forming region, and a gate electrode. The writing transistor $TR_W$ may be formed of a p-channel TFT.

Here, in the driving transistor $TR_D$, (A-1) one of the source and drain regions is connected to the power source unit 100, (A-2) the other of the source and drain regions is connected to an anode of the light-emitting portion ELP and one electrode of the capacitor $C_1$ to form a second node $ND_2$, and (A-3) the gate electrode thereof is connected to the other of source and drain regions of the writing transistor $TR_W$ and the other electrode of the capacitor $C_1$ to form a first node $ND_1$.

In the writing transistor $TR_W$, (B-1) one of the source and drain regions is connected to the corresponding data line DTL, and (B-2) the gate electrode is connected to the corresponding scanning line SCL.

Figure 3:
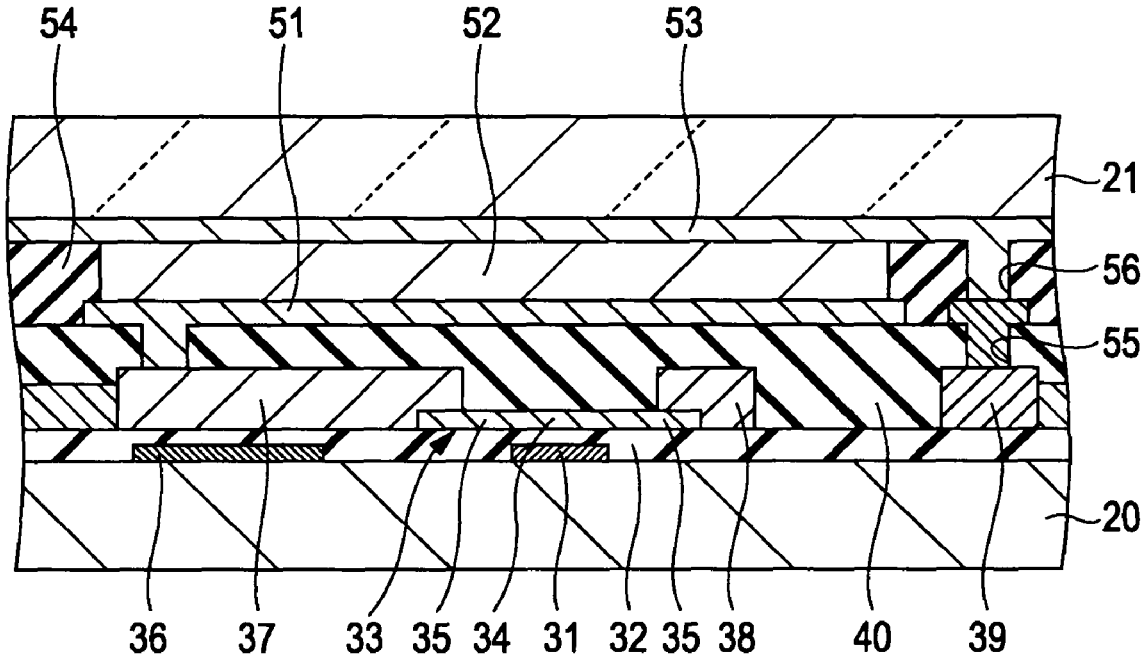
FIG. 3 is a partial sectional view schematically illustrating the organic EL display apparatus.

FIG. 3 is a partial sectional view schematically illustrating a part of the organic EL display apparatus. The transistors $TR_D$ and $TR_W$ and the capacitor $C_1$ of the driving circuit 11 are formed on a support member 20 and the light-emitting portion ELP is formed above the transistors $TR_D$ and $TR_W$ and the capacitor $C_1$ of the driving circuit 11, for example, with an interlayer insulating layer 40 interposed therebetween. The other of the source and drain regions of the driving transistor $TR_D$ is connected to the anode of the light-emitting portion ELP via a contact hole. Only the driving transistor $TR_D$ is shown in FIG. 3. Other transistors are not shown.

More specifically, the driving transistor $TR_D$ includes a gate electrode 31, a gate insulating layer 32, source and drain regions 35 and 35 formed in a semiconductor layer 33, and a channel forming region 34 corresponding to a part of the semiconductor layer 33 between the source and drain regions 35 and 35. On the other hand, the capacitor $C_1$ includes the other electrode 36, a dielectric layer formed of an extension of the gate insulating layer 32, and one electrode 37 (corresponding to the second node $ND_2$). The gate electrode 31, a part of the gate insulating layer 32, and the other electrode 36 of the capacitor $C_1$ are formed on the support member 20. One of the source and drain regions 35 of the driving transistor $TR_D$ is connected to a line 38 and the other of the source and drain regions 35 is connected to one electrode 37. The driving transistor $TR_D$ and the capacitor $C_1$ are covered with an interlayer insulating layer 40 and the light-emitting portion ELP including anode 51, a hole transport layer, a light-emitting layer, an electron transport layer, and a cathode 53 is formed on the interlayer insulating layer 40. In the drawing, the hole transport layer, the light-emitting layer, and the electron transport layer are shown as one layer 52. A second interlayer insulating layer 54 is formed on the part of the interlayer insulating layer 40 on which the light-emitting portion ELP is not formed, and a transparent substrate 21 is disposed above the second interlayer insulating layer 54 and the cathode 53. The light emitted from the light-emitting layer is output to the outside through the substrate 21. One electrode 37 (second node $ND_2$) and the anode 51 are connected to each other by the contact hole formed in the interlayer insulating layer 40. The cathode 53 is connected to a line 39 formed on an extension of the gate insulating layer 32 via contact holes 56 and 55 formed in the second interlayer insulating layer 54 and the interlayer insulating layer 40.

A method of manufacturing the organic EL display apparatus shown in FIG. 3 and the like will be described now. First, various lines such as the scanning lines SCL, the electrodes of the capacitors $C_1$, the transistors including a semiconductor layer, the interlayer insulating layers, the contact holes, and the like are properly formed on the support member 20 by existing methods. Then, the film forming process and the patterning process are carried out by existing methods to form the light-emitting portions ELP arranged in a matrix. The support member 20 having been subjected to the above-mentioned processes are opposed to the substrate 21, the resultant structure is sealed around, and for example, the wiring to external circuits is carried out, thereby obtaining an organic EL display apparatus.

The organic EL display apparatus of the examples is a color display apparatus having plural organic EL display elements 10 (for example, N×M=1920×480). The respective organic EL display elements 10 form a sub pixel, one pixel is configured by a group including plural sub pixels, the pixels are arranged in a two-dimensional matrix in a first direction and a second direction different from the first direction. Each pixel includes three types of sub pixels of a red-emission sub pixel emitting red light, a green-emission sub pixel emitting green light, and a blue-emission sub pixel emitting blue light, which are arranged in the extending direction of the scanning line SCL.

The organic EL display apparatus includes (N/3)×M pixels arranged in a two-dimensional matrix. The organic EL display elements 10 constituting the pixels are line-sequentially scanned and the display frame rate thereof is FR (times/second). That is, the organic EL display elements 10 constituting the N/3 pixels (N sub pixels) arranged in the m-th row are simultaneously driven. In other words, in the organic. EL display elements 10 in one row, the emission/non-emission times are controlled in the unit of the row to which they belong. The process of writing an image signal to the pixels constituting one row may be a process of simultaneously writing the image signal to all the pixels (hereinafter, also simply referred to as simultaneous writing process) or a process of sequentially writing the image signal to the pixels (hereinafter, also referred to as sequential writing process). The writing processes can be selected appropriately depending on the configuration of the organic EL display apparatus.

In the examples to be described later, for the purpose of convenient explanation, it is assumed that the organic EL display elements 10 in the (m−1)-th row are scanned and then the organic EL display elements 10 in the m-th row are scanned. The horizontal scanning period previous to the horizontal scanning period $H_m$ corresponding to the organic EL display elements 10 in the m-th row by P horizontal scanning periods is a horizontal scanning period where the organic EL display elements 10 in the (m-P)-th row are scanned. That is, in the examples, the horizontal scanning period $H_m$ including the image signal period corresponding to the organic EL display elements 10 in the m-th row is the m-th horizontal scanning period. When the horizontal scanning period previous to the horizontal scanning period $H_m$ by P horizontal scanning periods is expressed by a horizontal scanning period $H_{m_pre_P}$, the horizontal scanning period $H_{m_pre_P}$ is expressed by an (m-P)-th horizontal scanning period $H_{m-P}$.

In the examples to be described later, the driving operation of the organic EL display element 10 located in the m-th row and n-th column will be described. This organic EL display element 10 is hereinafter referred to as a (n, m)-th organic EL display element 10 or a (n, m)-th sub pixel. Until the horizontal scanning period of the organic EL display elements 10 arranged in the m-th row, that is, the m-th horizontal scanning period $H_m$ is ended, various processes (a threshold voltage canceling process, a writing process, and a mobility correcting process) are carried out.

After the above-mentioned various processes are all finished, the light-emitting portions of the organic EL display elements 10 in the m-th row are made to emit light. For example, in the configuration in which the step of (a) is performed in the initialization period of the horizontal scanning period $H_{m_pre_P}$, the emission state of the light-emitting portions of the organic EL display elements 10 in the m-th row are maintained just before the start of the initialization period of the next horizontal scanning period $H_{m_pre_P}$. The value of "P" can be properly determined depending on the design specification of the organic EL display apparatus. For example, in the configuration in which the step of (a) is performed in the initialization period of the horizontal scanning period $H_{m_pre_P}$, the emission of light of the light-emitting portions of the organic EL display elements 10 in the m-th row in a certain display frame is maintained just before the start of the initialization period of the (m-P)-th horizontal scanning period. On the other hand, by maintaining the non-emission state of the light-emitting portions ELP to set the non-emission period from the initialization period of the (m-P)-th horizontal scanning period to the end of the m-th horizontal scanning period, it is possible to reduce the after-image blur accompanied with the active matrix driving method, thereby improving the quality of a moving image. The time length of one display frame period is 1/FR and the time length of the horizontal scanning period is smaller than (1/FR)×(1/M) second. When the value of (m-P) or the like is a minus value, the horizontal scanning period corresponding to the minus value can be properly processed in a previous display frame or a subsequent display frame depending on the operations.

In two source and drain regions of one transistor, the term "one of the source and drain regions" can be used as the source or drain region connected to the power source unit. The ON state of a transistor means that a channel is formed between the source and drain regions. It is not considered whether current flows from one of the source and drain regions of a transistor to the other of the source and drain regions. On the other hand, the OFF state of a transistor means that a channel is not formed between the source and drain regions. When the source or drain region of a transistor is connected to the source or drain region of another transistor, it includes that the source or drain region of a transistor and the source or drain region of another transistor occupy the same area. In addition, the source and drain regions can be formed of a conductive material such as polysilicon or amorphous silicon containing impurities and can be formed as a layer including metal, alloy, conductive particles, a stacked structure thereof, an organic material (conductive polymer). In the timing diagrams described in the following, the length of the horizontal axis (time length) representing the periods is schematic and does not represent the ratio of time length of the periods. The same is true in the vertical axis. The shapes of the waveforms in the timing diagrams are schematic.

Hereinafter, the method of driving an organic EL display apparatus will be described by the examples.

Example 1

Example 1 relates to a method of driving an organic EL display apparatus according to the first embodiment of the invention. In Example 1, the driving circuit 11 includes two transistors and one capacitor. The equivalent circuit diagram of the organic EL display element 10 including the driving circuit 11 is shown in FIG. 2.

Details of the driving circuit and the light-emitting portion will be first described.

The driving circuit 11 includes two transistors of a writing transistor $TR_W$ and a driving transistor $TR_D$ and further includes a capacitor $C_1$ (2Tr/1C driving circuit).

Driving Transistor $TR_D$

One of the source and drain regions of the driving transistor $TR_D$ is connected to the power source unit 100 via a power supply line PS1. On the other hand, the other of the source and drain regions of the driving transistor $TR_D$ is connected to (1) an anode of the light-emitting portion ELP and (2) one electrode of the capacitor $C_1$, and forms a second node $ND_2$. The gate electrode of the driving transistor $TR_D$ is connected to (1) the other of the source and drain regions of the writing transistor $TR_W$ and (2) the other electrode of the capacitor $C_1$, and forms a first node $ND_1$. As described later, a voltage $V_{CC-H}$ and a voltage $V_{CC-L}$ are supplied from the power source unit 100.

Here, the driving transistor $TR_D$ is driven to allow drain current $I_{ds}$ to flow by Expression 1 in the emission state of the organic EL display element 10. In the emission state of the organic EL display element 10, one of the source and drain regions of the driving transistor $TR_D$ serves as a drain region and the other of the source and drain regions serves as a source region. For the purpose of convenient explanation, in the following description, one of the source and drain regions of the driving transistor $TR_D$ is simply called a drain region and the other of the source and drain regions is simply called a source region. Reference signs used herein are as follows.

μ: effective mobility

L: channel length

W: channel width $V_{gs}$: potential difference between gate electrode and source region $V_{th}$: threshold voltage $C_{ox}$: (specific dielectric constant of gate insulating layer)× (dielectric constant in vacuum)/(thickness of gate insulating layer)

$$k=(1/2)\cdot(W/L)\cdot C_{ox}$$

$$I_{ds}=k\cdot\mu\cdot(V_{gs}-V_{th})^2 \qquad \text{Expression 1}$$

By allowing the drain current $I_{ds}$ to flow in the light-emitting portion ELP of the organic EL display element 10, the light-emitting portion ELP of the organic EL display element 10 emits light. In addition, the emission state (luminance) of the light-emitting portion ELP of the organic EL display element 10 is controlled depending on the magnitude of the drain current $I_{ds}$.

Writing Transistor $TR_W$

The other of the source and drain regions of the writing transistor $TR_W$ is connected to the gate electrode of the driving transistor $TR_D$, as described above. On the other hand, one of the source and drain regions of the writing transistor $TR_W$ is connected to the data line DTL. The image signal (driving signal or luminance signal) $V_{Sig}$ for controlling the luminance of the light-emitting portion ELP or a first node initialization voltage to be described later is supplied to one of the source and drain regions from the signal output circuit 102 via the data line DTL. Various signals and voltages (for example, signals for a precharge driving operation or various reference voltages) may be supplied to one of the source and drain regions via the data line DTL. The ON/OFF operations of the writing transistor $TR_W$ are controlled on the basis of a signal from the scanning line SCL connected to the gate electrode of the writing transistor $TR_W$, that is, a signal from the scanning circuit 101.

Light-Emitting Portion ELP

The anode of the light-emitting portion ELP is connected to the source region of the driving transistor $TR_D$ as described above. On the other hand, the cathode of the light-emitting portion ELP is connected to the power supply line PS2 through which the voltage $V_{Cat}$ is applied. The parasitic capacitor of the light-emitting portion ELP is represented by reference sign $C_{EL}$. The threshold voltage for the emission of light of the light-emitting portion ELP is represented by reference sign $V_{th-EL}$. That is, when a voltage equal to or greater than $V_{th-EL}$ is applied across the anode and the cathode of the light-emitting portion ELP, the light-emitting portion ELP emits light.

The method of driving an organic EL display apparatus according to Example 1 will be described now.

In the following description, the values of voltages or potentials are defined as follows, but the values are only explanatory for explanation and the invention is not limited to these values. The same is true in the other examples to be described later.

Figure 7:
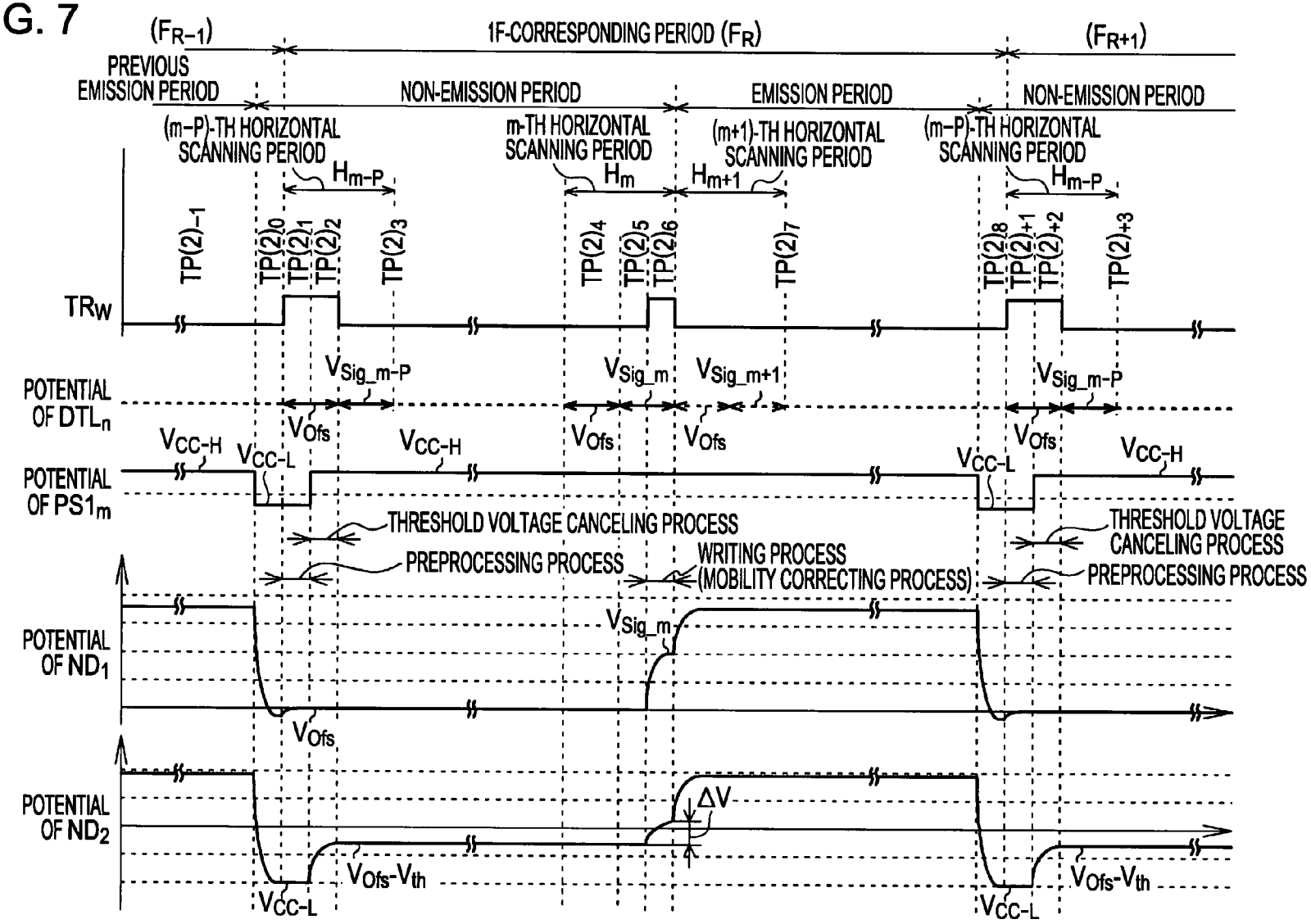
FIG. 7 is a timing diagram schematically illustrating the driving operation of an organic EL light-emitting portion according to Example 1 of the invention.

$V_{Sig}$: image signal for controlling luminance of light-emitting portion ELP, 0 V to 10 V $V_{CC-H}$: driving voltage for allowing current to flow in light-emitting portion ELP, 20 V $V_{CC-L}$: second node initialization voltage, −10 V $V_{Ofs}$: first node initialization voltage for initializing potential (potential of first node $ND_1$) of gate electrode of driving transistor $TR_D$, 0 V $V_{th}$: threshold voltage of driving transistor $TR_D$, 3 V $V_{Cat}$: voltage applied to cathode of light-emitting portion ELP, 0 V $V_{th-EL}$: threshold voltage of light-emitting portion ELP, 3 V The organic EL display elements 10 in the first to M-th rows are line-sequentially scanned. When a period allocated to scan the organic EL display elements 10 in the respective rows is called horizontal scanning period, as shown in FIG. 7 or the like, each horizontal scanning period includes an initialization period where the first node initialization voltage is applied to the data line DTL from the signal output circuit 102 and an image signal period where an image signal $V_{Sig}$ is then applied to the data line DTL from the signal output circuit 102.

The horizontal scanning period including the image signal period corresponding to the organic EL display elements 10 in the m-th row is represented by an m-th horizontal scanning period $H_m$. The horizontal scanning period previous to the horizontal scanning period $H_m$ by P horizontal scanning periods is represented by a horizontal scanning period $H_{m_pre_P}$ or a (m-P)-th horizontal scanning period $H_{m-P}$. The same is true in the other horizontal scanning periods.

In the organic EL display apparatus according to Example 1, one of the source and drain regions of the driving transistor $TR_D$ is selectively supplied with the driving voltage $V_{CC-H}$ for allowing current to flow to the light-emitting portion ELP via the driving transistor $TR_D$ and the second node initialization voltage $V_{CC-L}$ for initializing the potential of the second node $ND_2$ from the power source unit 100.

For the purpose of easy understanding of the invention, a driving operation and a problem in a reference example using the organic EL display apparatus according to Example 1 will be described now. The timing diagram of the driving operation of the light-emitting portion ELP according to the reference example is schematically shown in FIG. 4, and the ON and OFF states of the transistors are shown in FIGS. 5A to 5F and FIGS. 6A and 6B.

The method of driving an organic EL display apparatus according to the reference example includes the steps of, in the (n, m)-th organic EL display element 10, (a') performing a preprocessing process of initializing the potential of the first node $ND_1$ and the potential of the second node $ND_2$ so that the potential difference between the first node $ND_1$ and the second node $ND_2$ is greater than the threshold voltage $V_{th}$ of the driving transistor $TR_D$ and the potential difference between the second node $ND_2$ and the cathode of the light-emitting portion ELP is not greater than the threshold voltage $V_{th-EL}$ of the light-emitting portion ELP, (b') performing a threshold voltage canceling process of changing the potential of the second node $ND_2$ to the potential obtained by subtracting the threshold voltage $V_{th}$ of the driving transistor $TR_D$ from the potential of the first node $ND_1$ in a state where the potential of the first node $ND_1$ is maintained, (c') performing a writing process of applying the image signal $V_{Sig}$ to the first node $ND_1$ from the data line DTL via the writing transistor $TR_W$ turned on by the signal from the scanning line SCL, (d') changing the first node $ND_1$ to a floating state by turning off the writing transistor $TR_W$ by the signal from the scanning line SCL, (e') driving the light-emitting portion ELP by allowing the current corresponding to the potential difference between the first node $ND_1$ and the second node $ND_2$ to flow in the light-emitting portion ELP from the power source unit 100 via the driving transistor $TR_D$, and (f') applying the second node initialization voltage $V_{CC-L}$ to the second node $ND_2$ from the power source unit 100 via the driving transistor $TR_D$ to change the light-emitting portion ELP to a non-emission state.

Figure 4:
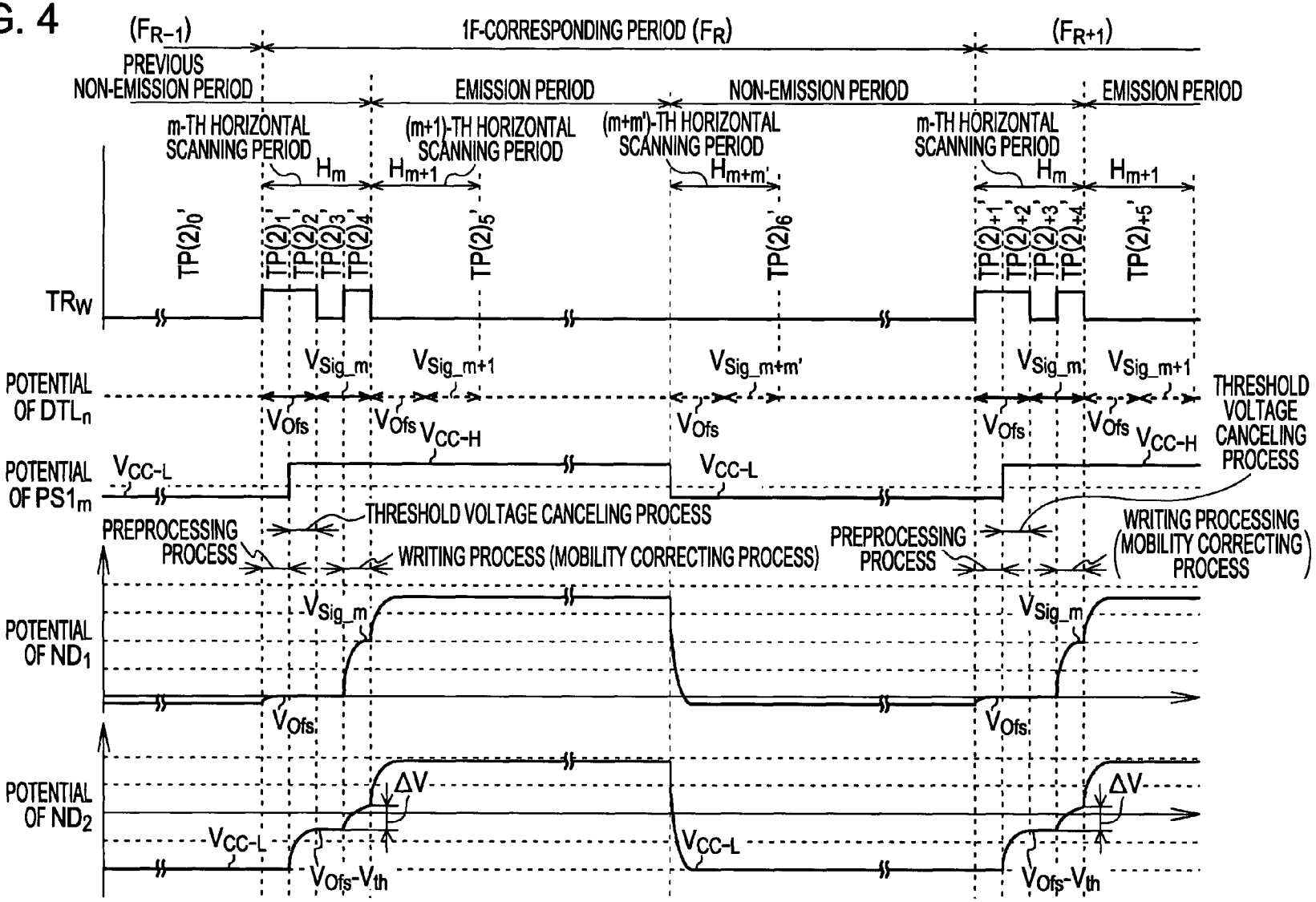
FIG. 4 is a timing diagram schematically illustrating the driving operation of an organic EL light-emitting portion according to a reference example.

Period $TP(2)_0$' to period $TP(2)_3$' shown in FIG. 4 are an operating period just before period $TP(2)_4$' where the writing process is performed. In period $TP(2)_0$' to period $TP(2)_3$', the (n, m)-th organic EL display element 10 is basically in a non-emission state. As shown in FIG. 4, in addition to period $TP(2)_4$', period $TP(2)_1$' to period $TP(2)_3$' are included in the m-th horizontal scanning period $H_m$. For the purpose of convenient explanation, it is assumed that the start of period $TP(2)_1$' and the end of period $TP(2)_4$' correspond to the start and the end of the m-th horizontal scanning period $H_m$.

In addition, it is assumed that the start of period $TP(2)_1$' and the end of period $TP(2)_2$' correspond to the start and the end of the initialization period of the horizontal scanning period $H_m$. It is assumed that the start of period $TP(2)_3$' and the end of period $TP(2)_4$' correspond to the start and the end of the image signal period of the horizontal scanning period $H_m$.

The periods of period $TP(2)_0$' to period $TP(2)_3$' will be described now. The respective lengths of period $TP(2)_1$' to period $TP(2)_3$' can be properly set depending on the design rule of the organic EL display apparatus.

Period $TP(2)_0$' (see FIGS. 4 and 5A)

The operation in period $TP(2)_0$' is, for example, an operation in the previous display frame to the present display frame. That is, period $TP(2)_0$' is a period from the start of the (m+m')-th horizontal scanning period in the previous display frame to the (m−1)-th horizontal scanning period in the present display frame. "m'" will be described later. In period $TP(2)_0$', the (n, m)-th organic EL display element 10 is in a non-emission state. At the start (not shown) of period $TP(2)_0$', the voltage supplied from the power source unit 100 is switched from the driving voltage $V_{CC-H}$ to the second node initialization voltage $V_{CC-L}$. As a result, the potential of the second node $ND_2$ decreases up to $V_{CC-L}$, and a reverse voltage is applied across the anode and the cathode of the light-emitting portion ELP, whereby the light-emitting portion ELP is changed to a non-emission state. The potential of the first node $ND_1$ (the gate electrode of the driving transistor $TR_D$) in the floating state also decreases with the decrease in potential of the second node $ND_2$.

As described above, in the horizontal scanning periods, the first node initialization voltage $V_{Ofs}$ is applied to the data line DTL from the signal output circuit 102 and the image signal $V_{Sig}$ is then applied instead of the first node initialization voltage $V_{Ofs}$. More specifically, in the m-th horizontal scanning period $H_m$ of the present display frame, the first node initialization voltage $V_{Ofs}$ is applied to the data line DTL and the image signal (represented by $V_{Sig_m}$ for the purpose of convenience, which is true in other image signals) corresponding to the (n, m)-th sub pixel is then applied instead of the first node initialization voltage $V_{Ofs}$. Similarly, in the (m+1)-th horizontal scanning period $H_{m+1}$, the first node initialization voltage $V_{Ofs}$ is applied to the data line DTL and the image signal $V_{Sig_m+1}$ corresponding to the (n, m+1)-th sub pixel is then applied instead of the first node initialization voltage $V_{Ofs}$. Although not shown in FIG. 4, the first node initialization voltage $V_{Ofs}$ and the image signal $V_{Sig}$ are applied to the data line DTL in the horizontal scanning periods other than the horizontal scanning periods $H_m$, $H_{m+1}$, and $H_{m+m'}$.

Period TP(2)$_1$' (see FIGS. 4 and 5B)

The m-th horizontal scanning period $H_m$ of the present display frame is started. In period TP(2)$_1$', the step of (a') is performed.

Specifically, at the start time of period TP(2)$_1$', the writing transistor $TR_W$ is turned on by setting the scanning line SCL to a high level. The voltage applied to the data line DTL from the signal output circuit 102 is $V_{Ofs}$ (initialization period). As a result, the potential of the first node $ND_1$ is $V_{Ofs}$ (0 V). Since the second node initialization voltage $V_{CC-L}$ is applied to the second node $ND_2$ from the power source unit 100, the potential of the second node $ND_2$ is maintained in $V_{CC-L}$ (−10 V).

Since the potential difference between the first node $ND_1$ and the second node $ND_2$ is 10 V and the threshold voltage $V_{th}$ of the driving transistor $TR_D$ is 3 V, the driving transistor $TR_D$ is in the ON state. The potential difference between the second node $ND_2$ and the cathode of the light-emitting portion ELP is −10 V and is not greater than the threshold voltage $V_{th-EL}$ of the light-emitting portion ELP. Accordingly, the preprocessing process of initializing the potential of the first node $ND_1$ and the potential of the second node $ND_2$ is finished.

Period TP(2)$_2$' (see FIGS. 4 and 5C)

In period TP(2)$_2$', the step of (b') is performed.

That is, with the writing transistor $TR_W$ maintained in the On state, the voltage supplied from the power source unit 100 is switched from $V_{CC-L}$ to $V_{CC-H}$. As a result, the potential of the first node $ND_1$ does not vary ($V_{Ofs}$=0 V is maintained), but the potential of the second node $ND_2$ varies to the potential obtained by subtracting the threshold voltage $V_{th}$ of the driving transistor $TR_D$ from the potential of the first node $ND_1$. That is, the potential of the second node $ND_2$ in the floating state increases. For the purpose of convenient explanation, the length of period TP(2)$_2$' is sufficient to change the potential of the second node $ND_2$.

When the period TP(2)$_2$' is sufficiently long, the potential difference between the gate electrode of the driving transistor $TR_D$ and the other of the source and drain regions reaches $V_{th}$ and thus the driving transistor $TR_D$ is turned off. That is, the potential of the second node $ND_2$ in the floating state approaches ($V_{Ofs}-V_{th}$=−3 V) and finally becomes ($V_{Ofs}-V_{th}$). When Expression 2 is guaranteed, in other words, when the potential is selected and determined to satisfy Expression 2, the light-emitting portion ELP does not emit light.

$$(V_{Ofs}-V_{th})<(V_{th-EL}+V_{Cat}) \quad \text{Expression 2}$$

In period TP(2)$_2$', the potential of the second node $ND_2$ finally becomes ($V_{Ofs}-V_{th}$). That is, the potential of the second node $ND_2$ is determined depending only on the threshold voltage $V_{th}$ of the driving transistor $TR_D$ and the voltage $V_{Ofs}$ for initializing the potential of the gate electrode of the driving transistor $TR_D$. The potential of the second node does not depend on the threshold voltage $V_{th-EL}$ of the light-emitting portion ELP.

Period TP(2)$_3$' (see FIGS. 4 and 5D)

At the start time of period TP(2)$_3$', the writing transistor $TR_W$ is turned off by the signal from the scanning line SCL. The voltage applied to the data line DTL is switched from the first node initialization voltage $V_{Ofs}$ to the image signal $V_{Sig_m}$ (image signal period). When the driving transistor $TR_D$ is turned off in the threshold voltage canceling process, the potentials of the first node $ND_1$ and the second node $ND_2$ are not changed. When the driving transistor $TR_D$ is not turned off in the threshold voltage canceling process, a bootstrap operation occurs in period TP(2)$_3$' and thus the potentials of the first node $ND_1$ and the second node $ND_2$ slightly increase.

Period TP(2)$_4$' (see FIGS. 4 and 5E)

In this period, the step of (c') is performed. The writing transistor $TR_W$ is turned on by the signal from the scanning line SCL. The image signal $V_{Sig_m}$ is applied to the first node $ND_1$ from the data line DTL via the writing transistor $TR_W$. As a result, the potential of the first node $ND_1$ increases to $V_{Sig_m}$. The driving transistor $TR_D$ is in the ON state. In some cases, the ON state of the writing transistor $TR_W$ may be maintained in period TP(2)$_3$'. In this configuration, when the voltage of the data line DTL is switched from the first node initialization voltage $V_{Ofs}$ to the image signal $V_{Sig_m}$ in period TP(2)$_3$', the writing process is started at once.

Here, the capacitance of the capacitor $C_1$ is $c_1$ and the capacitance of the capacitor $C_{EL}$ of the light-emitting portion ELP is $c_{EL}$. The parasitic capacitance between the gate electrode of the driving transistor $TR_D$ and the other of the source and drain regions is $c_{gs}$. When the potential of the gate electrode of the driving transistor $TR_D$ is changed from $V_{Ofs}$ to $V_{Sig_m}$ (>$V_{Ofs}$), the potentials (the potentials of the first node $ND_1$ and the second node $ND_2$) of both ends of the capacitor $C_1$ basically vary. That is, the electric charges based on the variation ($V_{Sig_m}-V_{Ofs}$) of the potential (=potential of the first node $ND_1$) of the gate electrode of the driving transistor $TR_D$ are distributed to the capacitor $C_1$, the capacitor $C_{EL}$ of the light-emitting portion ELP, and the parasitic capacitor between the gate electrode of the driving transistor $TR_D$ and the other of the source and drain regions. When the value of $c_{EL}$ is sufficiently greater than the value of $c_1$ and the value of $c_{gs}$, the variation in potential of the other of the source and drain regions (the second node $ND_2$) of the driving transistor $TR_D$ based on the variation ($V_{Sig_m}-V_{Ofs}$) in potential of the gate electrode of the driving transistor $TR_D$ is small. In general, the capacitance value $c_{EL}$ of the capacitor $C_{EL}$ of the light-emitting portion ELP is greater than the capacitance value $c_1$ of the capacitor $C_1$ and the value $c_{gs}$ of the parasitic capacitor of the driving transistor $TR_D$. Therefore, in the above description, the variation in potential of the second node $ND_2$ resulting from the variation in potential of the first node $ND_1$ is not considered. Provided that it is not particularly necessary, it is assumed that the variation in potential of the second node $ND_2$ resulting from the variation in potential of the first node $ND_1$ is not considered. The same is true in the other examples. In the timing diagram for driving, the variation in potential of the second node $ND_2$ resulting from the variation in potential of the first node $ND_1$ is not considered.

In the above-mentioned writing process, in the state where the driving voltage $V_{CC-H}$ is applied to one of the source and drain regions of the driving transistor $TR_D$ from the power source unit 100, the image signal $V_{Sig_m}$ is applied to the gate electrode of the driving transistor $TR_D$. Accordingly, as shown in FIG. 4, the potential of the second node $ND_2$ increases in period TP(2)$_4$'. The amount of increasing potential (ΔV in FIG. 4) will be described later. When the potential of the gate electrode (the first node $ND_1$) of the driving transistor $TR_D$ is $V_g$ and the potential of the other of the source and drain regions (the second node $ND_2$) of the driving transistor $TR_D$ is $V_s$, the value of $V_g$ and the value of $V_s$ are as follows without considering the increase in potential of the second node $ND_2$. The potential difference between the first node $ND_1$ and the second node $ND_2$, that is, the potential difference $V_{gs}$ between the gate electrode of the driving transistor $TR_D$ and the other of the source and drain regions serving as a source region can be expressed by Expression 3.

$$V_g = V_{Sig_m}$$

$$V_s \cong V_{Ofs} - V_{th}$$

$$V_{gs} \cong V_{Sig_m} - (V_{Ofs} - V_{th}) \quad \text{Expression 3}$$

That is, $V_{gs}$ obtained in the writing process on the driving transistor $TR_D$ depends only on the image signal $V_{Sig_m}$ for controlling the luminance of the light-emitting portion ELP, the threshold voltage $V_{th}$ of the driving transistor $TR_D$, and the voltage $V_{Ofs}$ for initializing the potential of the gate electrode of the driving transistor $TR_D$. The value $V_{gs}$ does not depend on the threshold voltage $V_{th\text{-}EL}$ of the light-emitting portion ELP.

The increase in potential of the second node $ND_2$ in period $TP(\mathbf{2})_4'$ will be described now. In the above-mentioned driving method of the reference example, the mobility correcting process of raising the potential of the other of the source and drain regions (that is, the potential of the second node $ND_2$) of the driving transistor $TR_D$ depending on the characteristic (for example, the magnitude of the mobility μ) of the driving transistor $TR_D$ is performed together with the writing process.

When the driving transistor $TR_D$ is formed of a polysilicon thin film transistor, it is difficult to avoid the deviation in mobility μ between the transistors. Accordingly, even when the same value of image signal $V_{Sig}$ is applied to the gate electrodes of plural driving transistors $TR_D$ having difference in mobility μ, a difference exists between the drain current $I_{ds}$ flowing in the driving transistor $TR_D$ having large mobility μ and the drain current $I_{ds}$ flowing in the driving transistor $TR_D$ having small mobility μ. When the difference exists, the uniformity in screen of the organic EL display apparatus is damaged.

In the above-mentioned driving method of the reference example, the image signal $V_{Sig_m}$ is applied to the gate electrode of the driving transistor $TR_D$ in the state where the driving voltage $V_{CC\text{-}H}$ is applied to one of the source and drain regions of the driving transistor $TR_D$ from the power source unit 100. Accordingly, as shown in FIG. 4, the potential of the second node $ND_2$ increases in period $TP(\mathbf{2})_4'$. When the value of the mobility μ of the driving transistor $TR_D$ is great, the amount of increasing potential ΔV (potential correcting value) of the potential (that is, the potential of the second node $ND_2$) of the other of the source and drain regions of the driving transistor $TR_D$ increases. On the contrary, when the value of the mobility μ of the driving transistor $TR_D$ is small, the amount of increasing potential ΔV (potential correcting value) of the potential of the other of the source and drain regions of the driving transistor $TR_D$ decreases. Here, the potential difference $V_{gs}$ between the gate electrode of the driving transistor $TR_D$ and the other of the source and drain regions serving as a source region is modified from Expression 3 to Expression 4.

$$V_{gs} \cong V_{Sig_m} - (V_{Ofs} - V_{th}) - \Delta V \quad \text{Expression 4}$$

A predetermined time (the total time ($t_0$) of period $TP(\mathbf{2})_4'$ in FIG. 4) where the writing process is performed can be determined in advance as a design value at the time of designing the organic EL display apparatus. The total time $t_0$ of period $TP(\mathbf{2})_4'$ is determined so that the potential ($V_{Ofs} - V_{th} + \Delta V$) of the other of the source and drain regions of the driving transistor $TR_D$ satisfy Expression 2'. Accordingly, the light-emitting portion ELP does not emit light in period $TP(\mathbf{2})_4'$. In addition, the deviation of coefficient k ($\equiv(1/2)\cdot(W/L)\cdot C_{ox}$) is corrected at the same time as the mobility correcting process.

$$(V_{Ofs} - V_{th} + \Delta V) < (V_{th\text{-}EL} + V_{Cat}) \quad \text{Expression 2'}$$

Period $TP(\mathbf{2})_5'$ (see FIGS. 4 and 5F)

By the above-mentioned operations, the step of (a') to the step of (c') are completed. Thereafter, in period $TP(\mathbf{2})_5'$, the step of (d') and the step of (e') are performed. That is, in the state where the driving voltage $V_{CC\text{-}H}$ is applied to one of the source and drain regions of the driving transistor $TR_D$ from the power source unit 100, the scanning line SCL is set to the low level by the operation of the scanning circuit 101, the writing transistor $TR_W$ is turned off, and the first node $ND_1$, that is, the gate electrode of the driving transistor $TR_D$, is set to the floating state. As a result, the potential of the second node $ND_2$ increases.

As described above, since the gate electrode of the driving transistor $TR_D$ is in the floating state and the capacitor $C_1$ exists, the same phenomenon as in a so-called bootstrap circuit occurs in the gate electrode of the driving transistor $TR_D$ and thus the potential of the first node $ND_1$ also increases. As a result, the potential difference $V_{gs}$ between the gate electrode of the driving transistor $TR_D$ and the other of the source and drain regions serving as a source region is held in the value of Expression 4.

Since the potential of the second node $ND_2$ increases and is greater than ($V_{th\text{-}EL} + V_{Cat}$), the light-emitting portion ELP starts emitting light. At this time, since the current flowing in the light-emitting portion ELP is the drain current $I_{ds}$ flowing from the drain region to the source region of the driving transistor $TR_D$, the current can be expressed by Expression 1. Here, Expression 1 can be modified into Expression 5 using Expressions 1 and 4.

$$I_{ds} = k\cdot\mu\cdot(V_{Sig_m} - V_{Ofs} - \Delta V)^2 \quad \text{Expression 5}$$

Therefore, for example, when $V_{Ofs}$ is set to 0 V, the current $I_{ds}$ flowing in the light-emitting portion ELP is proportional to the square of the value obtained by subtracting the potential correcting value ΔV based on the mobility μ of the driving transistor $TR_D$ from the value of the image signal $V_{Sig_m}$ for controlling the luminance of the light-emitting portion ELP. In other words, the current $I_{ds}$ flowing in the light-emitting portion ELP does not depend on the threshold voltage $V_{th\text{-}EL}$ of the light-emitting portion ELP and the threshold voltage $V_{th}$ of the driving transistor $TR_D$. That is, the light intensity (luminance) of the light-emitting portion ELP does not depend on the threshold voltage $V_{th\text{-}EL}$ of the light-emitting portion ELP and the threshold voltage $V_{th}$ of the driving transistor $TR_D$. The luminance of the (n, m)-th organic EL display element 10 is a value corresponding to the current $I_{ds}$.

The potential correcting value ΔV increases as the mobility μ of the driving transistor $TR_D$ increases. Accordingly, the value of $V_{gs}$ on the left side of Expression 4 decreases. Therefore, even when the value of the mobility μ in Expression 5 increases, the value of $(V_{Sig_m} - V_{Ofs} - \Delta V)^2$ decreases, thereby correcting the drain current $I_{ds}$. That is, when the values of the mobility μ of the driving transistors $TR_D$ are different but the value of the image signal $V_{Sig}$ is equal, the drain current $I_{ds}$ is almost uniform. Accordingly, the current $I_{ds}$ flowing in the light-emitting portion ELP so as to control the luminance of the light-emitting portion ELP is rendered uniform. As a result, it is possible to correct the deviation in luminance of the light-emitting portions ELP due to the deviation of the mobility μ (additionally, the deviation of k).

The emission state of the light-emitting portion ELP is maintained until the (m+m'−1)-th horizontal scanning period. The end of the (m+m'−1)-th horizontal scanning period corresponds to the end of period $TP(\mathbf{2})_5'$. Here, "m'" satisfies the relation of 1<m'<M and is a predetermined value in the organic EL display apparatus. In other words, the light-emitting portion ELP is driven from the start of the (m+1)-th horizontal scanning period $H_{m+1}$ to the time just before the (m+m')-th horizontal scanning period $H_{m+m'}$, and this period is an emission period.

Figure 6A:
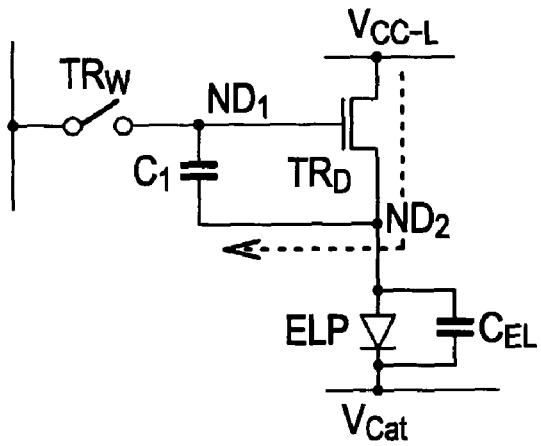
FIGS. 6A and 6B are diagrams schematically illustrating ON/OFF states of the transistors constituting the driving circuit of the organic EL display element, which is subsequent to FIG. 5F.

Period TP(2)$_6$' (see FIGS. 4 and 6A)

Then, the step of (f') is performed to put the light-emitting portion ELP in the non-emission period.

Specifically, in the state where the OFF state of the writing transistor $TR_W$ is maintained, the voltage supplied from the power source unit 100 is switched from the voltage $V_{CC-H}$ to the voltage $V_{CC-L}$ in the start of period TP(2)$_6$' (in other words, the start of the (m+m')-th horizontal scanning period $H_{m+m'}$). As a result, the potential of the second node $ND_2$ decreases up to $V_{CC-L}$, a reverse voltage is applied between the anode and the cathode of the light-emitting portion ELP, and thus the light-emitting portion ELP is in the non-emission state. With the decrease in potential of the second node $ND_2$, the potential of the first node $ND_1$ (the gate electrode of the driving transistor $TR_D$) in the floating state also decreases.

The non-emission state is maintained to the time just before the m-th horizontal scanning period $H_m$ in the next frame. This time corresponds to the time just before the start of period TP(2)$_{+1}$' shown in FIG. 4. In this way, by providing the non-emission period, it is possible to reduce the afterimage blur due to the active matrix driving method, thereby improving the quality of a moving image. For example, when m'=M/2 is set, the time lengths of the emission period and the non-emission period are each almost a half of one display frame period.

Figure 6B:
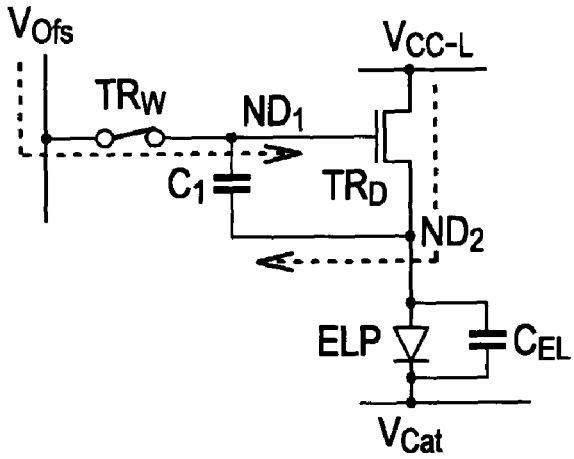

After period TP(2)$_{+1}$', the same processes as described in period TP(2)$_1$' to period TP(2)$_6$' are repeatedly performed (see FIGS. 4 and 6B). That is, period TP(2)$_6$' shown in FIG. 4 corresponds to the next period TP(2)$_0$'.

In the driving method according to the reference example, most of the non-emission period is occupied by period TP(2)$_6$' shown in FIG. 4. In the period, the reverse voltage with a value of $|V_{CC-L}-V_{Cat}|$ is applied to the light-emitting portion ELP. That is, in the above-mentioned example, the reverse voltage of 10 V is continuously applied to the light-emitting portion ELP from the start of the (m+m')-th horizontal scanning period $H_{m+m'}$ to the vicinity of the start of the m-th horizontal scanning period $H_m$ of the next frame.

The driving method according to Example 1 will be described now. The timing diagram of the driving operation of the light-emitting portion ELP according to Example 1 is schematically shown in FIG. 7, and the ON and OFF states of the transistors are shown in FIGS. 8A to 8F and FIGS. 9A to 9F.

The method of driving an organic EL display apparatus according to Example 1 includes the steps of, in the (n, m)-th organic EL display element 10, (a) performing a preprocessing process of initializing the potential of the first node $ND_1$ and the potential of the second node $ND_2$, so that the potential difference between the first node $ND_1$ and the second node $ND_2$ is greater than the threshold voltage $V_{th}$ of the driving transistor $TR_D$ and the potential difference between the second node $ND_2$ and the cathode of the light-emitting portion ELP is not greater than the threshold voltage $V_{th-EL}$ of the light-emitting portion ELP, in an initialization period located before the end of the horizontal scanning period $H_{m_pre_P}$ by applying the first node initialization voltage $V_{Ofs}$ to the first node $ND_1$ from the corresponding data line DTL via the writing transistor $TR_W$ turned on by the operation of the scanning circuit 101 to initialize the potential of the first node $ND_1$ and applying a second node initialization voltage $V_{CC-L}$ to the one of the source and drain regions of the driving transistor $TR_D$ from the power source unit 100 to initialize the potential of the second node $ND_2$, (b) switching the voltage of the power source unit 100 from the second node initialization voltage $V_{CC-L}$ to the driving voltage $V_{CC-H}$ and holding the state where the driving voltage $V_{CC-H}$ is applied to the one of the source and drain regions of the driving transistor $TR_D$ from the power source unit 100, (c) performing a threshold voltage canceling process of changing the potential of the second node $ND_2$ until the potential obtained by subtracting the threshold voltage $V_{th}$ of the driving transistor $TR_D$ from the first node initialization voltage $V_{Ofs}$ to turn off the driving transistor $TR_D$ in the initialization period of the horizontal scanning period $H_{m_pre_P}$, by applying the driving voltage $V_{CC-H}$ to the one of the source and drain regions of the driving transistor $TR_D$ from the power source unit 100 in a state where the writing transistor $TR_W$ is turned on in the initialization period by the operation of the scanning circuit 101 and the first node initialization voltage $V_{Ofs}$ is applied to the first node $ND_1$ from the data line DTL via the turned-on writing transistor $TR_W$, (d) changing the first node $ND_1$ to a floating state and holding the OFF state of the driving transistor $TR_D$, by turning off the writing transistor $TR_W$ by the operation of the scanning circuit 101, (e) performing a writing process of applying the image signal to the first node $ND_1$ from the data line DTL in the image signal period of the horizontal scanning period $H_m$ via the writing transistor $TR_W$ turned on by the operation of the scanning circuit 101, and (f) changing the first node $ND_1$ to a floating state and allowing current corresponding to the potential difference between the first node $ND_1$ and the second node $ND_2$ to flow to the light-emitting portion ELP via the driving transistor $TR_D$ from the power source unit 100 by turning off the writing transistor $TR_W$ by the operation of the scanning circuit 101. The same is true in the method of driving an organic EL display apparatus according to Example 2, Example 3, and Example 4 to be described later.

In Example 1, the step of (a) is performed in the initialization period of the horizontal scanning period $H_{m_{pre}_P}$. As described above, since the horizontal scanning period $H_{m_pre_P}$ is the horizontal scanning period $H_{m-P}$, the latter notation is used in the following description for the purpose of convenience. The same is true in the drawings. As described later, for example, when P=M/2 is set, the time lengths of the emission period and the non-emission period are each almost a half of one display frame period.

Periods TP(2)$_0$ to TP(2)$_5$ shown in FIG. 7 are an operating period to the time just before period TP(2)$_6$ where the writing process is performed. In periods TP(2)$_0$ to TP(2)$_6$, the (n, m)-th organic EL display element 10 is in the non-emission state. As shown in FIG. 7, periods TP(2)$_4$ to TP(2)$_5$ in addition to period TP(2)$_6$ are included in the m-th horizontal scanning period $H_m$.

For the purpose of simplifying the explanation, the start of period TP(2)$_1$ corresponds to the start of the initialization period (which is a period where the potential of the data line DTL is $V_{Ofs}$ in FIG. 7 and which is true in the other horizontal scanning periods) of the (m-P)-th horizontal scanning period $H_{m-P}$. Similarly, the end of period TP(2)$_2$ corresponds to the end of the initialization period of the horizontal scanning period $H_{m-P}$. The start of period TP(2)$_3$ corresponds to the start of the image signal period (which is a period where the potential of the data line DTL is $V_{Sig_m-P}$ in FIG. 7) of the horizontal scanning period $H_{m-P}$.

The start and end of period TP(2)$_4$ correspond to the start and end of the initialization period of the m-th horizontal scanning period. The start of period TP(2)$_5$ corresponds to the start of the image signal period (which is a period where the potential of the data line DTL is $V_{Sig_m}$ in FIG. 7) of the m-th horizontal scanning period $H_m$. Similarly, the end of period $TP(2)_6$ corresponds to the end of the image signal period of the horizontal scanning period $H_m$.

The respective periods of periods $TP(2)_{-1}$ to $TP(2)_3$ will be described now.

Period $TP(2)_{-1}$ (see FIGS. 7 and 8A)

Period $TP(2)_{-1}$ is a period where an operation is performed in the previous display frame and the (n, m)-th organic EL display element 10 is in the emission state after the previous processes are finished. That is, the drain current $I'_{ds}$ based on Expression 5 flows in the light-emitting portion ELP of the organic EL display element 10 constituting the (n, m)-th sub pixel and the luminance of the organic EL display element 10 constituting the (n, m)-th sub pixel has a value corresponding to the drain current $I'_{ds}$. Here, the writing transistor $TR_W$ is in the OFF state and the driving transistor $TR_D$ is in the ON state.

Period $TP(2)_0$ (see FIGS. 7 and 8B)

In period $TP(2)_0$, the operation is changed from the previous display frame to the present display frame. That is, period $TP(2)_0$ is a period just before the start of the (m-P)-th horizontal scanning period $H_{m-P}$. In period $TP(2)_0$, the (n, m)-th organic EL display element 10 is in the non-emission state. That is, the voltage supplied from the power source unit 100 is switched from the driving voltage $V_{CC-H}$ to the second node initialization voltage $V_{CC-L}$. As a result, the potential of the second node $ND_2$ decreases to $V_{CC-L}$, the reverse voltage is applied between the anode and the cathode of the light-emitting portion ELP, and thus the light-emitting portion ELP is changed to the non-emission state. With the decrease in potential of the second node $ND_2$, the potential of the first node $ND_1$ (the gate electrode of the driving transistor $TR_D$) in the floating state also decreases.

Period $TP(2)_1$ (see FIGS. 7 and 8C)

The (m-P)-th horizontal scanning period $H_{m-P}$ of the present display frame is started. In period $TP(2)_1$, the step of (a), that is, the preprocessing process is performed.

As described above, the start and end of the initialization period of the horizontal scanning period $H_{m-P}$ are the start of period $TP(2)_1$ and the end of period $TP(2)_2$. At the start of period $TP(2)_1$, the writing transistor $TR_W$ is turned on by the signal from the scanning line SCL and the first node initialization voltage $V_{Ofs}$ is applied to the first node $ND_1$ from the data line DTL via the writing transistor $TR_W$ in the ON state, whereby the potential of the first node $ND_1$ is initialized. The second node initialization voltage $V_{CC-L}$ is applied to one of the source and drain regions of the driving transistor $TR_D$ from the power source unit 100, thereby initializing the potential of the second node $ND_2$.

As a result, the potential of the first node $ND_1$ becomes $V_{Ofs}$ (0 V). Since the second node initialization voltage $V_{CC-L}$ is applied to the second node $ND_2$ from the power source unit 100, the potential of the second node $ND_2$ is maintained in $V_{CC-L}$ (−10 V).

Since the potential difference between the first node $ND_1$ and the second node $ND_2$ is 10 V and the threshold voltage $V_{th}$ of the driving transistor $TR_D$ is 3 V, the driving transistor $TR_D$ is turned on. The potential difference between the second node $ND_2$ and the cathode of the light-emitting portion ELP is −10 V, which is not greater than the threshold voltage $V_{th-EL}$ of the light-emitting portion ELP. Accordingly, the preprocessing process of initializing the potential of the first node $ND_1$ and the potential of the second node $ND_2$ is finished.

At the end of period $TP(2)_1$, the step of (b) is performed. Specifically, the voltage of the power source unit 100 is switched from the second node initialization voltage $V_{CC-L}$ to the driving voltage $V_{CC-H}$ and the state where the driving voltage $V_{CC-H}$ is applied to one of the source and drain regions of the driving transistor $TR_D$ from the power source unit 100 is maintained.

Period $TP(2)_2$ (see FIG. 7 and FIGS. 8D and 8E)

In period $TP(2)_2$, the step of (c), that is, the above-mentioned threshold voltage canceling process, is performed.

The writing transistor $TR_W$ is turned on by the operation of the scanning circuit 101 in the initialization period, and the driving voltage $V_{CC-H}$ is applied to one of the source and drain regions of the driving transistor $TR_D$ from the power source unit 100 in the state where the first node initialization voltage $V_{Ofs}$ is applied to the first node $ND_1$ from the data line DTL via the turned-on writing transistor $TR_W$. In Example 1, the ON state of the writing transistor $TR_W$ is maintained in period $TP(2)_2$.

In period $TP(2)_2$, the potential of the first node $ND_1$ does not vary ($V_{Ofs}$=0 V is maintained) but the potential of the second node $ND_2$ varies to the potential obtained by subtracting the threshold voltage $V_{th}$ of the driving transistor $TR_D$ from the potential of the first node $ND_1$. That is, the potential of the second node $ND_2$ in the floating state approaches $V_{Ofs}-V_{th}$=−3 V and finally becomes $V_{Ofs}-V_{th}$. In this way, the threshold voltage canceling process of making the potential of the second node $ND_2$ vary up to the potential obtained by subtracting the threshold voltage $V_{th}$ of the driving transistor $TR_D$ from the first node initialization voltage $V_{Ofs}$ to turn off the driving transistor $TR_D$ is performed.

In periods $TP(2)_3$ to $TP(2)_5$, the step of (d) is performed. That is, by turning off the writing transistor $TR_W$ on the basis of the operation of the scanning circuit 101, the first node $ND_1$ is changed to the floating state and the OFF state of the driving transistor $TR_D$ is maintained. The periods will be described now.

Period $TP(2)_3$ (see FIGS. 7 and 8F)

At the start of period $TP(2)_3$, the writing transistor $TR_W$ is switched to the OFF state. The driving transistor $TR_D$ is maintained in the OFF state and the potential of the first node $ND_1$ and the potential of the second node $ND_2$ do not vary.

Period $TP(2)_4$ (see FIGS. 7 and 9A)

In period $TP(2)_4$, the m-th horizontal scanning period is started. The first node initialization voltage $V_{Ofs}$ is applied to the data line DTL. The driving transistor $TR_D$ is maintained in the OFF state and the potential of the first node $ND_1$ and the potential of the second node $ND_2$ do not vary.

Period $TP(2)_5$ (see FIGS. 7 and 9B)

At the start of period $TP(2)_5$, the voltage applied to the data line DTL is switched from the first node initialization voltage $V_{Ofs}$ to the image signal $V_{Sig_m}$. The driving transistor $TR_D$ is maintained in the OFF state and the potential of the first node $ND_1$ and the potential of the second node $ND_2$ do not vary.

In periods $TP(2)_3$ to $TP(2)_5$, the (n, m)-th organic EL display element 10 is maintained in the non-emission state. In the periods, the reverse voltage with a value of $|(V_{Ofs}-V_{th})-V_{Cat}|$ is applied to the light-emitting portion ELP. That is, in the above-mentioned example, the reverse voltage of 3 V is continuously applied to the light-emitting portion ELP.

Period $TP(2)_6$ (see FIGS. 7 and 9C)

In this period, the step of (e), that is, the above-mentioned writing process is performed. The writing transistor $TR_W$ is turned on by the signal from the scanning line SCL. The image signal $V_{Sig_m}$ is applied to the first node $ND_1$ from the data line DTL via the writing transistor $TR_W$. As a result, the potential of the first node $ND_1$ increases to $V_{Sig_m}$. The driving transistor $TR_D$ is in the ON state. In some cases, the writing transistor $TR_W$ may be in the ON state in periods $TP(2)_4$ and $TP(2)_5$. In this configuration, when the voltage of the data line DTL is switched from the first node initialization voltage $V_{Ofs}$ to the image signal $V_{Sig_m}$ in period $TP(2)_5$, the writing process is started at once.

A predetermined time (the total time ($t_0$) of period $TP(2)_6$ in FIG. 7) where the writing process is performed can be determined in advance as a design value at the time of designing the organic EL display apparatus. In the driving method according to Example 1, similarly to the driving method according to the reference example, the mobility correcting process of increasing the potential of the other of the source and drain regions of the driving transistor $TR_D$ (that is, the potential of the second node $ND_2$) is together performed with the writing process depending on the characteristic of the driving transistor $TR_D$. The potential correcting value $\Delta V$ of the second node $ND_2$ shown in FIG. 7 is the same as described with reference to FIG. 4 and thus the description thereof is omitted.

Period $TP(2)_7$ (see FIGS. 7 and 9D)

By the above-mentioned operations, the threshold voltage canceling process, the writing process, and the mobility correcting process are finished. Thereafter, in period $TP(2)_7$, the step of (f) is performed. That is, in the state where the driving voltage $V_{CC-H}$ is applied to one of the source and drain regions of the driving transistor $TR_D$ from the power source unit 100, the scanning line SLC is set to the low level by the operation of the scanning circuit 101, the writing transistor $TR_W$ is turned off, and the first node $ND_1$, that is, the gate electrode of the driving transistor $TR_D$, is set to the floating state. As a result, the potential of the second node $ND_2$ increases.

As described above, since the gate electrode of the driving transistor $TR_D$ is in the floating state and the capacitor $C_1$ exists, the same phenomenon as in a so-called boostrap circuit occurs in the gate electrode of the driving transistor $TR_D$ and thus the potential of the first node $ND_1$ also increases. As a result, the potential difference $V_{gs}$ between the gate electrode of the driving transistor $TR_D$ and the other of the source and drain regions serving as a source region is held in the value of Expression 4.

Since the potential of the second node $ND_2$ increases and becomes greater than ($V_{th-EL}+V_{Cat}$), the light-emitting portion ELP starts emitting light. At this time, the current flowing in the light-emitting portion ELP is the drain current $I_{ds}$ flowing from the drain region to the source region of the driving transistor $TR_D$, the current can be expressed by Expression 5.

The emission state of the light-emitting portion ELP is maintained to the end of period $TP(2)_7$. Specifically, the state where the driving voltage $V_{CC-H}$ is applied to one of the source and drain regions of the driving transistor $TR_D$ from the power source unit 100 is maintained to the end of period $TP(2)_7$.

At the start time of period $TP(2)_8$, the voltage supplied from the power source unit 100 is switched from the driving voltage $V_{CC-H}$ to the second node initialization voltage $V_{CC-L}$. Period $TP(2)_8$ is a period just before the start of the (m-P)-th horizontal scanning period in the next frame. Period $TP(2)_8$ corresponds to period $TP(2)_0$ in the next frame. After period $TP(2)_{+1}$, the same processes as described in periods $TP(2)_1$ to $TP(2)_8$ are repeatedly performed (see FIG. 7 and FIGS. 9E and 9F).

In the driving method according to Example 1 described with reference to FIG. 7, the non-emission period is periods $TP(2)_0$ to $TP(2)_6$, and the emission period is period $TP(2)_7$. In periods $TP(2)_3$ to $TP(2)_5$ constituting most of the non-emission period, the reverse voltage with a value of $|(V_{Ofs}-V_{th})-V_{Cat}|$ is applied to the light-emitting portion ELP. That is, in the above-mentioned example, the reverse voltage of 3 V is continuously applied to the light-emitting portion ELP. In the driving method according to Example 1, the reverse voltage with a value of $|V_{CC-L}-V_{Cat}|$ is applied only in periods $TP(2)_0$ and $TP(2)_1$.

In the driving method according to Example 1, the ratio of the period where the reverse voltage with a large absolute value is applied to the light-emitting portion ELP to the non-emission period can be reduced and the absolute value of the reverse voltage applied to the light-emitting portion ELP can be reduced in most of the non-emission period. Accordingly, it is possible to suppress the deterioration of the light-emitting portion ELP.

Example 2

Example 2 relates to a method of driving an organic EL display apparatus according to the first embodiment of the invention. Example 2 is a modified example of Example 1. The conceptual diagram of the organic EL display apparatus according to Example 2 is the same as shown in FIG. 1 and the equivalent circuit diagram of the organic EL display element 10 including the driving circuit 11 is the same as shown in FIG. 2. The elements of the display apparatus according to Example 2 are the same as described in Example 1 and thus description thereof is omitted. The same is true in Example 3 and Example 4.

The driving method according to Example 2 is the same as the driving method according to Example 1, except that between the step of (d) and the step of (e) described in Example 1 is performed the steps of (g) performing a second preprocessing process of initializing the potential of the first node $ND_1$ and the potential of the second node $ND_2$, so that the potential difference between the first node $ND_1$ and the second node $ND_2$ is greater than the threshold voltage of the driving transistor $TR_D$ and the potential difference between the second node $ND_2$ and the cathode of the light-emitting portion ELP is not greater than the threshold voltage $V_{th-EL}$ of the light-emitting portion ELP, in the initialization period by applying the first node initialization voltage $V_{Ofs}$ to the first node $ND_1$ from the corresponding data line DTL via the writing transistor $TR_W$ turned on by the operation of the scanning circuit 101 to initialize the potential of the first node $ND_1$ and applying a second node initialization voltage $V_{CC-L}$ to the one of the source and drain regions of the driving transistor $TR_D$ from the power source unit 100 to initialize the potential of the second node $ND_2$, (h) switching the voltage of the power source unit 100 from the second node initialization voltage $V_{CC-L}$ to the driving voltage $V_{CC-H}$ and holding the state where the driving voltage $V_{CC-H}$ is applied to the one of the source and drain regions of the driving transistor $TR_D$ from the power source unit 100, and (i) performing a second threshold voltage canceling process of changing the potential of the second node $ND_2$ until the potential obtained by subtracting the threshold voltage $V_{th}$ of the driving transistor $TR_D$ from the first node initialization voltage $V_{Ofs}$ to turn off the driving transistor $TR_D$ in the initialization period located before the end of the horizontal scanning period $H_m$, by applying the driving voltage $V_{CC-H}$ to the one of the source and drain regions of the driving transistor $TR_D$ from the power source unit 100 in a state where the writing transistor $TR_W$ is turned on in the initialization period by the operation of the scanning circuit 101 and the first node initialization voltage $V_{Ofs}$ is applied to the first node $ND_1$ from the data line DTL via the turned-on writing transistor $TR_W$.

The driving method according to Example 2 will be described now. The timing diagram of the driving operation of the light-emitting portion ELP according to Example 2 is schematically shown in FIG. 10, and the ON and OFF states of the transistors are shown in FIGS. 11A to 11E.

Figure 10:
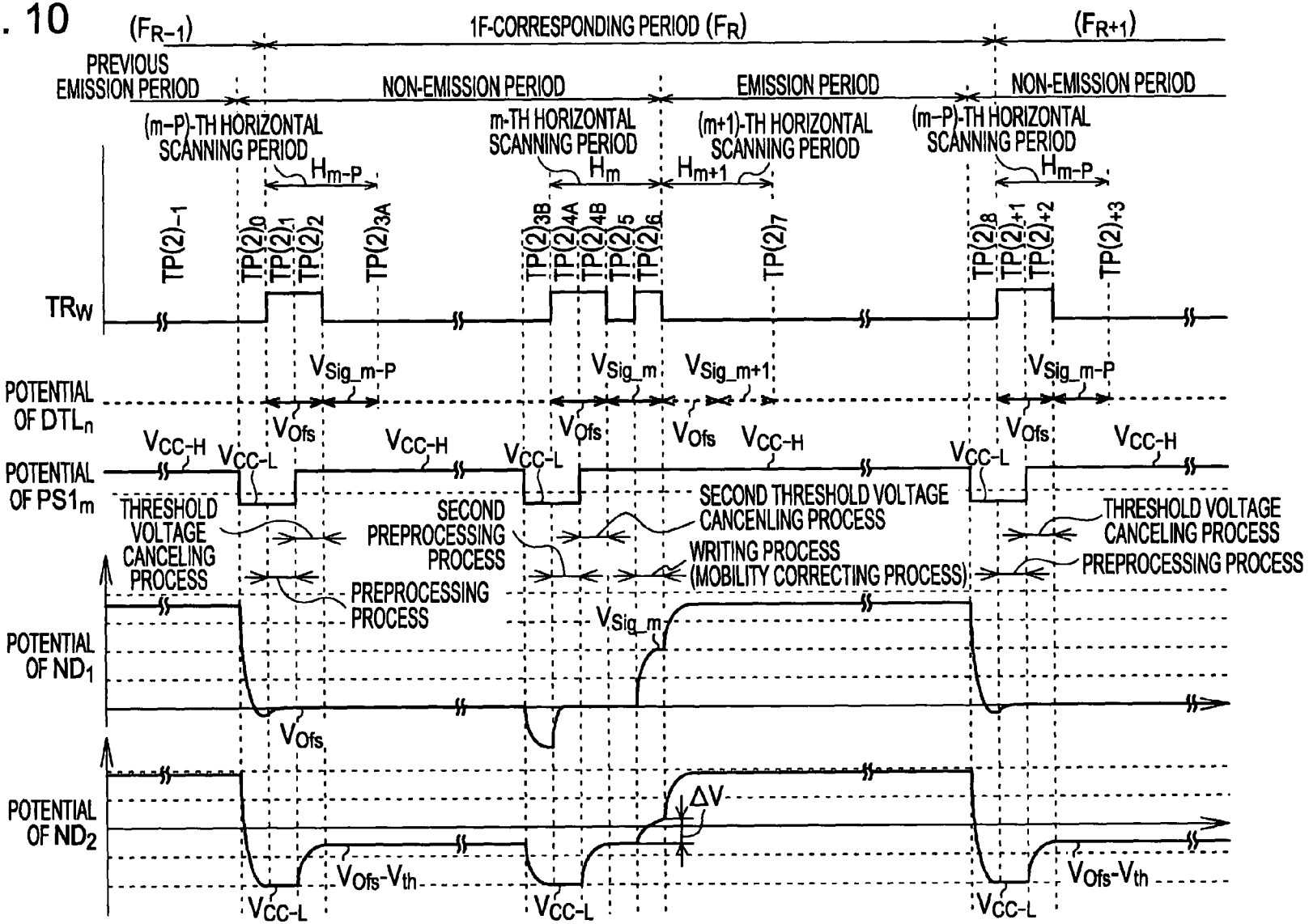
FIG. 10 is a timing diagram schematically illustrating the driving operation of an organic EL light-emitting portion according to Example 2 of the invention.

Periods $TP(2)_{-1}$ to $TP(2)_2$ (see FIG. 10)

The operations in these periods are the same as the operations in periods $TP(2)_{-1}$ to $TP(2)_2$ described with reference to FIG. 7 and FIGS. 8A to 8D in Example 1 and thus the description thereof is omitted. In period $TP(2)_2$, the step of (c), that is, the threshold voltage canceling process, is performed. The potential of the second node $ND_2$ in the floating state approaches $V_{Ofs}-V_{th}=-3$ V and finally becomes $V_{Ofs}-V_{th}$.

Period $TP(2)_{3A}$ (see FIGS. 10 and 11A)

The operations in this period is substantially the same as the operations in period $TP(2)_3$ described with reference to FIGS. 7 and 8F in Example 1. That is, in period $TP(2)_{3A}$, the driving transistor $TR_D$ is maintained in the OFF state (the step of (d)).

Period $TP(2)_{3B}$ (see FIGS. 10 and 11B)

Period $TP(2)_{3B}$ is a period just before the start of the m-th horizontal scanning period $H_m$. At the start time of period $TP(2)_{3B}$, the voltage supplied from the power source unit 100 is switched from the driving voltage $V_{CC-H}$ to the second node initialization voltage $V_{CC-L}$. As a result, the potential of the second node $ND_2$ decreases up to $V_{CC-L}$. The potential of the first node $ND_1$ also decreases with the variation in potential of the second node $ND_2$.

Period $TP(2)_{4A}$ (see FIGS. 10 and 11C)

Then, the m-th horizontal scanning period $H_m$ of the present display frame is started. In period $TP(2)_{4A}$, the step of (g), that is, the second preprocessing process, is performed.

The start and end of the initialization period of the horizontal scanning period $H_m$ correspond to the start of period $TP(2)_{4A}$ and the end of period $TP(2)_{4B}$, respectively. The start and end of the image signal period of the horizontal scanning period $H_m$ correspond to the start of period $TP(2)_5$ and the end of period $TP(2)_6$, respectively. At the start time of period $TP(2)_{4A}$, the writing transistor $TR_W$ is turned on by the signal from the scanning line SCL and the first node initialization voltage $V_{Ofs}$ is applied to the first node $ND_1$ from the data line DTL via the turned-on writing transistor $TR_W$ to initialize the potential of the first node $ND_1$. The second node initialization voltage $V_{CC-L}$ is applied to one of the source and drain regions of the driving transistor $TR_D$ from the power source unit 100 to initialize the potential of the second node $ND_2$.

The potential of the first node $ND_1$ is $V_{Ofs}$ (0 V). Since the second node initialization voltage $V_{CC-L}$ is applied to the second node $ND_2$ from the power source unit 100, the potential of the second node $ND_2$ is maintained at $V_{CC-L}$ (−10 V).

Similarly to period $TP(2)_2$ described with reference to FIG. 7 in Example 1, since the potential difference between the first node $ND_1$ and the second node $ND_2$ is 10 V and the threshold voltage $V_{th}$ of the driving transistor $TR_D$ is 3 V, the driving transistor $TR_D$ is in the ON state. The potential difference between the second node $ND_2$ and the cathode of the light-emitting portion ELP is −10 V, which is not greater than the threshold voltage $V_{th-EL}$ of the light-emitting portion ELP. Accordingly, the second preprocessing process of initializing the potential of the first node $ND_1$ and the potential of the second node $ND_2$ is finished.

At the end time of period $TP(2)_{4A}$, the step of (h) is performed. Specifically, the voltage of the power source unit 100 is switched from the second node initialization voltage $V_{CC-L}$ to the driving voltage $V_{CC-H}$ and the state where the driving voltage $V_{CC-H}$ is applied to one of the source and drain regions of the driving transistor $TR_D$ from the power source unit 100 is maintained.

Period $TP(2)_{4B}$ (see FIG. 10 and FIGS. 11D and 11E)

In period $TP(2)_{4B}$, the step of (i), that is, the second threshold voltage canceling process, is performed. In Example 2, the ON state of the writing transistor $TR_W$ is maintained in period $TP(2)_{4B}$.

In period $TP(2)_{4B}$, the potential of the first node $ND_1$ does not vary ($V_{Ofs}=0$ V is maintained), but the potential of the second node $ND_2$ varies to the potential obtained by subtracting the threshold voltage $V_{th}$ of the driving transistor $TR_D$ from the potential of the first node $ND_1$. That is, the potential of the second node $ND_2$ in the floating state approaches $V_{Ofs}-V_{th}=-3$ V and finally becomes $V_{Ofs}-V_{th}$. In this way, the second threshold voltage canceling process of making the potential of the second node $ND_2$ vary up to the potential obtained by subtracting the threshold voltage $V_{th}$ of the driving transistor $TR_D$ from the potential of the first node initialization voltage $V_{Ofs}$ is performed.

Period $TP(2)_5$ (see FIG. 10)

At the start time of period $TP(2)_5$, the writing transistor $TR_W$ is turned off by the signal from the scanning line SCL. The operation in this period is substantially the same as the operation in period $TP(2)_5$ described with reference to FIGS. 7 and 9B in Example 1 and thus the description is omitted.

Period $TP(2)_6$ (see FIG. 10)

In this period, the step of (e), that is, the writing process, is performed. The operation in this period is the same as the operation in period $TP(2)_6$ described with reference to FIGS. 7 and 9C in Example 1. That is, the writing transistor $TR_W$ is turned on by the signal from the scanning line SCL. The image signal $V_{Sig_m}$ is applied to the first node $ND_1$ from the data line DTL via the writing transistor $TR_W$. As a result, the potential of the first node $ND_1$ increases to $V_{Sig_m}$. The driving transistor $TR_D$ is in the ON state. In some cases, the writing transistor $TR_W$ may be turned on in period $TP(2)_5$. In this configuration, when the voltage of the data line DTL is switched from the first node initialization voltage $V_{Ofs}$ to the image signal $V_{Sig_m}$ in period $TP(2)_5$, the writing process is started at once.

Period $TP(2)_7$ (see FIG. 10)

In period $TP(2)_7$, the step of (f) is performed. The operation in this period is the same as the operation in period $TP(2)_7$ described with reference to FIGS. 7 and 9D in Example 1.

That is, in the state where the driving voltage $V_{CC-H}$ is applied to one of the source and drain regions of the driving transistor $TR_D$ from the power source unit 100, the scanning line SCL is set to the low level by the operation of the scanning circuit 101, the writing transistor $TR_W$ is turned off, and the first node $ND_1$, that is, the gate electrode of the driving transistor $TR_D$, is set to the floating state. As a result, the potential of the second node $ND_2$ increases.

As a result, the potential difference $V_{gs}$ between the gate electrode of the driving transistor $TR_D$ and the other of the source and drain regions serving as a source region is maintained in the value expressed by Expression 4.

Since the potential of the second node $ND_2$ increases and becomes greater than $V_{th-EL}+V_{Cat}$, the light-emitting portion ELP starts emitting light. At this time, since the current flowing in the light-emitting portion ELP is the drain current $I_{ds}$ flowing from the drain region to the source region of the driving transistor $TR_D$, the current value is obtained from Expression 5.

The emission state of the light-emitting portion ELP is continued up to the end of period $TP(2)_7$. Specifically, the state where the driving voltage $V_{CC-H}$ is applied to one of the source and drain regions of the driving transistor $TR_D$ from the power source unit 100 is maintained up to the end of period $TP(2)_7$.

At the start time of period $TP(2)_8$, the voltage supplied from the power source unit 100 is switched from the driving voltage $V_{CC-H}$ to the second node initialization voltage $V_{CC-L}$. Period $TP(2)_8$ is, for example, a period just before the start of the (m-P)-th horizontal scanning period $H_{m-P}$ of the next frame. Period $TP(2)_8$ corresponds to, for example, period $TP(2)_0$ of the next frame. After period $TP(2)_{+1}$, the same processes as described for periods $TP(2)_1$ to $TP(2)_8$ are repeatedly performed.

As described in Example 1, in the driving method according to Example 2 described with reference to FIG. 10, the non-emission period includes periods $TP(2)_0$ to $TP(2)_6$ and the emission period is period $TP(2)_7$. In period $TP(2)_{3A}$ occupying most of the non-emission period, the reverse voltage with a value of $|(V_{Ofs}-V_{th})-V_{Cat}|$ is applied to the light-emitting portion ELP. That is, in the above-mentioned example, the reverse voltage of 3 V is continuously applied to the light-emitting portion ELP. In the driving method according to Example 2, the reverse voltage with a value of $|V_{CC-L}-V_{Cat}|$ is applied only in periods $TP(2)_0$, $TP(2)_1$, $TP(2)_{3B}$, and $TP(2)_{4A}$.

Therefore, as described in Example 1, it is possible to reduce the ratio of the period where the reverse voltage with a great absolute value is applied to the light-emitting portion ELP to the non-emission period and to reduce the absolute value of the reverse voltage applied to the light-emitting portion ELP in most of the non-emission period. Accordingly, it is possible to suppress the deterioration of the light-emitting portion ELP.

The specific advantage to the driving method according to Example 2 will be described now. In Example 1, the potential of the second node $ND_2$ at the start time of period $TP(2)_3$ is $V_{Ofs}-V_{th}=-3$ V and the reverse voltage with a value of $|(V_{Ofs}-V_{th})-V_{Cat}|$, that is, with an absolute value of 3 V, is applied to both ends of the light-emitting portion ELP. Therefore, when the reverse current in the light-emitting portion ELP is sufficiently small, the potential of the second node $ND_2$ is maintained in $V_{Ofs}-V_{th}=-3$ V up to the end of period $TP(2)_3$.

However, when the reverse current in the light-emitting portion ELP is not negligible, the potential of the second node $ND_2$ increases in period $TP(2)_3$. In this case, a problem that the step of (e), that is, the writing process, is performed in the state where the potential of the second node $ND_2$ varies to vary the luminance of an image to be displayed occurs in Example 1.

In the driving method according to Example 2, the second threshold voltage canceling process is performed just before performing the writing process. Accordingly, for example, even when the potential of the second node $ND_2$ varies in period $TP(2)_{3A}$, the potential of the second node $ND_2$ is set to approach $V_{Ofs}-V_{th}=-3$ V just before performing the writing process. Therefore, even when the potential of the second node $ND_2$ varies in period $TP(2)_{3A}$, it does not have an influence on the luminance of an image to be displayed.

Example 3

Example 3 relates to a method of driving an organic EL display apparatus according to the first embodiment of the invention. Example 3 is a modified example of Example 1.

In the driving method according to Example 3, the steps of (a) to (f) described in Example 1 are performed. However, the driving method according to Example 3 is different from the driving method according to Example 1, in that the signal output circuit 102 applies a first initialization voltage as the first node initialization voltage to the data line DTL and then applies a second initialization voltage lower than the first initialization voltage as the first node initialization voltage to the data line DTL instead of the first initialization voltage.

In the following description, the following values of voltages are used for explanation, but the invention is not limited to these voltage values.

$V_{Ofs1}$: first initialization voltage, 0 V $V_{Ofs2}$: second initialization voltage, −2 V The driving method according to Example 3 will be described now. The timing diagram of the driving operation of the light-emitting portion ELP according to Example 3 is schematically shown in FIG. 12, and the ON and OFF states of the transistors are shown in FIGS. 13A to 13F.

Figure 12:
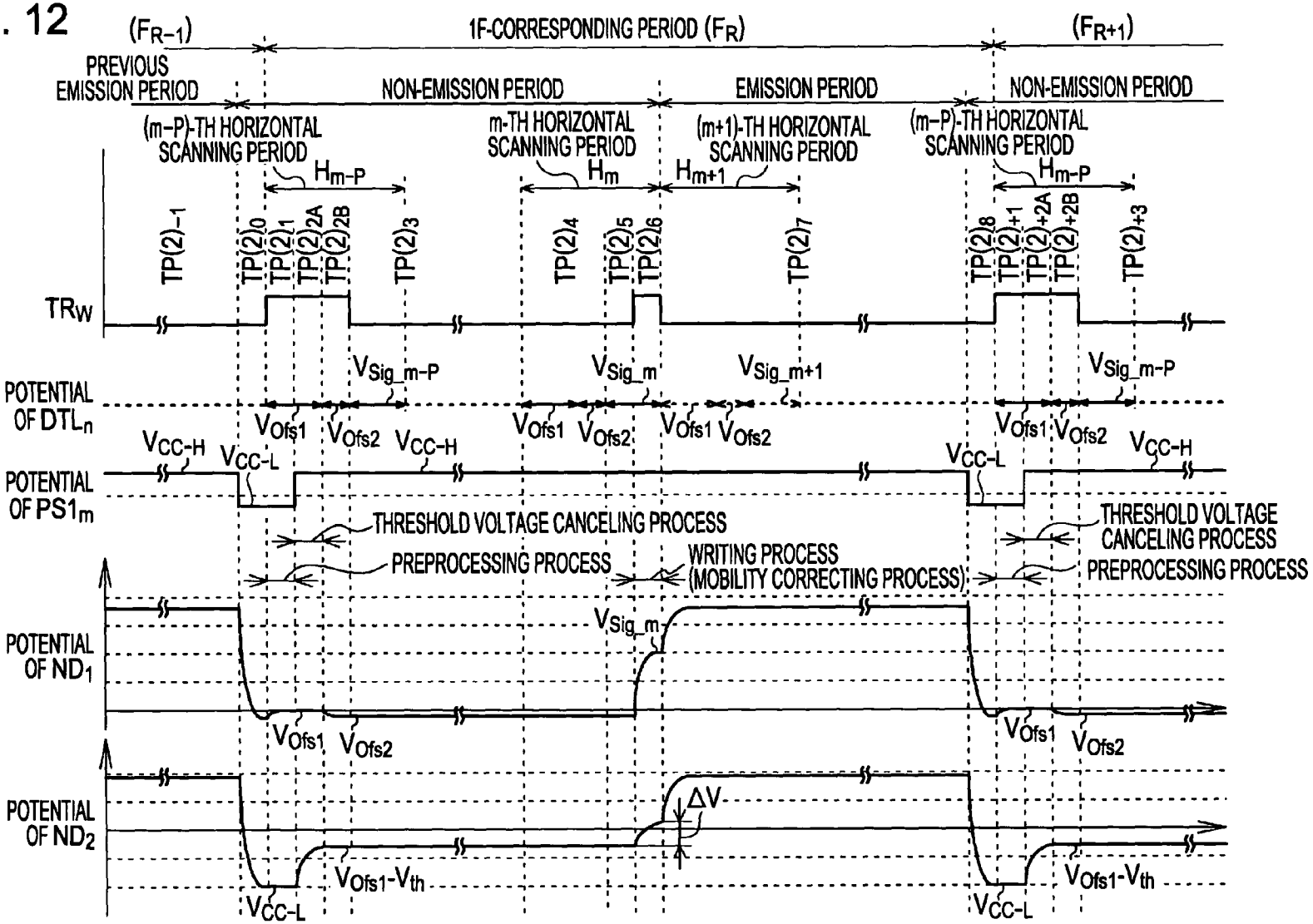
FIG. 12 is a timing diagram schematically illustrating the driving operation of an organic EL light-emitting portion according to Example 3 of the invention.

For the purpose of simplifying the explanation, the start of period $TP(2)_1$ shown in FIG. 12 corresponds to the start of the initialization period (the period where the potential of the data line DTL is $V_{Ofs1}$ or $V_{Pfs2}$ in FIG. 12) of the (m-P)-th horizontal scanning period $H_{m-P}$. Similarly, the end of period $TP(2)_{2B}$ corresponds to the end of the initialization period of the horizontal scanning period $H_{m-P}$. The start of period $TP(2)_3$ corresponds to the start of the image signal period (the period where the potential of the data line DTL is $V_{Sig_m-P}$ in FIG. 12) of the horizontal scanning period $H_{m-P}$.

In the initialization period of the horizontal scanning period $H_{m-P}$, the period where the signal output circuit 102 applies the first initialization voltage $V_{Ofs1}$ as the first node initialization voltage to the data line DTL corresponds to the period from the start of period $TP(2)_1$ to the end of period $TP(2)_{2A}$. Similarly, the period where the signal output circuit 102 applies the second initialization voltage $V_{Ofs2}$ as the first node initialization voltage to the data line DTL corresponds to period $TP(2)_{2B}$.

Period $TP(2)_{-1}$ (see FIG. 12)

The operation in this period is the same as the operation in period $TP(2)_{-1}$ described with reference to FIGS. 7 and 8A in Example 1 and thus the description thereof is omitted.

Period $TP(2)_0$ (see FIGS. 12 and 13A)

The operation in this period is the same as the operation in period $TP(2)_0$ described with respect to FIGS. 7 and 8B in Example 1. Period $TP(2)_0$ is a period just before the start of the (m-P)-th horizontal scanning period $H_{m-P}$. In period $TP(2)_0$, the (n, m)-th organic EL display element 10 is in the non-emission state. The voltage supplied from the power source unit 100 is switched from the driving voltage $V_{CC-H}$ to the second node initialization voltage $V_{CC-L}$. As a result, the potential of the second node $ND_2$ decreases to $V_{CC-L}$ and the reverse voltage is applied between the anode and the cathode of the light-emitting portion ELP, whereby the light-emitting portion ELP is changed to the non-emission state. With the decrease in potential of the second node $ND_2$, the potential of the first node $ND_1$ (the gate electrode of the driving transistor $TR_D$) in the floating state also decreases.

Period $TP(2)_1$ (see FIGS. 12 and 13B)

The (m-P)-th horizontal scanning period $H_{m-P}$ of the present display frame is started. In period $TP(2)_1$, the step of (a), that is, the preprocessing process, is performed. The operation in this period is substantially the same as the operation in period $TP(2)_1$ described with reference to FIGS. 7 and 8C in Example 1.

That is, at the start time of period $TP(2)_1$, the writing transistor $TR_W$ is turned on by the signal from the scanning line SCL and the first initialization voltage $V_{Ofs1}$ as the first node initialization voltage is applied to the first node $ND_1$ from the data line DTL via the turned-on writing transistor $TR_W$, whereby the potential of the first node $ND_1$ is initialized. The second node initialization voltage $V_{CC-L}$ is applied to one of the source and drain regions of the driving transistor $TR_D$ from the power source unit 100, whereby the potential of the second node $ND_2$ is initialized. Accordingly, the preprocessing process of initializing the potential of the first node $ND_1$ and the potential of the second node $ND_2$ is finished.

At the end time of period $TP(2)_1$, the step of (b) is performed. Specifically, the voltage of the power source unit 100 is switched from the second node initialization voltage $V_{CC-L}$ to the driving voltage $V_{CC-H}$ and the state where the driving voltage $V_{CC-H}$ is applied to one of the source and drain regions of the driving transistor $TR_D$ from the power source unit 100 is maintained.

Period $TP(2)_{2A}$ (see FIG. 12 and FIGS. 13C and 13D)

In period $TP(2)_{2A}$, the step of (c), that is, the threshold voltage canceling process, is performed. The operation in this period is substantially the same as the operation in period $TP(2)_2$ described with reference to FIG. 7 and FIGS. 8D and 8E in Example 1.

In Example 3, the ON state of the writing transistor $TR_W$ is maintained in period $TP(2)_{2A}$ and period $TP(2)_{2B}$ to be described later.

In period $TP(2)_{2A}$, the potential of the first node $ND_1$ does not vary ($V_{Ofs1}$=0 V is maintained), but the potential of the second node $ND_2$ varies to the potential obtained by subtracting the threshold voltage $V_{th}$ of the driving transistor $TR_D$ from the potential of the first node $ND_1$. That is, the potential of the second node $ND_2$ in the floating state approaches $V_{Ofs1}-V_{th}$=−3 V and finally becomes $V_{Ofs1}-V_{th}$. In this way, the threshold voltage canceling process of turning off the driving transistor $TR_D$ by making the potential of the second node $ND_2$ up to the potential obtained by subtracting the threshold voltage $V_{th}$ of the driving transistor $TR_D$ from the first initialization voltage $V_{Ofs1}$ as the first node initialization voltage is performed.

Period $TP(2)_{2B}$ (see FIGS. 12 and 13E)

At the start time of this period, the signal output circuit 102 applies the second initialization voltage $V_{Ofs2}$ lower than the first initialization voltage $V_{Ofs1}$ to the data line DTL as the first node initialization voltage instead of the first node initialization voltage $V_{Ofs1}$. The potential of the first node $ND_1$ varies from $V_{Ofs1}$=0 V to $V_{Ofs2}$=−2 V. As described above, since the variation in potential of the second node $ND_2$ resulting from the variation in potential of the first node $ND_1$ is small, the potential of the second node $ND_2$ is maintained in $V_{Ofs1}-V_{th}$. The potential difference $V_{gs}$ between the gate electrode of the driving transistor $TR_D$ and the other of the source and drain regions serving as a source region is expressed by Expression 6.

$$V_{gs}=V_{Ofs2}-(V_{Ofs1}-V_{th}) \quad \text{Expression 6}$$

In periods $TP(2)_3$ to $TP(2)_5$, the OFF state of the driving transistor $TR_D$ is maintained (the step of (d)). The respective periods will be described now.

Period $TP(2)_3$ (see FIGS. 12 and 13F)

The operation in this period is basically the same as the operation in period $TP(2)_3$ described with reference to FIGS. 7 and 8F in Example 1. In period $TP(2)_3$, the writing transistor $TR_W$ is switched to the OFF state. The driving transistor $TR_D$ is maintained in the OFF state and the potential of the first node $ND_1$ and the potential of the second node $ND_2$ do not vary.

Period $TP(2)_4$ (see FIG. 12)

In period $TP(2)_4$, the m-th horizontal scanning period is started. The operation in this period is basically the same as the operation in period $TP(2)_4$ described with reference to FIGS. 7 and 9A in Example 1. The first initialization voltage $V_{Ofs1}$ is applied as the first node initialization voltage to the data line DTL and then the second initialization voltage $V_{Ofs2}$ is applied instead of the first node initialization voltage $V_{Ofs1}$. The driving transistor $TR_D$ is maintained in the OFF state and the potential of the first node $ND_1$ and the potential of the second node $ND_2$ do not vary.

Period $TP(2)_5$ (see FIG. 12)

The operation in this period is basically the same as the operation in period $TP(2)_5$ described with reference to FIGS. 7 and 9B in Example 1. At the start time of period $TP(2)_5$, the voltage applied to the data line DTL is switched from the second initialization voltage $V_{Ofs2}$ to the image signal $V_{Sig_m}$. The driving transistor $TR_D$ is maintained in the OFF state and the potential of the first node $ND_1$ and the potential of the second node $ND_2$ do not vary.

As described in Example 1, in periods $TP(2)_3$ to $TP(2)_5$, the (n, m)-th organic EL display element 10 is maintained in the non-emission state. In the periods, the reverse voltage with a value of $|(V_{Ofs1}-V_{th})-V_{Cat}|$ is applied to the light-emitting portion ELP. That is, in the above-mentioned example, the reverse voltage of 3 V is continuously applied to the light-emitting portion ELP.

Period $TP(2)_6$ (see FIG. 12)

In this period, the step of (e), that is, the writing process, is performed. The operation in this period is the same as the operation in period $TP(2)_6$ described with reference to FIGS. 7 and 9C in Example 1. That is, the writing transistor $TR_W$ is turned on by the signal from the scanning line SCL. Then, the image signal $V_{Sig_m}$ is applied to the first node $ND_1$ from the data line DTL via the writing transistor $TR_W$. As a result, the potential of the first node $ND_1$ increases to $V_{Sig_m}$. The driving transistor $TR_D$ is in the ON state. In some cases, the writing transistor $TR_W$ may be turned on in periods $TP(2)_4$ and $TP(2)_5$. In this configuration, when the voltage of the data line DTL is switched from the second initialization voltage $V_{Ofs2}$ to the image signal $V_{Sig_m}$ in period $TP(2)_5$, the writing process is started at once.

As described in Example 1, in the driving method according to Example 3, the mobility correcting process of increasing the potential of the other of the source and drain regions of the driving transistor $TR_D$ (that is, the potential of the second node $ND_2$) depending on the characteristic of the driving transistor $TR_D$ is performed together. The potential correcting value $\Delta V$ of the second node $ND_2$ shown in FIG. 12 is the same as described with reference to FIG. 4 and thus the description thereof is omitted.

Period $TP(2)_7$ (see FIG. 12)

By the above-mentioned operations, the threshold voltage canceling process, the writing process, and the mobility correcting process are finished. Thereafter, in period $TP(2)_7$, the step of (f) is performed. The operation of this period is basically the same as the operation in period $TP(2)_7$ described with reference to FIGS. 7 and 9D in Example 1. That is, in the state where the driving voltage $V_{CC-H}$ is applied to one of the source and drain regions of the driving transistor $TR_D$ from the power source unit 100, the scanning line SCL is set to the low level by the operation of the scanning circuit 101, the writing transistor $TR_W$ is turned off, and the first node $ND_1$, that is, the gate electrode of the driving transistor $TR_D$, is set to the floating state. As a result, the potential of the second node $ND_2$ increases.

As described above, since the gate electrode of the driving transistor $TR_D$ is in the floating state and the capacitor $C_1$ exists, the same phenomenon as in a so-called bootstrap circuit occurs in the gate electrode of the driving transistor $TR_D$ and thus the potential of the first node $ND_1$ also increases. As a result, the potential difference $V_{gs}$ between the gate electrode of the driving transistor $TR_D$ and the other of the source and drain regions serving as a source region is maintained in the value of Expression 4'.

$$V_{gs} \cong V_{Sig_m} - (V_{Ofs1} - V_{th}) - \Delta V \quad \text{Expression 4'}$$

Since the potential of the second node $ND_2$ increases and becomes greater than $V_{th\text{-}EL}+V_{Cat}$, the light-emitting portion ELP starts emitting light. At this time, the current flowing in the light-emitting portion ELP is the drain current $I_{ds}$ flowing from the drain region to the source region of the driving transistor $TR_D$, the current can be expressed by Expression 5'.

$$I_{ds} = k \cdot \mu \cdot (V_{Sig_m} - V_{Ofs1} - \Delta V)^2 \quad \text{Expression 5'}$$

The emission state of the light-emitting portion ELP is maintained up to the end of period $TP(\mathbf{2})_7$. Specifically, the state where the driving voltage $V_{CC\text{-}H}$ is applied to one of the source and drain regions of the driving transistor $TR_D$ from the power source unit 100 is maintained to the end of period $TP(\mathbf{2})_7$.

At the start time of period $TP(\mathbf{2})_8$, the voltage supplied from the power source unit 100 is switched from the driving voltage $V_{CC\text{-}H}$ to the second node initialization voltage $V_{CC\text{-}L}$. Period $TP(\mathbf{2})_8$ is a period just before the start of the (m-P)-th horizontal scanning period $H_{m\text{-}P}$. Period $TP(\mathbf{2})_8$ corresponds to, for example, period $TP(\mathbf{2})_0$ of the next frame. After period $TP(\mathbf{2})_{+1}$, the same processes as described for periods $TP(\mathbf{2})_1$ to $TP(\mathbf{2})_8$ are repeatedly performed (see FIG. 12).

As described in Example 1, in the driving method according to Example 3 described with reference to FIG. 12, the non-emission period includes periods $TP(\mathbf{2})_0$ to $TP(\mathbf{2})_6$, and the emission period includes period $TP(\mathbf{2})_7$. In periods $TP(\mathbf{2})_3$ to $TP(\mathbf{2})_5$ constituting most of the non-emission period, the reverse voltage with a value of $|(V_{Ofs}-V_{th})-V_{Cat}|$ is applied to the light-emitting portion ELP. That is, in the above-mentioned example, the reverse voltage of 3 V is continuously applied to the light-emitting portion ELP. In the driving method according to Example 3, the reverse voltage with a value of $|V_{CC\text{-}L}-V_{Cat}|$ is applied only in periods $TP(\mathbf{2})_0$ and $TP(\mathbf{2})_1$.

Therefore, as described in Example 1, it is possible to reduce the ratio of the period where the reverse voltage with a great absolute value is applied to the light-emitting portion ELP to the non-emission period and to reduce the absolute value of the reverse voltage applied to the light-emitting portion ELP in most of the non-emission period. Accordingly, it is possible to suppress the deterioration of the light-emitting portion ELP.

Specific advantages of the driving method according to Example 3 will be described now. In the driving method according to Example 1, the potential of the gate electrode of the driving transistor $TR_D$ is $V_{Ofs}=0$ V in period $TP(\mathbf{2})_3$ shown in FIG. 7. On the contrary, in the driving method according to Example 3, the potential of the gate electrode of the driving transistor $TR_D$ is $V_{Ofs2}=-2$ V in period $TP(\mathbf{2})_3$ shown in FIG. 12. Therefore, the off resistance value of the driving transistor $TR_D$ can be higher in period $TP(\mathbf{2})_3$ than that in Example 1. Accordingly, there is an advantage that the variation in potential of the first node $ND_1$ and the second node $ND_2$ in period $TP(\mathbf{2})_3$ resulting from the leakage of the driving transistor $TR_D$ or the like can be reduced.

Example 4

Example 4 relates to a method of driving an organic EL display apparatus according to the first embodiment of the invention. Example 4 is a modified example of Example 1.

In the driving method according to Example 4, the steps of (a) to (f) described in Example 1 are performed. However, the driving method according to Example 4 is different from the driving method according to Example 1, in that the step of (a) is performed in the initialization period of a horizontal scanning period previous to the horizontal scanning period $H_{m\text{-}P}$.

In general, when the number of pixels of an organic EL display apparatus increases, the length of the horizontal scanning period allocated to each row decreases. Accordingly, in some specifications of the organic EL display apparatus, the step of (c), that is, the threshold voltage canceling process, may not be finished only in the initialization period of one horizontal scanning period. In this case, the threshold voltage canceling process can be finished by performing the step of (a) in the initialization period of the horizontal scanning period previous to the horizontal scanning period $H_{m\text{-}P}$ and successively performing a predetermined operation over plural horizontal scanning periods.

In the following description, it is assumed that the step of (a) is performed in the horizontal scanning period previous to the horizontal scanning period $H_{m\text{-}P}$ by one horizontal scanning period. Specifically, the step of (a) is performed in the initialization period of the (m-P−1)-th horizontal scanning period $H_{m\text{-}P-1}$.

The driving method according to Example 4 will be described now. The timing diagram of the driving operation of the light-emitting portion ELP according to Example 4 is schematically shown in FIG. 14, and the ON and OFF states of the transistors are shown in FIGS. 15A to 15E.

Figure 14:
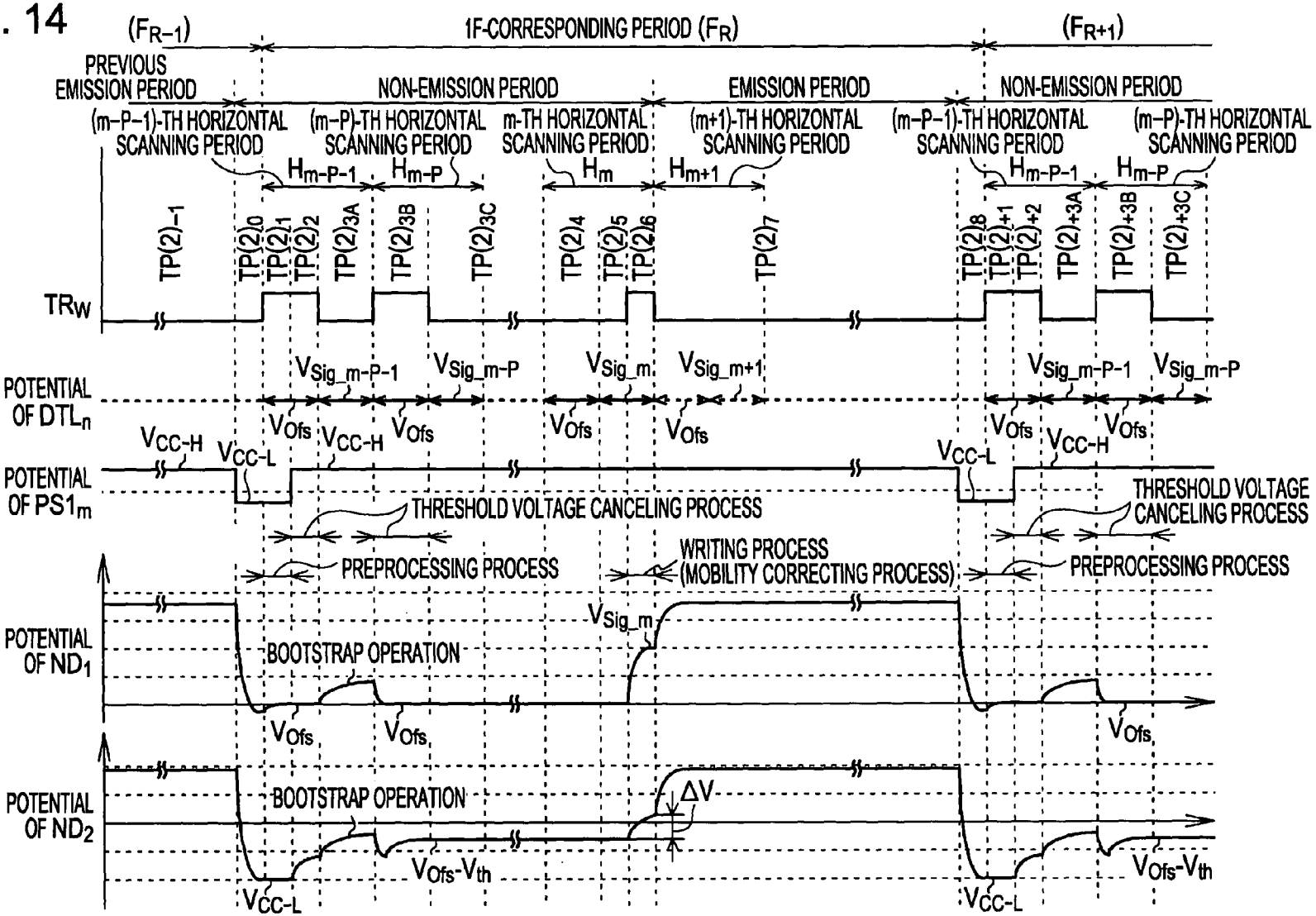
FIG. 14 is a timing diagram schematically illustrating the driving operation of an organic EL light-emitting portion according to Example 4 of the invention.

Period $TP(\mathbf{2})_{-1}$ (see FIG. 14)

The operation in this period is the same as the operation in period $TP(\mathbf{2})_{-1}$ described with reference to FIGS. 7 and 8A in Example 1, except that the end thereof is preceded by one horizontal scanning period, and thus the description thereof is omitted.

Period $TP(\mathbf{2})_0$ (see FIG. 14)

The operation in this period is the same as the operation in period $TP(\mathbf{2})_0$ described with reference to FIGS. 7 and 8B in Example 1, except that this period is a period just before the start of the (m-P−1)-th horizontal scanning period $H_{m\text{-}P-1}$, and thus the description thereof is omitted.

Period $TP(\mathbf{2})_1$ (see FIG. 14)

The (m-P−1)-th horizontal scanning period $H_{m\text{-}P-1}$ of the present display frame is started. In period $TP(\mathbf{2})_1$, the step of (a), that is, the preprocessing process, is performed. The operation in this period is the same as the operation in period $TP(\mathbf{2})_1$ described with reference to FIGS. 7 and 8C in Example 1, except that the operation is an operation in the initialization of the (m-P−1)-th horizontal scanning period.

That is, at the start time of period $TP(\mathbf{2})_1$, the writing transistor $TR_W$ is turned on by the signal from the scanning line SCL and the first node initialization voltage $V_{Ofs}$ is applied to the first node $ND_1$ from the data line DTL via the turned-on writing transistor $TR_W$, whereby the potential of the first node $ND_1$ is initialized. The second node initialization voltage $V_{CC\text{-}L}$ is applied to one of the source and drain regions of the driving transistor $TR_D$ from the power source unit 100, whereby the potential of the second node $ND_2$ is initialized. Accordingly, the preprocessing process of initializing the potential of the first node $ND_1$ and the potential of the second node $ND_2$ is finished.

The threshold voltage canceling process is performed in periods $TP(\mathbf{2})_2$ to $TP(\mathbf{2})_{3B}$ to be described later.

Specifically, the ON state and the OFF state of the writing transistor $TR_W$ are controlled on the basis of the operation of the scanning circuit 101 until the end of the horizontal scanning period $H_{m\text{-}P}$, so that the writing transistor $TR_W$ is turned on in the initialization period and the writing transistor $TR_W$ is turned off in the image signal period. In Example 4, the writing transistor $TR_W$ is maintained in the ON state in period $TP(2)_2$. Then, the writing transistor $TR_W$ is switched to the OFF state in period $TP(2)_{3A}$. Thereafter, the writing transistor $TR_W$ is switched to and maintained in the ON state in period $TP(2)_{3B}$. Then, the writing transistor $TR_W$ is switched to the OFF state in period $TP(2)_{3C}$. The operations of the above-mentioned periods will be described.

Period $TP(2)_2$ (see FIGS. 14 and 15A)

When the period $TP(2)_2$ is sufficiently long, the potential difference between the gate electrode of the driving transistor $TR_D$ and the other of the source and drain regions reaches $V_{th}$ and thus the driving transistor $TR_D$ is turned off. That is, the potential of the second node $ND_2$ in the floating state approaches $V_{Ofs}-V_{th}=-3$ V and finally becomes $V_{Ofs}-V_{th}$. However, the length of period $TP(2)_2$ in Example 4 is not sufficient to change the potential of the second node $ND_2$ and the potential of the second node $ND_2$ reaches a certain potential $V_A$ satisfying the relation of $V_{CC-L}<V_A<(V_{Ofs}-V_{th})$ at the end of period $TP(2)_2$.

Period $TP(2)_{3A}$ (see FIGS. 14 and 15B)

At the start time of period $TP(2)_{3A}$, the voltage of the data line DTL is switched from the first node initialization voltage $V_{Ofs}$ to the image signal $V_{Sig_m-P-1}$. To avoid the image signal $V_{Sig_m-P-1}$ from being applied to the first node $ND_1$, the writing transistor $TR_W$ is turned off by the signal from the scanning line SCL at the start time of period $TP(2)_{3A}$. As a result, the gate electrode (that is, the first node $ND_1$) of the driving transistor $TR_D$ is changed to the floating state.

Since the driving voltage $V_{CC-H}$ is applied to one of the source and drain regions of the driving transistor $TR_D$ from the power source unit 100, the potential of the second node $ND_2$ rises from the potential $V_A$ to a certain potential $V_B$. On the other hand, since the gate electrode of the driving transistor $TR_D$ is in the floating state and the capacitor $C_1$ exists, a bootstrap operation is generated in the gate electrode of the driving transistor $TR_D$. Therefore, the potential of the first node $ND_1$ rises with the variation in potential of the second node $ND_2$.

Period $TP(2)_{3B}$ (see FIG. 14 and FIGS. 15C and 15D)

At the start time of period $TP(2)_{3B}$, the voltage of the data line DTL is switched from the image signal $V_{Sig_m-P-1}$ to the first node initialization voltage $V_{Ofs}$. At the start time of period $TP(2)_{3B}$, the writing transistor $TR_W$ is turned on by the signal from the scanning line SCL. As a result, the potential of the gate electrode (that is, the first node $ND_1$) of the driving transistor $TR_D$ decreases to $V_{Ofs}$, the potential of the second node $ND_2$ decreases to the above-mentioned potential $V_A$, and the potential of the second node $ND_2$ then varies to the potential obtained by subtracting the threshold voltage $V_{th}$ of the driving transistor $TR_D$ from the potential of the first node $ND_1$. That is, the potential of the second node $ND_2$ in the floating state increases and finally becomes $V_{Ofs}-V_{th}$. In this way, the threshold voltage canceling process of turning off the driving transistor $TR_D$ by making the potential of the second node $ND_2$ to vary up to the potential obtained by subtracting the threshold voltage $V_{th}$ of the driving transistor $TR_D$ from the first node initialization voltage $V_{Ofs}$ is finished.

In periods $TP(2)_{3C}$ to $TP(2)_5$, the driving transistor $TR_D$ is maintained in the OFF state (the step of (d)). The respective periods will be described now.

Period $TP(2)_{3C}$ (see FIGS. 14 and 15E)

The operation in this period is the same as the operation in period $TP(2)_3$ described with reference to FIGS. 7 and 8F in Example 1. In period $TP(2)_{3C}$, the writing transistor $TR_W$ is switched to the OFF state. The driving transistor $TR_D$ is maintained in the OFF state and the potential of the first node $ND_1$ and the potential of the second node $ND_2$ do not vary.

Period $TP(2)_4$ (see FIG. 14)

In period $TP(2)_4$, the m-th horizontal scanning period is started. The operation in this period is the same as the operation in period $TP(2)_4$ described with reference to FIGS. 7 and 9A in Example 1. The first node initialization voltage $V_{Ofs}$ is applied to the data line DTL. The driving transistor $TR_D$ is maintained in the OFF state and the potential of the first node $ND_1$ and the potential of the second node $ND_2$ do not vary.

Period $TP(2)_5$ (see FIG. 14)

The operation in this period is the same as the operation in period $TP(2)_5$ described with reference to FIGS. 7 and 9B in Example 1. At the start time of period $TP(2)_5$, the voltage applied to the data line DTL is switched from the first node initialization voltage $V_{Ofs}$ to the image signal $V_{Sig_m}$. The driving transistor $TR_D$ is maintained in the OFF state and the potential of the first node $ND_1$ and the potential of the second node $ND_2$ do not vary.

The operations after period $TP(2)_6$ are the same as described in Example 1, except that the end of period $TP(2)_7$ is preceded by one horizontal scanning period, and thus the description thereof is omitted. The advantages of the driving method according to Example 4 are the same as described in Example 1 and thus the description thereof is omitted.

Example 5

Example 5 relates to a method of driving an organic EL display apparatus according to the second embodiment of the invention. In Example 5, the driving circuit 11 includes three transistors and one capacitor (3Tr/1C driving circuit). The conceptual diagram of the organic EL display apparatus according to Example 5 is shown in FIG. 16 and the equivalent circuit diagram of the organic EL display element 10 including the driving circuit 11 is shown in FIG. 17.

Details of the driving circuit and the light-emitting portion will be described now.

The 3Tr/1C driving circuit includes two transistors of a writing transistor $TR_W$ and a driving transistor $TR_D$ and one capacitor $C_1$, similarly to the above-mentioned 2Tr/1C driving circuit. The 3Tr/1C driving circuit further includes a first transistor $TR_1$.

Driving Transistor $TR_D$

The configuration of the driving transistor $TR_D$ is the same as the configuration of the driving transistor $TR_D$ described in Example 1 and thus the detailed description thereof is omitted. In Example 1, the potential of the second node $ND_2$ is initialized by applying the voltage $V_{CC-L}$ to one of the source and drain regions of the driving transistor $TR_D$ from the power source unit 100. On the other hand, in Example 5, the potential of the second node $ND_2$ is initialized using the first transistor $TR_1$, as described later. Therefore, in Example 5, it is not necessary to apply the voltage $V_{CC-L}$ from the power source unit 100 to initialize the potential of the second node $ND_2$. For this reason, the power source unit 100 in Example 5 applies a constant voltage $V_{CC}$.

Writing Transistor $TR_W$

The configuration of the writing transistor $TR_W$ is the same as the configuration of the writing transistor $TR_W$ described in Example 1 and thus the description thereof is omitted. Similarly to Example 1, the image signal (driving signal, luminance signal) $V_{Sig}$ for controlling the luminance of the light-emitting portion ELP and the first node initialization voltage $V_{OfS}$ are supplied to one of the source and drain regions from the signal output circuit 102 via the data line DTL.

First Transistor $TR_1$

In the first transistor $TR_1$, (C-1) the other of source and drain regions is connected to the second node $ND_2$, (C-2) one of the source and drain regions is supplied with the second node initialization voltage $V_{SS}$, and (C-3) the gate electrode is connected to a first transistor control line AZ1. The voltage $V_{SS}$ will be described later.

The conductive type of the first transistor $TR_1$ is not particularly limited. In Example 5, the first transistor $TR_1$ is formed of, for example, an n-channel transistor. The ON and OFF states of the first transistor $TR_1$ are controlled by the signal from a first transistor control line AZ1. More specifically, the first transistor control line AZ1 is connected to a first transistor control circuit 103. On the basis of the operation of the first transistor control circuit 103, the first transistor control line AZ1 is set to a low level or a high level to switch the first transistor $TR_1$ to the ON state or the OFF state.

Light-Emitting Portion ELP

The configuration of the light-emitting portion ELP is the same as the configuration of the light-emitting portion ELP described in Example 1 and thus the detailed description thereof is omitted.

The method of driving an organic EL display apparatus according to Example 5 will be described now.

In the following description, the value of the voltage $V_{CC}$ and the value of the voltage $V_{SS}$ are defined as follows, but the values are only explanatory examples and the invention is not limited to these values.

Figure 18:
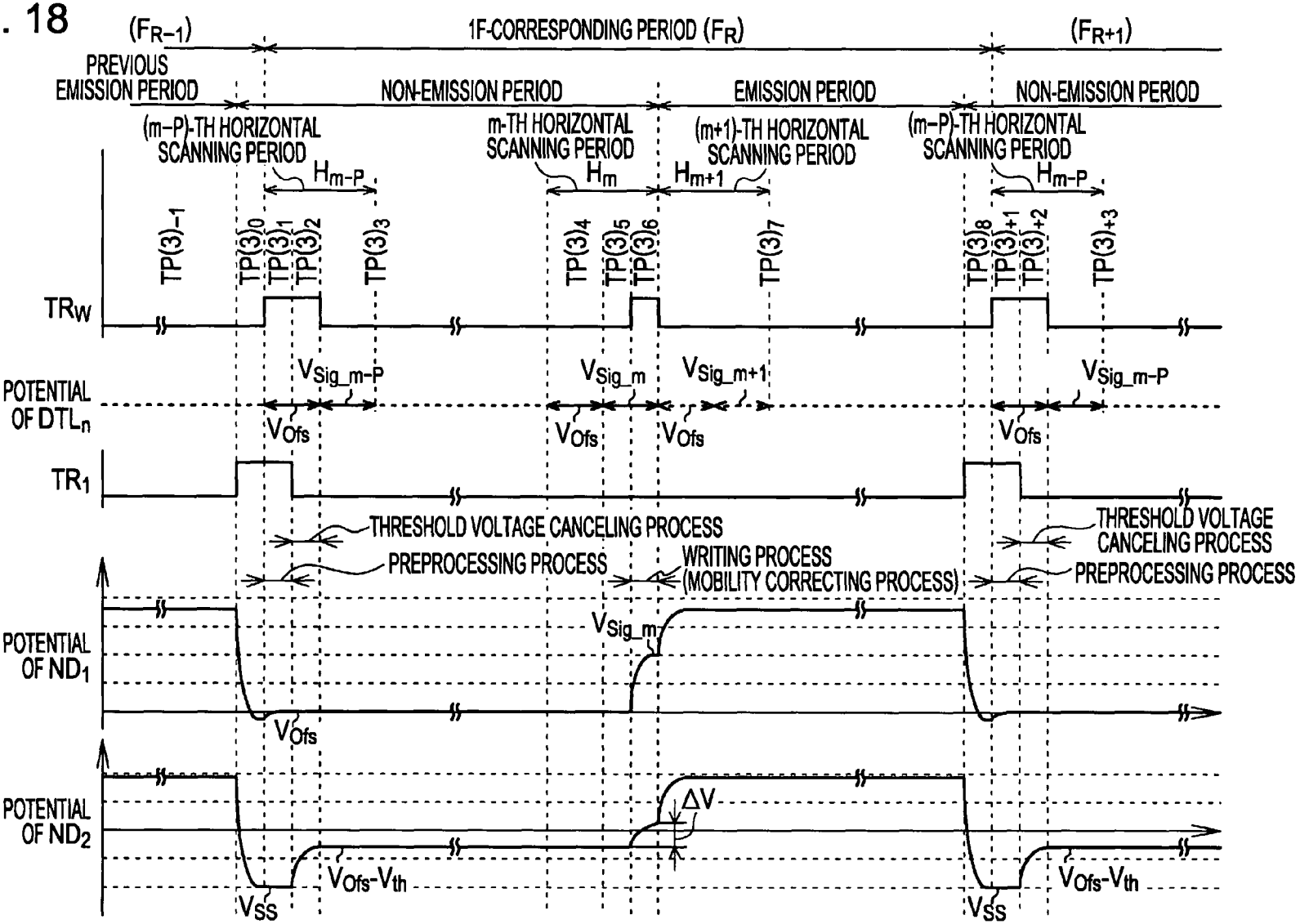
FIG. 18 is a timing diagram schematically illustrating the driving operation of an organic EL light-emitting portion according to Example 5 of the invention.

$V_{CC}$: driving voltage for allowing current to flow in the light-emitting portion ELP, 20 V $V_{SS}$: second node initialization voltage for initializing the potential of the second node $ND_2$, −10 V The timing diagram of the driving operation of the light-emitting portion ELP according to Example 5 is schematically shown in FIG. 18, and the ON and OFF states of the transistors are shown in FIGS. 19A to 19F and FIGS. 20A to 20F.

The method of driving an organic EL display apparatus according to Example 5 includes the steps of, in the (n, m)-th organic EL display element 10, (a) performing a preprocessing process of initializing the potential of the first node $ND_1$ and the potential of the second node $ND_2$, so that the potential difference between the first node $ND_1$ and the second node $ND_2$ is greater than the threshold voltage $V_{th}$ of the driving transistor $TR_D$ and the potential difference between the second node $ND_2$ and the cathode of the light-emitting portion ELP is not greater than the threshold voltage $V_{th\text{-}EL}$ of the light-emitting portion ELP, in an initialization period located before the end of the horizontal scanning period $H_{m_pre_P}$ by applying a first node initialization voltage $V_{Ofs}$ to the first node $ND_1$ from the corresponding data line DTL via the writing transistor $TR_W$ turned on by the operation of the scanning circuit 101 to initialize the potential of the first node $ND_1$ and applying the second node initialization voltage $V_{SS}$ to the second node $ND_2$ via the first transistor $TR_1$ turned on by a signal from the first transistor control line AZ1 to initialize the potential of the second node $ND_2$, (b) switching the first transistor $TR_1$ from the ON state to the OFF state by the signal from the first transistor control line AZ1, (c) performing a threshold voltage canceling process of changing the potential of the second node $ND_2$ until the potential obtained by subtracting the threshold voltage $V_{th}$ of the driving transistor $TR_D$ from the first node initialization voltage $V_{Ofs}$ to turn off the driving transistor $TR_D$ in the initialization period of the horizontal scanning period $H_{m_pre_P}$, by applying the driving voltage $V_{CC}$ to the one of the source and drain regions of the driving transistor $TR_D$ from the power source unit 100 in a state where the writing transistor $TR_W$ is turned on in the initialization period by the operation of the scanning circuit 101 and the first node initialization voltage $V_{Ofs}$ is applied to the first node $ND_1$ from the data line DTL via the turned-on writing transistor $TR_W$, (d) changing the first node $ND_1$ to a floating state and holding the OFF state of the driving transistor $TR_D$, by turning off the writing transistor $TR_W$ by the operation of the scanning circuit 101, (e) performing a writing process of applying the image signal $V_{Sig}$ to the first node $ND_1$ from the data line DTL in the image signal period of the horizontal scanning period $H_m$ via the writing transistor $TR_W$ turned on by the operation of the scanning circuit 101, and (f) changing the first node $ND_1$ to a floating state and allowing current corresponding to the potential difference between the first node $ND_1$ and the second node $ND_2$ to the light-emitting portion ELP via the driving transistor $TR_D$ from the power source unit 100 by turning off the writing transistor $TR_W$ by the operation of the scanning circuit 101. The same is true in the method of driving an organic EL display apparatus according to Example 6, Example 7, Example 8, Example 9, and Example 10 to be described later.

The method of driving an organic EL display apparatus according to Example 5 is different from the method of driving an organic EL display apparatus according to Example 1, in that the power source unit 100 applies a constant voltage $V_{CC}$ and the potential of the second node $ND_2$ is initialized using the first transistor $TR_1$. Periods $TP(\mathbf{3})_{-1}$ to $TP(\mathbf{3})_{+3}$ shown in FIG. 18 correspond to periods $TP(\mathbf{2})_{-1}$ to $TP(\mathbf{2})_{+3}$ shown in FIG. 7 in Example 1, respectively.

In the organic EL display apparatus according to Example 5, the first node initialization voltage $V_{Ofs}$ is applied to the data line DTL from the signal output circuit 102 and then the image signal $V_{Sig}$ is applied instead of the first node initialization voltage $V_{Ofs}$, in the respective horizontal scanning periods. The details thereof are the same as described in Example 1. The relations between the initialization period and the image signal period of each horizontal scanning period and periods $TP(\mathbf{3})_{-1}$ to $TP(\mathbf{3})_{+3}$ shown in FIG. 18 are the same as described on periods $TP(\mathbf{2})_{-1}$ to $TP(\mathbf{2})_{+3}$ shown in FIG. 7 in Example 1 and thus the description is omitted.

Period $TP(\mathbf{3})_{-1}$ (see FIGS. 18 and 19A)

The operation of period $TP(\mathbf{3})_{-1}$ is the operation in a previous display frame and the period is a period where the (n, m)-th organic EL display element 10 is in the emission state after the previous processes are finished. The operation in this period is substantially the same as the operation in period $TP(\mathbf{2})_{-1}$ described in Example 1, except that the first transistor $TR_1$ is in the OFF state.

Period $TP(\mathbf{3})_0$ (see FIGS. 18 and 19B)

In period $TP(\mathbf{3})_0$, the switching operation from the previous display frame to the present display frame is performed. That is, period $TP(\mathbf{3})_0$ is a period just before the start of the (m-P)-th horizontal scanning period $H_{m\text{-}P}$. In period $TP(\mathbf{3})_0$, the (n, m)-th organic EL display element 10 is changed to the non-emission state. At the start time of period $TP(\mathbf{3})_0$, the first transistor $TR_1$ is turned on by the signal from the first transistor control line AZ1. The second node initialization voltage $V_{SS}$ is applied to the second node $ND_2$ via the turned-on first transistor $TR_1$.

The driving voltage $V_{CC}$ is also applied to the second node $ND_2$ via the driving transistor $TR_D$. Accordingly, the potential of the second node $ND_2$ is determined on the basis of the voltage $V_{SS}$, the voltage $V_{CC}$, the ON resistance value of the first transistor $TR_1$, and the ON resistance value of the driving transistor $TR_D$. Here, when the ON resistance of the first transistor $TR_1$ is sufficiently low, the potential of the second node $ND_2$ decreases to about $V_{SS}$ and the reverse voltage is applied between the anode and the cathode of the light-emitting portion ELP, whereby the light-emitting portion ELP is changed to the non-emission state. With the decrease in potential of the second node $ND_2$, the potential of the first node $ND_1$ (the gate electrode of the driving transistor $TR_D$) in the floating state also decreases. Hereinafter, for the purpose of convenience, it is described that the potential of the second node $ND_2$ is $V_{SS}$ when the first transistor $TR_1$ is in the ON state. In FIG. 18, it is shown that the potential of the second node $ND_2$ is $V_{SS}$ when the first transistor $TR_1$ is in the ON state. The same is true in FIGS. 21, 23, and 25 referred to by other examples to be described later.

Period $TP(3)_1$ (see FIGS. 18 and 19C)

The (m-P)-th horizontal scanning period $H_{m-P}$ of the present display frame is started. In period $TP(3)_1$, the step of (a), that is, the preprocessing process, is performed. At the start time of period $TP(3)_1$, the writing transistor $TR_W$ is turned on by the signal from the scanning line SCL and the first node initialization voltage $V_{Ofs}$ is applied to the first node $ND_1$ from the data line DTL via the turned-on writing transistor $TR_W$, whereby the potential of the first node $ND_1$ is initialized. The second node initialization voltage $V_{SS}$ is applied to the second node $ND_2$ via the first transistor $TR_1$ turned on by the signal from the first transistor control line AZ1, whereby the potential of the second node $ND_2$ is initialized. In this way, the preprocessing process of initializing the potential of the first node $ND_1$ and the potential of the second node $ND_2$ so that the potential difference between the first node $ND_1$ and the second node $ND_2$ is greater than the threshold voltage $V_{th}$ of the driving transistor $TR_D$ and the potential difference between the second node $ND_2$ and the cathode of the light-emitting portion ELP is not greater than the threshold voltage $V_{th-EL}$ of the light-emitting portion ELP.

Period $TP(3)_2$ (see FIG. 18 and FIGS. 19D and 19E))

At the start time of period $TP(3)_2$, the first transistor $TR_1$ is changed from the ON state to the OFF state by the signal from the first transistor control line AZ1 (the step of (b)). The OFF state of the first transistor $TR_1$ is maintained to the end of period $TP(3)_7$ to be described later.

In period $TP(3)_2$, the step of (c), that is, the threshold voltage canceling process, is performed. The writing transistor $TR_W$ is turned on by the operation of the scanning circuit 101 in the initialization period, and the driving voltage $V_{CC}$ is applied to one of the source and drain regions of the driving transistor $TR_D$ from the power source unit 100 in the state where the first node initialization voltage $V_{Ofs}$ is applied to the first node $ND_1$ from the data line DTL via the turned-on writing transistor $TR_W$. In Example 5, the writing transistor $TR_W$ is maintained in the ON state in period $TP(3)_2$. The operation in this period is substantially the same as the operation in period $TP(2)_2$ described in Example 1. The potential of the second node $ND_2$ in the floating state approaches $V_{Ofs}-V_{th}=-3$ V and finally becomes $V_{Ofs}-V_{th}$. In this way, the potential of the second node $ND_2$ is made to vary up to the potential obtained by subtracting the threshold voltage $V_{th}$ of the driving transistor $TR_D$ from the first node initialization voltage $V_{Ofs}$. The driving transistor $TR_D$ is in the OFF state.

In periods $TP(3)_3$ to $TP(3)_5$, the step of (d) is performed. The operations in these periods are substantially the same as the operations in periods $TP(2)_3$ to $TP(2)_5$ described in Example 1 and thus the description is omitted. FIG. 19F and FIGS. 20A and 20B correspond to FIG. 8F and FIGS. 9A and 9B.

In periods $TP(3)_3$ to $TP(3)_5$, the (n, m)-th organic EL display element 10 is maintained in the non-emission state. In these periods, the reverse voltage with a value of $|(V_{Ofs}-V_{th})-V_{Cat}|$ is applied to the light-emitting portion ELP. That is, similarly to Example 1, the reverse voltage of 3 V is continuously applied to the light-emitting portion ELP.

Period $TP(3)_6$ (see FIGS. 18 and 20C)

In this period, the step of (e), that is, the writing process, is performed. The operation in this period is substantially the same as the operation in period $TP(2)_6$ described in Example 1 and thus the description thereof is omitted.

Period $TP(3)_7$ (see FIGS. 18 and 20D)

In this period, the step of (f) is performed. The operation in this period is substantially the same as the operation in period $TP(2)_7$ described in Example 1 and thus the description thereof is omitted.

In the driving method according to Example 5, similarly to the driving method according to Example 1, it is possible to reduce the ratio of the period where the reverse voltage with a great absolute value is applied to the light-emitting portion ELP to the non-emission period and to reduce the absolute value of the reverse voltage applied to the light-emitting portion ELP in most of the non-emission period. Accordingly, it is possible to suppress the deterioration of the light-emitting portion ELP.

Example 6

Example 6 relates to a method of driving an organic EL display apparatus according to the second embodiment of the invention. Example 6 is a modified example of Example 5. The relation of Example 6 to Example 5 corresponds to the relation of Example 2 to Example 1.

The conceptual diagram of the organic EL display apparatus according to Example 6 is the same as shown in FIG. 16 and the equivalent circuit diagram of the organic EL display element 10 including the driving circuit 11 is the same as shown in FIG. 17. The elements of the display apparatus according to Example 6 are the same as described in Example 5 and thus the description thereof is omitted. The same is true in Examples 7 and 8 to be described later.

Figure 21:
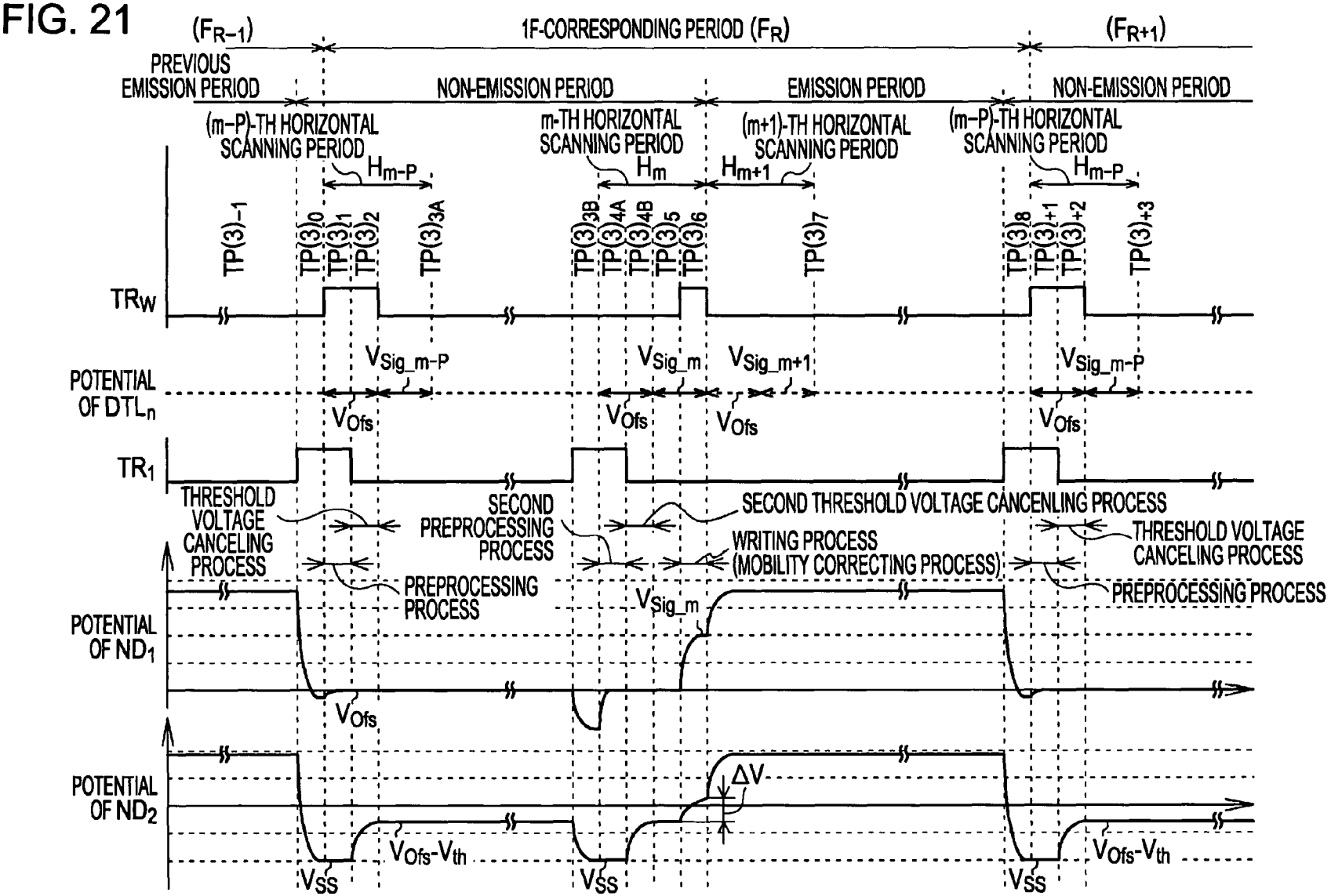
FIG. 21 is a timing diagram schematically illustrating the driving operation of an organic EL light-emitting portion according to Example 6 of the invention.

The timing diagram of the driving operation of the light-emitting portion ELP according to Example 6 is schematically shown in FIG. 21, and the ON and OFF states of the transistors are shown in FIGS. 22A to 22E.

The driving method according to Example 6 is equal to the driving method according to Example 5, except that between the step of (d) and the step of (e) described in Example 5 is performed the steps of (g) performing a second preprocessing process of initializing the potential of the first node $ND_1$ and the potential of the second node $ND_2$, so that the potential difference between the first node $ND_1$ and the second node $ND_2$ is greater than the threshold voltage $V_{th}$ of the driving transistor $TR_D$ and the potential difference between the second node $ND_2$ and the cathode of the light-emitting portion ELP is not greater than the threshold voltage $V_{th-EL}$ of the light-emitting portion ELP, in the initialization period by applying the first node initialization voltage $V_{Ofs}$ to the first node $ND_1$ from the corresponding data line DTL via the writing transistor $TR_W$ turned on by the operation of the scanning circuit 101 to initialize the potential of the first node $ND_1$ and applying the second node initialization voltage $V_{SS}$ to the second node $ND_2$ via the first transistor $TR_1$ turned on by the signal from the first transistor control line AZ1 to initialize the potential of the second node $ND_2$, (h) switching the first transistor $TR_1$ from the ON state to the OFF state by the signal from the first transistor control line AZ1, and (i) performing a second threshold voltage canceling process of changing the potential of the second node $ND_2$ until the potential obtained by subtracting the threshold voltage $V_{th}$ of the driving transistor $TR_D$ from the first node initialization voltage $V_{Ofs}$ to turn off the driving transistor $TR_D$ in the initialization period located before the end of the horizontal scanning period $H_m$, by applying the driving voltage $V_{CC}$ to the one of the source and drain regions of the driving transistor $TR_D$ from the power source unit 100 in a state where the writing transistor $TR_W$ is turned on in the initialization period by the operation of the scanning circuit 101 and the first node initialization voltage $V_{Ofs}$ is applied to the first node $ND_1$ from the data line DTL via the turned-on writing transistor $TR_W$.

The method of driving an organic EL display apparatus according to Example 6 is different from the method of driving an organic EL display apparatus according to Example 2, in that the power source unit 100 applies a constant voltage $V_{CC}$ and the potential of the second node $ND_2$ is initialized using the first transistor $TR_1$ in the step of (g). Periods $TP(3)_{-1}$ to $TP(3)_{+3}$ shown in FIG. 21 correspond to periods $TP(2)_{-1}$ to $TP(2)_{+3}$ shown in FIG. 10 referred to by Example 2, respectively. The relations between the initialization period and the image signal period of each horizontal scanning period and periods $TP(3)_{-1}$ to $TP(3)_{+3}$ shown in FIG. 21 are the same as described in periods $TP(2)_{-1}$ to $TP(2)_{+3}$ shown in FIG. 10 in Example 2 and thus the description thereof is omitted.

Period $TP(3)_{-1}$ (see FIG. 21)

The operation in this period is the same as the operation in period $TP(3)_{-1}$ described with reference to FIGS. 18 and 19A in Example 5 and thus the description thereof is omitted.

Period $TP(3)_0$ (see FIG. 21)

The operation in this period is the same as the operation in period $TP(3)_0$ described with reference to FIGS. 18 and 19B in Example 5 and thus the description thereof is omitted.

Period $TP(3)_1$ (see FIG. 21)

The (m-P)-th horizontal scanning period $H_{m-P}$ of the present display frame is started. In period $TP(3)_1$, the step of (a), that is, the above-mentioned preprocessing process. The operation in this period is the same as the operation in period $TP(3)_1$ described with reference to FIGS. 18 and 19C in Example 5 and thus the description thereof is omitted.

Period $TP(3)_2$ (see FIG. 21)

At the start time of period $TP(3)_2$, the first transistor $TR_1$ is switched from the ON state to the OFF state by the signal from the first transistor control line AZ1 (the step of (b)). The OFF state of the first transistor $TR_1$ is maintained to the end of period $TP(3)_{3A}$ to be described later. In period $TP(3)_2$, the step of (c), that is, the threshold voltage canceling process, is performed. The operation in this period is the same as the operation in period $TP(3)_2$ described with reference to FIGS. 18 and 19E in Example 5 and thus the description thereof is omitted.

Period $TP(3)_{3A}$ (see FIGS. 21 and 22A)

The operation in this period is substantially the same as the operation in period $TP(2)_3$ described with reference to FIGS. 7 and 8F in Example 1. In period $TP(3)_{3A}$, the OFF state of the driving transistor $TR_D$ is maintained (the step of (d)).

Period $TP(3)_{3B}$ (see FIGS. 21 and 22B)

Period $TP(3)_{3B}$ is a period just before the start of the m-th horizontal scanning period $H_m$. At the start time of period $TP(3)_{3B}$, the first transistor $TR_1$ is turned on by the signal from the first transistor control line AZ1. As a result, the potential of the second node $ND_2$ decreases up to $V_{SS}$.

Period $TP(3)_{4A}$ (see FIGS. 21 and 22C)

The m-th horizontal scanning period $H_m$ of the present display frame is started. In period $TP(3)_{4A}$, the step of (g), that is, the second preprocessing process, is performed. At the start time of period $TP(3)_{4A}$, the writing transistor $TR_W$ is turned on by the signal from the scanning line SCL and the first node initialization voltage $V_{Ofs}$ is applied to the first node $ND_1$ from the data line DTL via the turned-on writing transistor $TR_W$, whereby the potential of the first node $ND_1$ is initialized. The ON state of the first transistor $TR_1$ is maintained and the potential of the second node $ND_2$ is maintained in $V_{SS}$.

As a result, the potential of the first node $ND_1$ becomes $V_{Ofs}$ (0 V). The potential of the second node $ND_2$ is maintained in $V_{SS}$ (−10 V).

At the end time of period $TP(3)_{4A}$, the step of (h) is performed. Specifically, the first transistor $TR_1$ is switched from the ON state to the OFF state by the signal from the first transistor control line AZ1. The OFF state of the first transistor $TR_1$ is maintained to the end of period $TP(3)_7$.

Period $TP(3)_{4B}$ (see FIG. 21 and FIGS. 22D and 22E)

In period $TP(3)_{4B}$, the step of (i), that is, the second threshold voltage canceling process, is performed. The operation in this period is the same as the operation in period $TP(2)_{4B}$ described with reference to FIG. 10 and FIGS. 11D and 11E in Example 2 and thus the description thereof is omitted.

Period $TP(3)_5$ (see FIG. 21)

In period $TP(3)_5$, the step of (e) is performed. The operation in this period is the same as the operation in period $TP(2)_5$ described with reference to FIGS. 7 and 9B in Example 1 and thus the description thereof is omitted. The operations of the periods after period $TP(3)_6$ are the same as described in Example 5 and thus the description thereof is omitted.

In the driving method according to Example 6, similarly to Example 2, the second threshold voltage canceling process is performed just before performing the writing process. Accordingly, even when the potential of the second node $ND_2$ varies in period $TP(3)_{3A}$, the potential of the second node $ND_2$ is set again to $V_{Ofs}-V_{th}=-3$ V just before the writing process. Therefore, even when the potential of the second node $ND_2$ varies in period $TP(3)_{3A}$, the luminance of an image to be displayed is not influenced.

Example 7

Example 7 relates to a method of driving an organic EL display apparatus according to the second embodiment of the invention. Example 7 is a modified example of Example 5. The relation of Example 7 to Example 5 corresponds to the relation of Example 3 to Example 1.

In the driving method according to Example 7, the steps of (a) to (f) described in Example 5 are performed. However, the driving method according to Example 7 is different from the driving method according to Example 5, in that the signal output circuit 102 applies a first initialization voltage as the first node initialization voltage to the data line DTL and then applies a second initialization voltage lower than the first initialization voltage as the first node initialization voltage to the data line DTL instead of the first initialization voltage.

Figure 23:
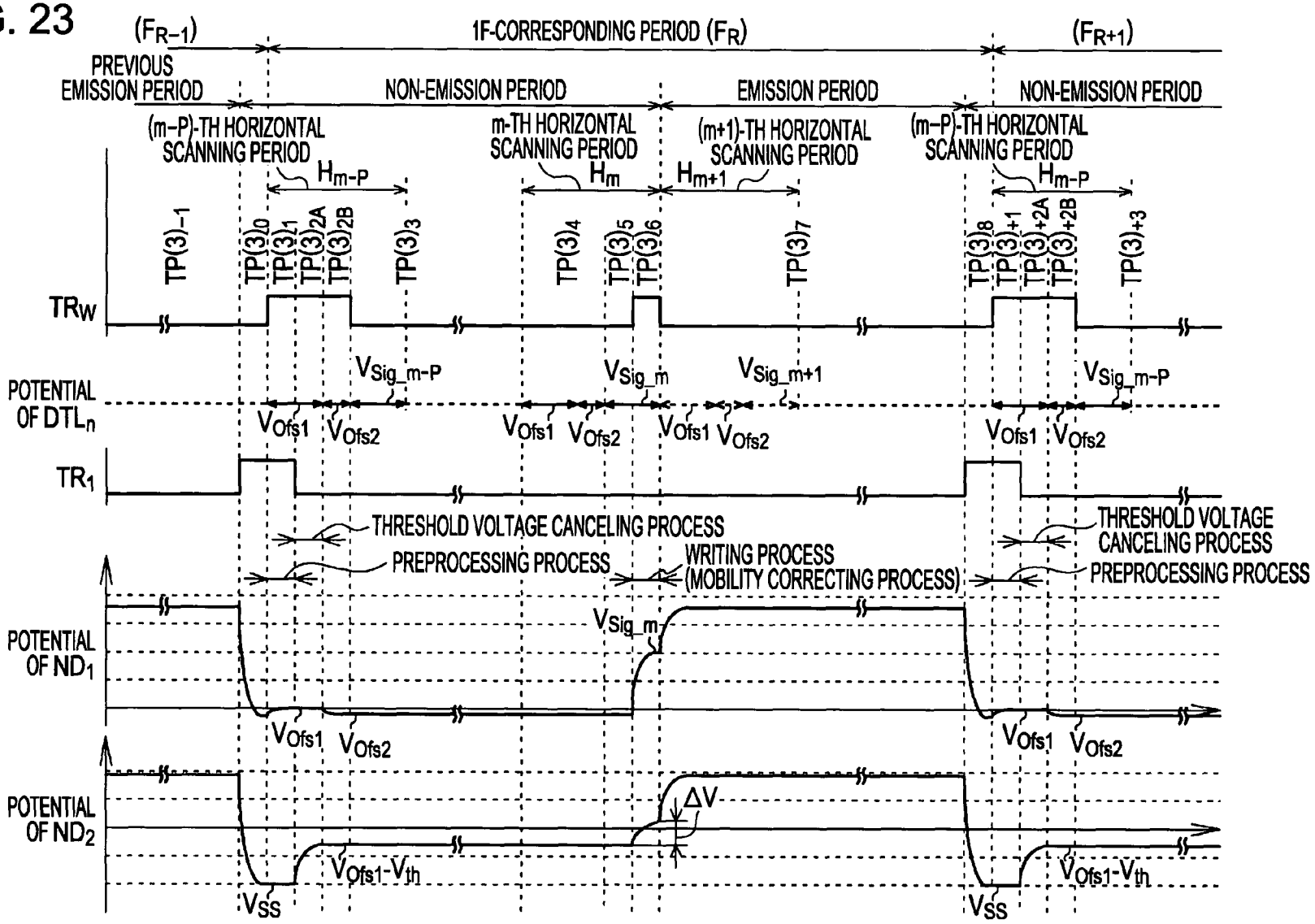
FIG. 23 is a timing diagram schematically illustrating the driving operation of an organic EL light-emitting portion according to Example 7 of the invention.

The timing diagram of the driving operation of the light-emitting portion ELP according to Example 7 is schematically shown in FIG. 23, and the ON and OFF states of the transistors are shown in FIGS. 24A to 24F.

Periods $TP(3)_{-1}$ to $TP(3)_{+3}$ shown in FIG. 23 correspond to periods $TP(2)_{-1}$ to $TP(2)_{+3}$ shown in FIG. 12 referred to by Example 3, respectively. The relations between the initialization period and the image signal period of each horizontal scanning period and periods $TP(3)_{-1}$ to $TP(3)_{+3}$ shown in FIG. 23 are the same as described in periods $TP(2)_{-1}$ to $TP(2)_{+3}$ shown in FIG. 12 in Example 3 and thus the description thereof is omitted.

In the driving method according to Example 7, the operations in periods $TP(3)_0$ and $TP(3)_1$ shown in FIG. 23 are the same as the operation in periods $TP(3)_0$ and $TP(3)_1$ described with reference to FIG. 18 in Example 5 and thus the description thereof is omitted. The operations in periods $TP(3)_{2A}$ to $TP(3)_7$ shown in FIG. 23 are substantially the same as the operation in periods $TP(2)_{2A}$ to $TP(2)_7$ described with reference to FIG. 12 in Example 3 and thus the description thereof is omitted.

The specific advantages of the driving method according to Example 7 are the same as the specific advantages of the driving method according to Example 3. It is possible to make the OFF resistance value of the driving transistor $TR_D$ in period $TP(3)_3$ higher than that in Example 5. Accordingly, it is possible to suppress the variation in potential of the second node $ND_2$ and the first node $ND_1$ in period $TP(3)_3$ resulting from the leakage of the driving transistor $TR_D$.

Example 8

Example 8 relates to a method of driving an organic EL display apparatus according to the second embodiment of the invention. Example 8 is a modified example of Example 5. The relation of Example 8 to Example 5 corresponds to the relation of Example 4 to Example 1.

In the driving method according to Example 8, the steps of (a) to (f) described in Example 5 are performed. However, the driving method according to Example 8 is different from the driving method according to Example 5, in that the step of (a) is performed in the initialization period of a horizontal scanning period previous to the horizontal scanning period $H_{m-P}$.

Figure 25:
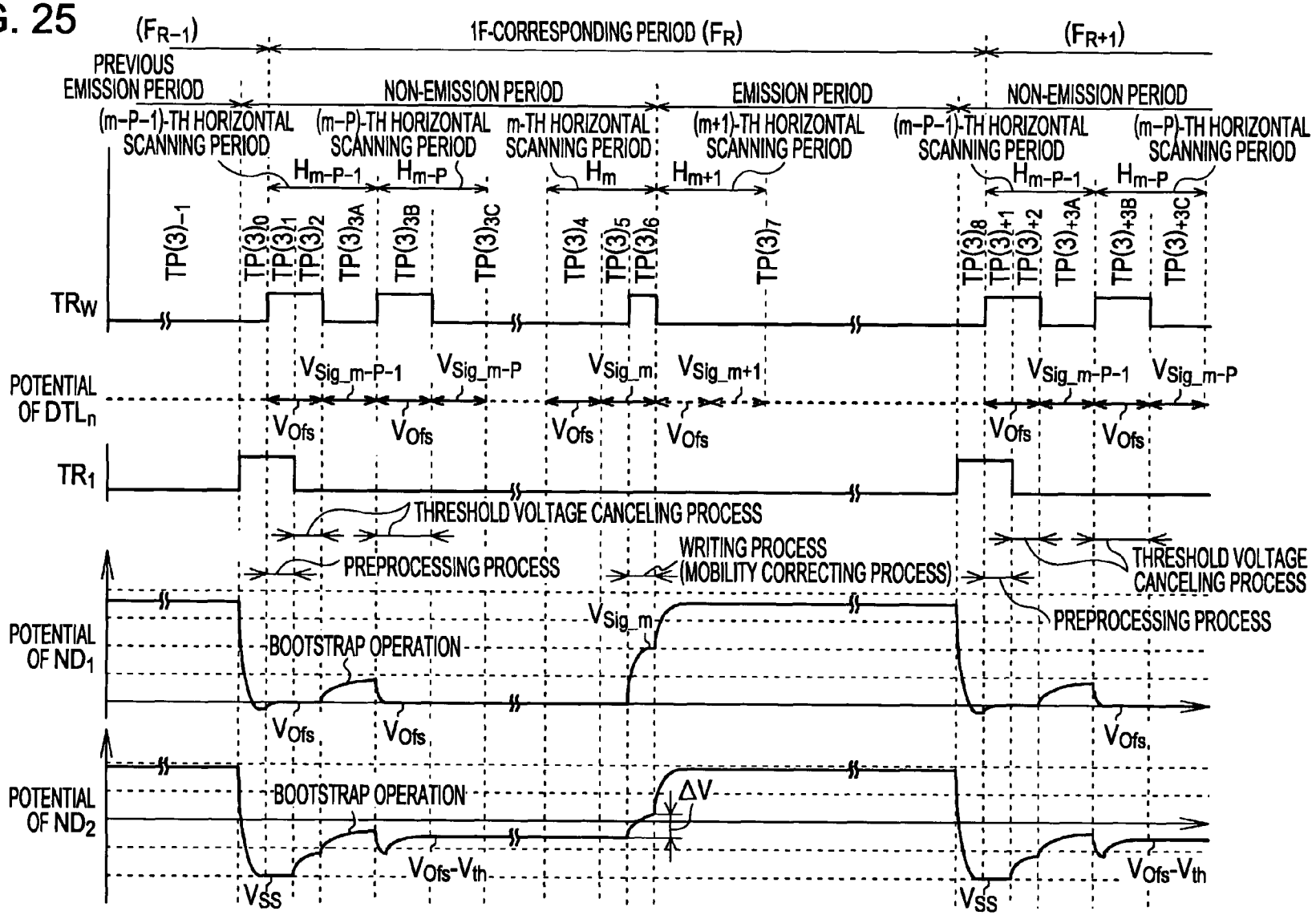
FIG. 25 is a timing diagram schematically illustrating the driving operation of an organic EL light-emitting portion according to Example 8 of the invention.

The timing diagram of the driving operation of the light-emitting portion ELP according to Example 8 is schematically shown in FIG. 25, and the ON and OFF states of the transistors are shown in FIGS. 26A to 26E.

Periods $TP(3)_{-1}$ to $TP(3)_{+3}$ shown in FIG. 25 correspond to periods $TP(2)_{-1}$ to $TP(2)_{+3}$ shown in FIG. 14 referred to by Example 4, respectively. The relations between the initialization period and the image signal period of each horizontal scanning period and periods $TP(3)_{-1}$ to $TP(3)_{+3}$ shown in FIG. 25 are the same as described in periods $TP(2)_{-1}$ to $TP(2)_{+3}$ shown in FIG. 14 in Example 4 and thus the description thereof is omitted.

In driving method according to Example 8, the operations of periods $TP(3)_0$ and $TP(3)_1$ shown in FIG. 25 are the same as the operations in periods $TP(3)_0$ and $TP(3)_1$ described with reference to FIG. 18 in Example 5 and thus the description thereof is omitted. The operations in periods $TP(3)_{2A}$ to $TP(3)_7$ shown in FIG. 25 are substantially the same as the operations in periods $TP(2)_{2A}$ to $TP(2)_7$ described with reference to FIG. 12 in Example 3 and thus the description thereof is omitted.

Example 9

Example 9 relates to a method of driving an organic EL display apparatus according to the second embodiment of the invention. Example 9 is a modified example of Examples 5 to 8. In Example 9, the driving circuit 11 includes four transistors and one capacitor (4Tr/1C driving circuit). The conceptual diagram of the organic EL display apparatus according to Example 9 is shown in FIG. 27 and the equivalent circuit diagram of the organic EL display element 10 including the driving circuit 11 is shown in FIG. 28.

Details of the driving circuit will be described now.

The 4Tr/1C driving circuit includes three transistors these being a writing transistor $TR_W$, a driving transistor $TR_D$, and a first transistor $TR_1$ and one capacitor $C_1$, similarly to the above-mentioned 3Tr/1C driving circuit. The 4Tr/1C driving circuit further includes a second transistor $TR_2$.

Driving Transistor $TR_D$

The configuration of the driving transistor $TR_D$ is the same as the configuration of the driving transistor $TR_D$ described in Example 5 and thus the detailed description thereof is omitted. As described in Example 5, the power source unit 100 applies a constant voltage $V_{CC}$ to one of the source and drain regions of the driving transistor $TR_D$.

Writing Transistor $TR_W$

The configuration of the writing transistor $TR_W$ is the same as the configuration of the writing transistor $TR_W$ described in Example 1 and thus the description thereof is omitted.

First Transistor $TR_1$

The configuration of the first transistor $TR_1$ is the same as the configuration of the first transistor $TR_1$ described in Example 5 and thus the detailed description thereof is omitted.

The driving circuit 11 in Example 9 further includes a second transistor $TR_2$ and the power source unit 100 is connected to one of the source and drain regions of the driving transistor $TR_D$ via the second transistor $TR_2$. This driving circuit is different from that of Examples 5 to 8, in that the second transistor $TR_2$ is turned off when the first transistor $TR_1$ is in the ON state.

Specifically, in the second transistor $TR_2$, (D-1) one of the source and drain regions is connected to the power source unit 100, (D-2) the other of the source and drain regions is connected to one of the source and drain regions of the driving transistor $TR_D$, and (D-3) the gate electrode is connected to a second transistor control line CL. One end of the second transistor control line CL is connected to a second transistor control circuit 104.

It is described in Example 5 that the driving voltage $V_{CC}$ is applied to the second node $ND_2$ via the driving transistor $TR_D$ when the second node initialization voltage $V_{SS}$ is applied to the second node $ND_2$ via the turned-on first transistor $TR_1$. In this case, there is a problem that through current flows through the driving transistor $TR_D$ and the first transistor $TR_1$.

Therefore, in Example 9, the second transistor $TR_2$ is turned off by the signal from the second transistor control circuit 104 when the first transistor $TR_1$ is turned on in the operations described in Examples 5 to 8.

For example, the ON and OFF states of the transistors are shown in FIGS. 29A to 29D where the operations in periods $TP(3)_{-1}$ to $TP(3)_2$ shown in FIG. 18 referred to by Example 5 are performed in Example 9.

As shown in FIG. 29A, in period $TP(3)_{-1}$, the second transistor $TR_2$ is turned on by the signal from the second transistor control circuit 104.

As shown in FIGS. 29B and 29C, in periods $TP(3)_0$ and $TP(3)_1$, the second transistor $TR_2$ is turned off by the signal from the second transistor control circuit 104. Therefore, in these periods, the through current does not flow through the driving transistor $TR_D$ and the first transistor $TR_1$.

As shown in FIG. 29D, in period $TP(3)_2$, the second transistor $TR_2$ is turned off by the signal from the second transistor control circuit 104. After the end of period $TP(3)_2$, the OFF state of the second transistor $TR_2$ is maintained.

Although the operations of Example 9 have been described in comparison with the operations of Example 5, the invention is not limited to the operations. Compared with the operations of Examples 6 to 8, it is possible to prevent the through current from flowing by turning off the second transistor $TR_2$ when the first transistor $TR_1$ is in the ON state.

Example 10

Example 10 relates to a method of driving an organic EL display apparatus according to the second embodiment of the invention. Example 10 is a modified example of Example 9. In Example 10, the driving circuit 11 includes four transistors and one capacitor (4Tr/1C driving circuit). The equivalent circuit diagram of the organic EL display element 10 including the driving circuit 11 constituting an organic EL display apparatus according to Example 10 is shown in FIG. 30. The schematic diagram of the organic EL display apparatus according to Example 10 is the same as shown in FIG. 16 and thus the description thereof is omitted.

Details of the driving circuit will be described now. In Example 10, the second transistor $TR_2$ is formed of a transistor having a conductive type different from that of the first transistor $TR_1$ and the gate electrode of the second transistor $TR_2$ is connected to the first transistor control line AZ1.

Specifically, in Example 10, the first transistor $TR_1$ is formed of an n-channel transistor, similarly to Example 9, and the second transistor $TR_2$ is formed of a p-channel transistor.

According to this configuration, when the first transistor control line AZ1 is at a high level, the first transistor $TR_1$ is in the ON state and the second transistor $TR_2$ is in the OFF state. When the first transistor control line AZ1 is at a low level, the first transistor $TR_1$ is in the OFF state and the second transistor $TR_2$ is in the ON state.

The ON and OFF states of the transistors are shown in FIGS. 31A to 31D where the operations in periods $TP(\mathbf{3})_{-1}$ to $TP(\mathbf{3})_2$ shown in FIG. 18 referred to by Example 5 are performed in Example 10.

As shown in FIG. 31A, in period $TP(\mathbf{3})_{-1}$, the first transistor $TR_1$ is turned off by the signal from the first transistor control circuit 103. At this time, the second transistor $TR_2$ is in the ON state.

As shown in FIGS. 31B and 31C, in periods $TP(\mathbf{3})_0$ and $TP(\mathbf{3})_1$, the first transistor $TR_1$ is turned on by the signal from the first transistor control circuit 103. At this time, the second transistor $TR_2$ is in the OFF state. Therefore, in these periods, the through current does not flow through the driving transistor $TR_D$ and the first transistor $TR_1$.

As shown in FIG. 31D, in period $TP(\mathbf{3})_2$, the first transistor $TR_1$ is turned off by the signal from the first transistor control circuit 103. At this time, the second transistor $TR_2$ is in the ON state. After the end of period $TP(\mathbf{3})_2$, when the first transistor $TR_1$ is maintained in the OFF state, the second transistor $TR_2$ is maintained in the ON state.

Accordingly, as described in Example 9, by turning off the second transistor $TR_2$ when the first transistor $TR_1$ is in the ON state, it is possible to prevent the through current from flowing. In addition, Example 10 has an advantage that the second transistor control circuit 104 and the second transistor control line CL of Example 9 are not necessary.

The present application contains subject matter related to that disclosed in Japanese Priority Patent Application JP 2008-311805 filed in the Japan Patent Office on Dec. 8, 2008, the entire content of which is hereby incorporated by reference.

Although the preferred examples of the invention have been described, the invention is not limited to the examples. The configurations and structures of various elements of the organic EL display apparatus, the organic EL display elements, and the driving circuits and the steps of the light-emitting portion driving method described in the examples are only examples and may be properly modified.

What is claimed is:

1. A method of driving an organic electroluminescence (EL) display apparatus having (1) a scanning circuit, (2) a signal output circuit, (3) organic EL display elements of which N×M of N in a first direction and M in a second direction different from the first direction are arranged in a two-dimensional matrix, each organic EL display element having an organic EL light-emitting portion and a driving circuit driving the organic EL light-emitting portion, (4) M scanning lines connected to the scanning circuit to extend in the first direction, (5) N data lines connected to the signal output circuit to extend in the second direction, and (6) a power source unit, wherein the driving circuit includes a writing transistor, a driving transistor, and a capacitor, wherein (A-1) one of source and drain regions of the driving transistor is connected to the power source unit, (A-2) the other of the source and drain regions is connected to an anode of the organic EL light-emitting portion and one electrode of the capacitor to form a second node, and (A-3) the gate electrode thereof is connected to the other of source and drain regions of the writing transistor and the other electrode of the capacitor to form a first node, and wherein (B-1) one of the source and drain regions of the writing transistor is connected to the corresponding data line, and (B-2) the gate electrode thereof is connected to the corresponding scanning line, wherein when the organic EL display elements in the first row to the M-th row are line-sequentially scanned and a period allocated to scan the organic EL display elements in the respective rows is represented by a horizontal scanning period, each horizontal scanning period includes an initialization period where the signal output circuit applies a first node initializing voltage to the corresponding data lines and an image signal period where the signal output circuit applies an image signal to the corresponding data lines, the method comprising the steps of:

in the organic EL display element in the m-th row (where m=1, 2, 3, . . . , M) and n-th column (where n=1, 2, 3, . . . , N) where the horizontal scanning period including the image signal period corresponding to the organic EL display elements in the m-th row is represented by a horizontal scanning period $H_m$ and the horizontal scanning period previous to the horizontal scanning period $H_m$ by P horizontal scanning periods (where P satisfies 1<P<M and is a predetermined value in the organic EL display apparatus) is represented by a horizontal scanning period $H_{m_pre_P}$, (a) performing a preprocessing process of initializing the potential of the first node and the potential of the second node, so that the potential difference between the first node and the second node is greater than the threshold voltage of the driving transistor and the potential difference between the second node and the cathode of the organic EL light-emitting portion is not greater than the threshold voltage of the organic EL light-emitting portion, in an initialization period located before the end of the horizontal scanning period $H_{m_pre_P}$ by applying a first node initialization voltage to the first node from the corresponding data line via the writing transistor turned on by the operation of the scanning circuit to initialize the potential of the first node and applying a second node initialization voltage to the one of the source and drain regions of the driving transistor from the power source unit to initialize the potential of the second node;

(b) switching the voltage of the power source unit from the second node initialization voltage to a driving voltage and holding the state where the driving voltage is applied to the one of the source and drain regions of the driving transistor from the power source unit;

(c) performing a threshold voltage canceling process of changing the potential of the second node until the potential obtained by subtracting the threshold voltage of the driving transistor from the first node initialization voltage to turn off the driving transistor in the initialization period of the horizontal scanning period $H_{m_pre_P}$, by applying the driving voltage to the one of the source and drain regions of the driving transistor from the power source unit in a state where the writing transistor is turned on in the initialization period by the operation of the scanning circuit and the first node initialization voltage is applied to the first node from the data line via the turned-on writing transistor;

(d) changing the first node to a floating state and holding the OFF state of the driving transistor, by turning off the writing transistor by the operation of the scanning circuit;

(e) performing a writing process of applying the image signal to the first node from the data line in the image signal period of the horizontal scanning period $H_m$ via the writing transistor turned on by the operation of the scanning circuit; and (f) changing the first node to a floating state and allowing current corresponding to the potential difference between the first node and the second node to flow to the organic EL light-emitting portion via the driving transistor from the power source unit by turning off the writing transistor by the operation of the scanning circuit.

2. The method according to claim 1, wherein between the step of (d) and the step of (e) are performed the steps of:

(g) performing a second preprocessing process of initializing the potential of the first node and the potential of the second node, so that the potential difference between the first node and the second node is greater than the threshold voltage of the driving transistor and the potential difference between the second node and the cathode of the organic EL light-emitting portion is not greater than the threshold voltage of the organic EL light-emitting portion, in the initialization period by applying the first node initialization voltage to the first node from the corresponding data line via the writing transistor turned on by the operation of the scanning circuit to initialize the potential of the first node and applying a second node initialization voltage to the one of the source and drain regions of the driving transistor from the power source unit to initialize the potential of the second node;

(h) switching the voltage of the power source unit from the second node initialization voltage to a driving voltage and holding the state where the driving voltage is applied to the one of the source and drain regions of the driving transistor from the power source unit; and (i) performing a second threshold voltage canceling process of changing the potential of the second node until the potential obtained by subtracting the threshold voltage of the driving transistor from the first node initialization voltage to turn off the driving transistor in the initialization period located before the end of the horizontal scanning period $H_m$, by applying the driving voltage to the one of the source and drain regions of the driving transistor from the power source unit in a state where the writing transistor is turned on in the initialization period by the operation of the scanning circuit and the first node initialization voltage is applied to the first node from the data line via the turned-on writing transistor.

3. The method according to claim 1, wherein the signal output circuit applies a first initialization voltage as the first node initialization voltage to the data line in the initialization period and then applies a second initialization voltage lower than the first initialization voltage as the first node initialization voltage to the data line instead of the first initialization voltage.

4. A method of driving an organic electroluminescence (EL) display apparatus having (1) a scanning circuit, (2) a signal output circuit, (3) organic EL display elements of which N×M of N in a first direction and M in a second direction different from the first direction are arranged in a two-dimensional matrix, each organic EL display element having an organic EL light-emitting portion and a driving circuit driving the organic EL light-emitting portion, (4) M scanning lines connected to the scanning circuit to extend in the first direction, (5) N data lines connected to the signal output circuit to extend in the second direction, and (6) a power source unit, wherein the driving circuit includes a writing transistor, a driving transistor, and a capacitor, wherein (A-1) one of source and drain regions of the driving transistor is connected to the power source unit, (A-2) the other of the source and drain regions is connected to an anode of the organic EL light-emitting portion and one electrode of the capacitor to form a second node, and (A-3) the gate electrode thereof is connected to the other of source and drain regions of the writing transistor and the other electrode of the capacitor to form a first node, wherein (B-1) one of the source and drain regions of the writing transistor is connected to the corresponding data line, and (B-2) the gate electrode thereof is connected to the corresponding scanning line, wherein when the organic EL display elements in the first row to the M-th row are line-sequentially scanned and a period allocated to scan the organic EL display elements in the respective rows is represented by a horizontal scanning period, each horizontal scanning period includes an initialization period where the signal output circuit applies a first node initializing voltage to the corresponding data lines and an image signal period where the signal output circuit applies an image signal to the corresponding data lines, wherein the driving circuit further includes a first transistor, and wherein (C-1) the other of source and drain regions of the first transistor is connected to the second node, (C-2) one of the source and drain regions is supplied with a second node initialization voltage for initializing the potential of the second node, and (C-3) the gate electrode thereof is connected to a first transistor control line, the method comprising the steps of:

in the organic EL display element in the m-th row (where m=1, 2, 3, . . . , M) and n-th column (where n=1, 2, 3, . . . , N) where the horizontal scanning period including the image signal period corresponding to the organic EL display elements in the m-th row is represented by a horizontal scanning period $H_m$ and the horizontal scanning period previous to the horizontal scanning period $H_m$ by P horizontal scanning periods (where P satisfies 1<P<M and is a predetermined value in the organic EL display apparatus) is represented by a horizontal scanning period $H_{m_pre_P}$, (a) performing a preprocessing process of initializing the potential of the first node and the potential of the second node, so that the potential difference between the first node and the second node is greater than the threshold voltage of the driving transistor and the potential difference between the second node and the cathode of the organic EL light-emitting portion is not greater than the threshold voltage of the organic EL light-emitting portion, in an initialization period located before the end of the horizontal scanning period $H_{m_pre_P}$ by applying a first node initialization voltage to the first node from the corresponding data line via the writing transistor turned on by the operation of the scanning circuit to initialize the potential of the first node and applying the second node initialization voltage to the second node via the first transistor turned on by a signal from the first transistor control line to initialize the potential of the second node;

(b) switching the first transistor from the ON state to the OFF state by the signal from the first transistor control line;

(c) performing a threshold voltage canceling process of changing the potential of the second node until the potential obtained by subtracting the threshold voltage of the driving transistor from the first node initialization voltage to turn off the driving transistor in the initialization period of the horizontal scanning period $H_{m_pre_P}$, by applying the driving voltage to the one of the source and drain regions of the driving transistor from the power source unit in a state where the writing transistor is turned on in the initialization period by the operation of the scanning circuit and the first node initialization voltage is applied to the first node from the data line via the turned-on writing transistor;

(d) changing the first node to a floating state and holding the OFF state of the driving transistor, by turning off the writing transistor by the operation of the scanning circuit;

(e) performing a writing process of applying the image signal to the first node from the data line in the image signal period of the horizontal scanning period $H_m$ via the writing transistor turned on by the operation of the scanning circuit; and (f) changing the first node to a floating state and allowing current corresponding to the potential difference between the first node and the second node to the organic EL light-emitting portion via the driving transistor from the power source unit by turning off the writing transistor by the operation of the scanning circuit.

5. The method according to claim 4, wherein between the step of (d) and the step of (e) is performed the steps of:

(g) performing a second preprocessing process of initializing the potential of the first node and the potential of the second node, so that the potential difference between the first node and the second node is greater than the threshold voltage of the driving transistor and the potential difference between the second node and the cathode of the organic EL light-emitting portion is not greater than the threshold voltage of the organic EL light-emitting portion, in the initialization period by applying the first node initialization voltage to the first node from the corresponding data line via the writing transistor turned on by the operation of the scanning circuit to initialize the potential of the first node and applying the second node initialization voltage to the second node via the first transistor turned on by the signal from the first transistor control line to initialize the potential of the second node;

(h) switching the first transistor from the ON state to the OFF state by the signal from the first transistor control line; and (i) performing a second threshold voltage canceling process of changing the potential of the second node until the potential obtained by subtracting the threshold voltage of the driving transistor from the first node initialization voltage to turn off the driving transistor in the initialization period located before the end of the horizontal scanning period $H_m$, by applying the driving voltage to the one of the source and drain regions of the driving transistor from the power source unit in a state where the writing transistor is turned on in the initialization period by the operation of the scanning circuit and the first node initialization voltage is applied to the first node from the data line via the turned-on writing transistor.

6. The method according to claim 4, wherein the signal output circuit applies a first initialization voltage as the first node initialization voltage to the data line in the initialization period and then applies a second initialization voltage lower than the first initialization voltage as the first node initialization voltage to the data line instead of the first initialization voltage.

7. The method according to claim 4, wherein the driving circuit further includes a second transistor, wherein the power source unit is connected to the one of the source and drain regions of the driving transistor via the second transistor, and wherein the second transistor is turned off when the first transistor is in the ON state.

8. The method according to claim 7, wherein the second transistor is a transistor having a conductive type different from that of the first transistor and the gate electrode of the second transistor is connected to the first transistor control line.

* * * * *